US012208865B2

(12) United States Patent
Ceraolo

(10) Patent No.: US 12,208,865 B2
(45) Date of Patent: Jan. 28, 2025

(54) WATERCRAFT MOORING SYSTEM

(71) Applicant: Christopher G. Ceraolo, Mooresville, NC (US)

(72) Inventor: Christopher G. Ceraolo, Mooresville, NC (US)

( * ) Notice: Subject to any disclaimer, the term of this patent is extended or adjusted under 35 U.S.C. 154(b) by 492 days.

(21) Appl. No.: 17/833,704

(22) Filed: Jun. 6, 2022

(65) Prior Publication Data

US 2023/0331350 A1 Oct. 19, 2023

Related U.S. Application Data

(60) Provisional application No. 63/197,437, filed on Jun. 6, 2021.

(51) Int. Cl.
*B63B 21/00* (2006.01)

(52) U.S. Cl.
CPC ..... *B63B 21/00* (2013.01); *B63B 2021/006* (2013.01)

(58) Field of Classification Search
CPC ..... B63B 21/00; B63B 2021/006
See application file for complete search history.

(56) References Cited

U.S. PATENT DOCUMENTS 3,974,794 A * 8/1976 Kakitani ..... B63B 59/02 114/230.17
4,144,831 A 3/1979 Heydolph
4,751,892 A 6/1988 Sechel et al.
4,817,551 A 4/1989 Matson
5,676,085 A * 10/1997 Michl, Jr. ..... B63B 21/00 114/230.17
6,561,113 B2 * 5/2003 Leise ..... B63B 21/00 114/221 R
7,089,877 B1 * 8/2006 Hay ..... B63B 21/00 114/221 R
7,229,059 B1 * 6/2007 Hood ..... F16M 13/022 248/205.8
7,293,519 B2 * 11/2007 Montgomery ..... B63B 21/00 114/230.1
7,418,913 B2 * 9/2008 Dowd ..... B63B 21/00 114/230.17
7,637,222 B1 * 12/2009 Keely ..... B63B 21/00 114/230.17

(Continued)

FOREIGN PATENT DOCUMENTS

AU 2022202114 A1 * 10/2022 ..... B63B 21/00
WO WO-2022212103 A1 * 10/2022 ..... B63B 21/00

*Primary Examiner* — S. Joseph Morano
*Assistant Examiner* — Jovon E Hayes
(74) *Attorney, Agent, or Firm* — Memminger E. Wiggins

(57) ABSTRACT

A watercraft mooring system comprising a plurality of interchangeable mooring components for the temporary mooring of one watercraft to another watercraft or one watercraft to a stationary object such as a dock. The interchangeable mooring components comprising a connecting rod member, a vacuum-handle member, and a cleat connector member. The connector rod member has an adjustable length. The vacuum handle member includes a pair of vacuum cup assemblies and is pivotally and detachably connected to the first or second end of the connecting rod member. The vacuum handle member and the cleat connector member are interchangeable. At least one vacuum means provides vacuum to the vacuum cup assemblies.

16 Claims, 40 Drawing Sheets

(56) References Cited

U.S. PATENT DOCUMENTS

| | | | | |
|---|---|---|---|---|
| 8,091,499 | B1 * | 1/2012 | Perez | B63B 21/00 114/230.15 |
| 8,156,883 | B2 * | 4/2012 | Sheedy | B63B 59/02 114/219 |
| 8,800,461 | B2 | 8/2014 | Gagan, II | |
| 8,857,359 | B1 * | 10/2014 | Gonzalez | B63B 21/00 114/230.17 |
| 9,027,496 | B2 * | 5/2015 | Zucco | E02B 3/20 114/230.15 |
| 9,199,696 | B1 * | 12/2015 | Bonell | B63B 21/00 |
| 9,505,465 | B2 | 11/2016 | Wright et al. | |
| 11,319,029 | B2 * | 5/2022 | Logan | B63B 21/00 |
| 11,319,031 | B1 * | 5/2022 | Perry | B63B 59/00 |
| 2009/0230686 | A1 * | 9/2009 | Catlin | F03B 13/264 290/54 |
| 2016/0340948 | A1 * | 11/2016 | McCullough | E05C 19/00 |
| 2021/0214047 | A1 * | 7/2021 | Gonzales | B63B 21/00 |
| 2021/0371051 | A1 * | 12/2021 | Givens | B63B 21/00 |
| 2022/0048598 | A1 | 2/2022 | Gonzlez et al. | |
| 2022/0212758 | A1 * | 7/2022 | Vanberg | B63B 21/00 |

* cited by examiner

WATERCRAFT MOORING SYSTEM

CROSS-REFERENCE TO RELATED APPLICATIONS

This application claims priority to and incorporates by reference herein U.S. Provisional Application No. 63/197,437 filed on Jun. 6, 2021 and titled "Watercraft Mooring System".

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO SEQUENCE LISTING, A TABLE, OR A COMPUTER PROGRAM LISTING SUBMITTED ON A COMPACT DISC WITH APPENDIX

Not Applicable.

FIELD OF THE INVENTION

The present invention is directed towards a mooring system for watercraft. More specifically, the present invention relates to a multi-component device that permits the mooring of watercraft of various shapes and sizes to be moored to one another or to a stationary object such as a dock.

BACKGROUND OF THE INVENTION

One primary objective of watercraft is the transportation of persons or goods from one location to another location. On the arrival of the watercraft at its desired location, it is generally necessary to moor the watercraft to a stationary object or to another watercraft for the off-loading of passengers or goods. Also, it is often desired by boaters to moor their watercraft to the watercraft of another to be part of a on-water social gathering. As such, various attempts have been made to provide the boating public with safe and reliable methods and devices to temporarily moor their watercraft to one another or to a boat dock. Often the devices developed for the temporary mooring of watercraft are complex and costly and not very effective.

Often ropes and boat fenders are used singly or in combination with one another to moor watercraft. However, these methods are often subject to limited success often as a result of common environmental conditions typically found on and around most bodies of water such as undulating waves, watercraft wakes, and water currents. Under such conditions ropes and boat fenders may shift and fail maintain their original position.

Some of the devices developed for the mooring of watercraft to docks or other watercraft are large and cumbersome and thus such items are not portable nor inexpensive. Portability and affordability of boating products are important factors to most boaters.

Some approaches to the mooring of watercraft to one another have employed the use of stretchable cords that are configured with various hooks. This such system is subject to component degradation and failure.

The use of boat fenders alone fails to reliably maintain the distance moored watercraft the result of which may damage to the watercraft, the dock, or to inattentive persons.

Additionally, most watercraft mooring devices do not provide interchangeable mooring components for different kinds of mooring circumstances or different sizes of watercraft, for example the mooring of boat to boat, boat to personal watercraft, or boat to dock.

The safe and effective mooring of the watercraft continues to be a challenge even though various mooring devices have been developed.

Accordingly, there remains room for improvement and variation within the art.

SUMMARY OF THE INVENTION

The present disclosure describes at least one embodiment for a watercraft mooring system which provides a simple and innovative system for the mooring of a first watercraft to a second watercraft at a safe distance from one another, or for the mooring of a single watercraft to a stationary object such as a boat dock, and avoid the complications, and sometimes dangers, generally associated with the use fenders and ropes for such mooring devices and activities. The present mooring system is designed and adapted to accommodate various kinds and sizes of watercraft including motorboats or sail boats and personal watercraft such as jet-skis. The primary interchangeable mooring components for one preferred embodiment of the present invention include a connecting rod member, a vacuum-handle member, and a cleat connector member. The vacuum-handle member and the cleat connector member are both independently operational from each other, independently interchangeable with the connecting rod member, and are detachably attachable to the object to which such mooring component is temporarily attached, such as the surface of a watercraft or to a cleat attached to a dock or another watercraft. The present invention being compact, lightweight, corrosion and heat resistant, and provides for easy installation and reconfiguration of the mooring components.

It is therefore at least one aspect of the present embodiments to provide a watercraft mooring system comprising a connecting rod member having a first end and a second end.

It is therefore at least one aspect of the present embodiments to provide a connecting rod member comprising a first telescopic member being designed and adapted to optionally engage a tubular coupler for connecting the first telescopic member to a second telescopic member.

It is therefore at least one aspect of the present embodiments to provide a connecting rod member comprising first and second telescopic members having respective first and second extension locks respectively.

It is therefore at least one aspect of the present embodiments to provide a watercraft mooring system comprising first and second vacuum handle members pivotally secured to the first and second ends of the connecting rod member respectively.

It is therefore at least one aspect of the present embodiments to provide each vacuum handle member having a handle mount and a vacuum cup assembly secured to the handle mount with the vacuum cup assembly having a first vacuum cup operationally associated with a first vacuum cup assembly, a second vacuum cup operationally associated with a second vacuum cup assembly, and at least one vacuum means for providing at least one vacuum to the first and second vacuum cups for detachable attachment of the at least one vacuum-handle member to the at least one watercraft.

It is therefore at least one aspect of the present embodiments to provide that the first vacuum-handle member is replaced with a first cleat connector member being designed and adapted for detachable attachment to a cleat and for detachable attachment to the first end of the connecting rod member.

It is therefore at least one aspect of the present embodiments to provide that the second vacuum-handle member is replaced with a cleat connector member being designed and adapted for detachable attachment to a cleat and for detachable attachment to the second end of the connecting rod member.

It is therefore at least one aspect of the present embodiments to provide a watercraft mooring system comprising a connecting rod member having a first end and a second end; a first extension lock secured to the first end of the connecting rod member; a second extension lock secured to the second end of the connecting rod member; a first piston connecting rod telescopically engaged to the first extension lock; a second piston connecting rod telescopically engaged to the second extension lock; a first vacuum-handle member pivotally and removably secured to first piston connecting rod; a second vacuum-handle member pivotally and removably secured to the second piston connecting rod, each vacuum handle member comprising a handle mount engaged to the piston connecting rod; a vacuum assembly contained within the handle mount; a first vacuum cup assembly pivotally engaged to the handle mount; and a second vacuum cup assembly pivotally engaged to the handle mount, each vacuum cup assembly comprising a vacuum cup mount secured to a vacuum cup and operationally associated with the vacuum assembly.

It is therefore at least one aspect of the present embodiments to provide the vacuum assembly contained within the handle mount is a motion-actuated vacuum means for providing a continuous vacuum to the first vacuum cup assembly and to the second vacuum cup assembly to maintain the first vacuum-handle member's detachable attachment and the second vacuum-handle member's detachable attachment to a watercraft or dock, the motion-actuated vacuum means comprising a spherical continuous vacuum assembly.

It is therefore at least one aspect of the present embodiments to provide that the vacuum assembly contained within the handle mount is a motion-actuated vacuum means for providing a continuous vacuum to the first vacuum cup assembly and to the second vacuum cup assembly to maintain the first vacuum-handle member's detachable attachment and the second vacuum-handle member's detachable attachment to a watercraft or dock; each handle mount having a handle mount inner surface and a handle mount outer surface, the handle mount defining a lower handle grip, an upper handle grip, a cylindrical socket being defined by the upper handle grip and designed and adapted to house an initial vacuum means, the initial vacuum means comprising a thumb-plunger vacuum assembly, a plurality of vacuum channels operatively connecting the initial vacuum means and the motion-actuated vacuum means to the first and second vacuum cup assemblies, a handle mount inner surface spherical socket designed and adapted to house the motion-actuated vacuum means, the motion-actuated vacuum means comprising a spherical continuous vacuum assembly, a first vacuum cup ball joint socket, designed and adapted to mount/secure said first vacuum cup assembly; a second vacuum cup ball joint socket, designed and adapted to mount/secure said second vacuum cup assembly, a second vacuum channel connecting the motion-actuated vacuum means to the first vacuum cup assembly and the second vacuum cup assembly.

These and other features, aspects, and advantages of the present invention will become better understood with regard to the following description, appended claims, and accompanying drawings

DESCRIPTION OF PREFERRED EMBODIMENTS ON THE INVENTION

Figure 1:
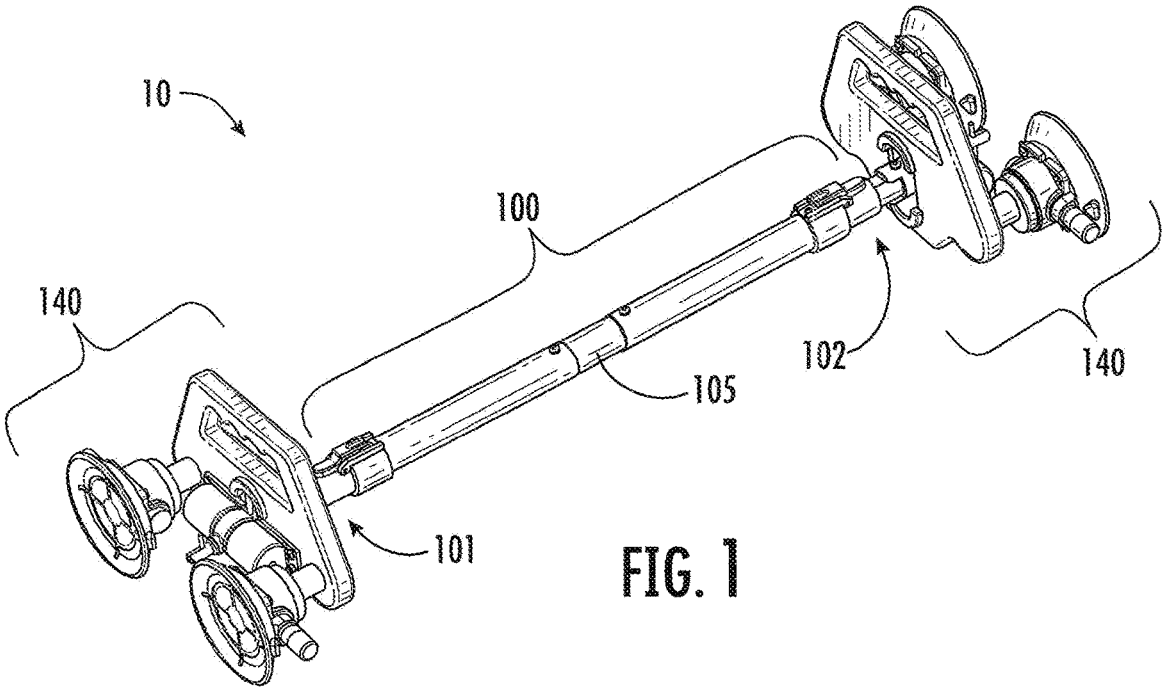
FIG. 1 is a perspective view for one embodiment of the present invention.
Figure 2:
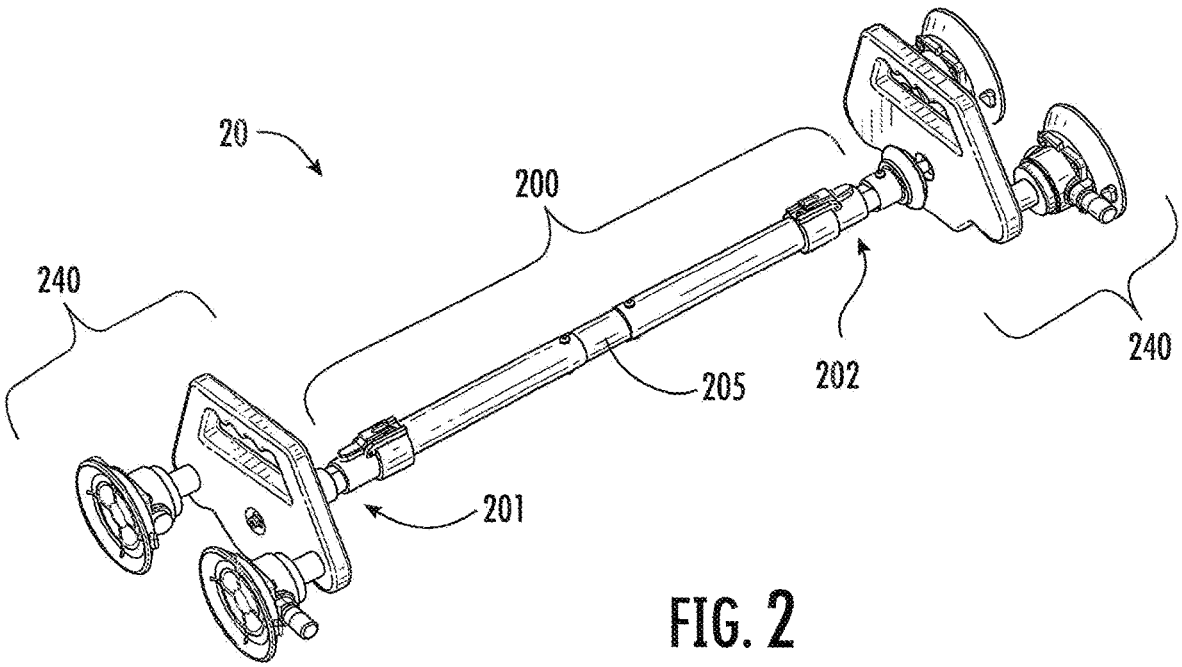
FIG. 2 is a perspective view for one embodiment of the present invention.
Figure 3:
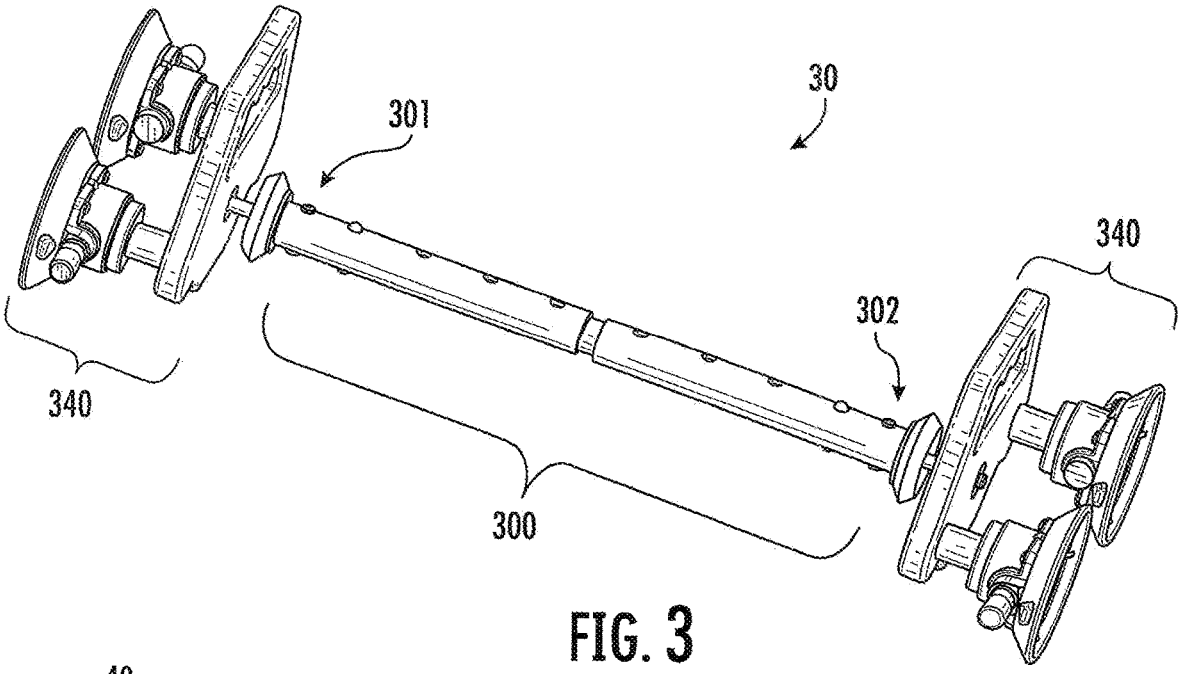
FIG. 3 is a perspective view for one embodiment of the present invention.
Figure 4:
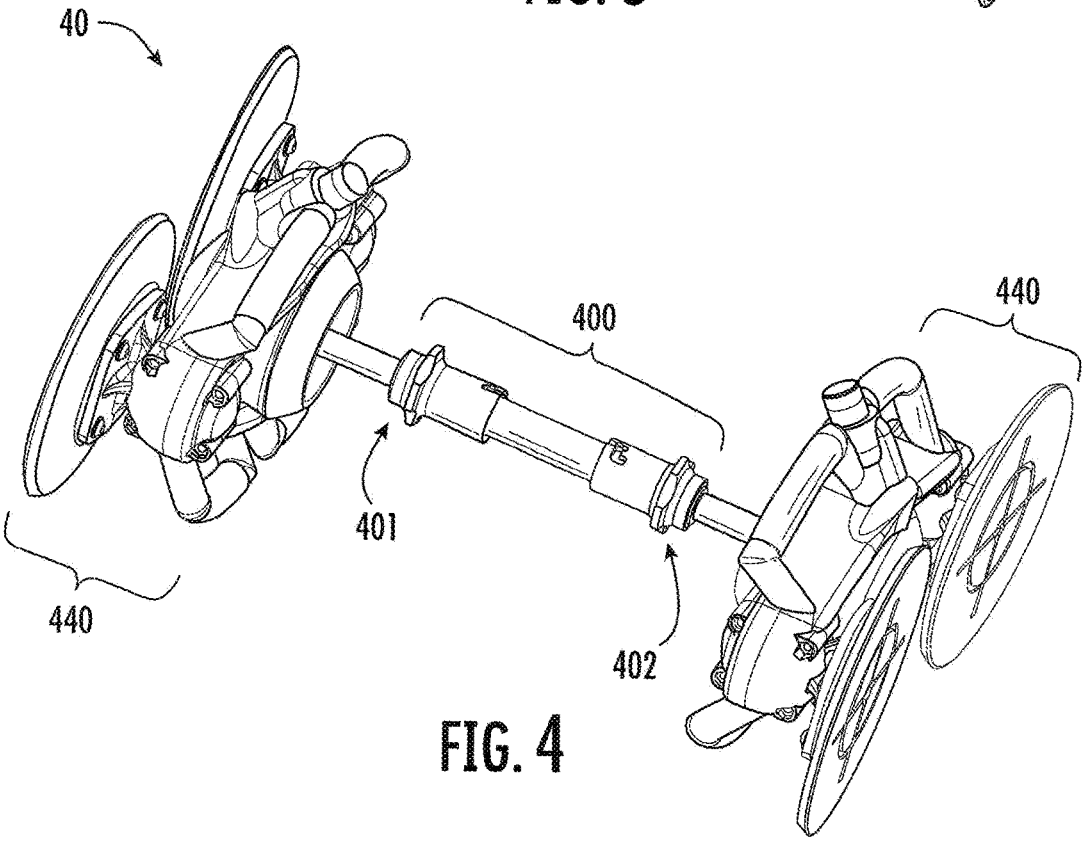
FIG. 4 is a perspective view for one embodiment of the present invention.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention. Which broader aspects are embodied in the exemplary constructions.

In describing the various figures herein, the same reference numbers are used throughout to describe the same material, item, aspect, or feature of the present invention. To avoid redundancy, detailed descriptions of much of the present invention once described in relation to a figure is not necessarily repeated in the descriptions of subsequent figures, although such material, item, aspect, or feature is labeled with the same reference numbers. Additionally, once a named material, item, aspect, or feature is introduced in this written description for the present invention with its reference number, such reference number may not necessarily accompany subsequent entries or reference to such material, item, aspect, or feature.

The components for various preferred embodiments of the present invention, a watercraft mooring system, may be manufactured from plastics and/or lightweight metals such as aluminum, or such other lightweight materials capable of providing the required structural integrity for the invention to perform its intended function(s).

Prior to referring to the drawings, definitions and explanations are offered to assist the reader in understanding this description.

The term "adjustable length" when referenced in conjunction with the connecting rod member for the present invention means the distance as measured from the connecting rod member first end to the connecting rod member second end.

The term "connecting rod member" when referenced without regard to the individual components of which it is comprised is meant to be understood as an interchangeable mooring member having a connecting rod member first end and a connecting rod member second end, and it is the interchangeable mooring member to which other interchangeable mooring members may be individually detachably attached to the connecting rod member's first or second ends. In certain configurations/descriptions of the present invention the connecting rod may be comprised of a single "telescopic member" and in such configurations the first and second ends of the "connecting rod member" will coincide with the first and second ends of the "telescopic member".

However, in certain configurations of the present invention the "connecting rod member" will be comprised of two "telescopic members" such that the second end of the first telescopic member is connected, or coupled, to the second end of the second telescopic member. In this "connected/coupled" configuration the connected telescopic members will be described collectively and understood to function as a single "connecting rod member" having a "connecting rod member first end" and a "connecting rod member second end". NOTE: The connecting rod member comprising a connecting rod member first end and a connecting rod member second end. The connecting rod member first end is analogous to the first telescopic member first end which is analogous to the first inner tube first end of the first telescopic member. The connecting rod member second end is analogous to the second telescopic member first end which is analogous to the second inner tube first end of the second telescopic member.

Also, it is important to note that unless otherwise described, a "telescopic member" is comprised of individual tubular components and each such tubular component will have its own specific first and second end with each end being described accordingly. Additionally, the first and second ends of the individual components may not be analogous to the first and second ends of the combined structure (i.e., the "telescopic member" or the "connecting rod member").

For example, a telescopic member of the present invention comprises an inner tube having first and second ends and an outer tube having first and second ends. In a configuration of the present invention with a single telescopic member the first end of inner tube will coincide with the first end of the "telescopic member" and the first end of the "connecting rod member. However, it will be the second end of the telescopic member's outer tube (not the second end of the telescopic member's inner tube) that will coincide with the second ends of the "telescopic member" or the "connecting rod member". Similar nomenclature differences will occur when two "telescopic members" are connected/coupled to construct a single "connecting rod member".

The term "detachably attached" when referenced here means the fastening of one component to another component in a manner and with the intention such that components may be detached from each other by hand or by a simple hand-operated tool (i.e., screwdriver, pliers, hand wrench, adjustable wrench, etc.).

The term "relative movement" when referenced herein means any vertical or horizontal movement or displacement of one watercraft relative to another watercraft or to a stationary object during the temporary mooring of the watercraft(s) with the present invention.

The term "separation distance" is the specific distance between the first vacuum cup assembly and the second vacuum cup assembly that provides optimum functionality of a vacuum-handle member such that the first and second vacuum cup assemblies performs as a single unit as opposed to two separate vacuum cup assemblies which results in greater push and pull force.

The term "telescopic" when used herein to describe an aspect for the present invention means and describes a configuration in which an inner tubular component, or a non-tubular component, is designed and configured to slidably extend into or out of a stationary outer tubular component. Each end of such stationary outer tubular component may slidably receive an inner tubular component, or a non-tubular component. Alternatively, the term "telescopic" also includes the configuration in which a first outer tubular component slides outward or inward over a stationary inner tubular component, or a stationary inner non-tubular component. In this configuration a second outer tubular component may slide outward or inward over a stationary inner tubular component opposite to the first outer tubular component.

The term "tube" and/or "tubular" when referenced herein with regard to a component of the present invention structurally means a hollow elongated cylinder with opposing open ends and an inner bore traversing the length of the hollow elongated cylinder and connecting the opposing open ends. Any "non-tubular" component of the present invention means an elongated cylinder with opposing ends and no inner bore traversing the length of the elongated cylinder. Also, unless specifically noted as being otherwise, a "connecting rod member" when used herein is a tubular item of the present invention as it is always comprised of one or more tubular members.

The singular forms "a", "an" and "the" are intended to include the plural forms as well, unless the context clearly indicates otherwise. It will be further understood that the terms "having", "including", "comprises" and/or "comprising" when used in this specification, specify the presence of stated features, integers, steps, operations, elements, and/or components, but do not preclude the presence or addition of one or more other features, integers, steps, operations, elements, components, and/or groups thereof.

In the description of exemplary embodiments, relative terms such as "angled", "upper", "lower", "upward", "downward", "forward", "rearward", "inward", "outward", "left", "leftward", "right", "rightward", "middle", "midway", "contiguous", "parallel", "coplanar", "horizontal", "vertical", "lateral", "above", "below", "up", "down", "top", "bottom", "front", and "back" as well as derivatives thereof (e.g., "horizontally", "downwardly", "upwardly", "inwardly", "outwardly", "vertically", "perpendicularly") should be construed to refer to the orientation as then described or as shown in the drawing under the discussion.

In describing specific components or elements of the present invention when such component or element is referred to herein as being connected, coupled, or fastened to another component or element it can be directly connected, coupled, or fastened to the to the other component or element or intervening elements that may be present. In contrast, when a component or element is referred to herein as being directly connected, coupled, or fastened to another component or element, there are no intervening components or elements present. Moreover, although the drawings illustrate connection of some components or elements by means of fasteners comprising threaded screws and bolts with or without nuts, pins, cotter pins, spring biased button fasteners, ball detents, rivets, quick-release connectors, adhesives, or such other similar devices and mechanisms, provided such means does not interfere with the operation or structural integrity of the device.

The present invention as described herein is a watercraft mooring system comprised of a plurality of interchangeable mooring components. Although four embodiments for the present invention are provided, it is understood that a person of ordinary skill in the art would recognize that additional embodiments for the present invention may be desirable and probable since the combination of mooring components may be varied and/or dictated by the needs and desires of a user. As such, the four embodiments presented herein are intended as examples of combinations of the interchangeable mooring components for the present invention that are most likely to be used for the temporary mooring of one watercraft to another watercraft, or the temporary mooring of one watercraft to a dock or such other stationary object as appropriate. Therefore, the number of interchangeable components utilized and the configuration of such components will be determined by the needs and wants of the user, hence the present invention constitutes a "system" for the temporally mooring watercraft.

In the embodiment descriptions that follow redundancy within and between the preferred embodiments producing lengthy explanation and description. However, the redundancy is provided to assist the reader's understanding of the present invention.

Figure 68:
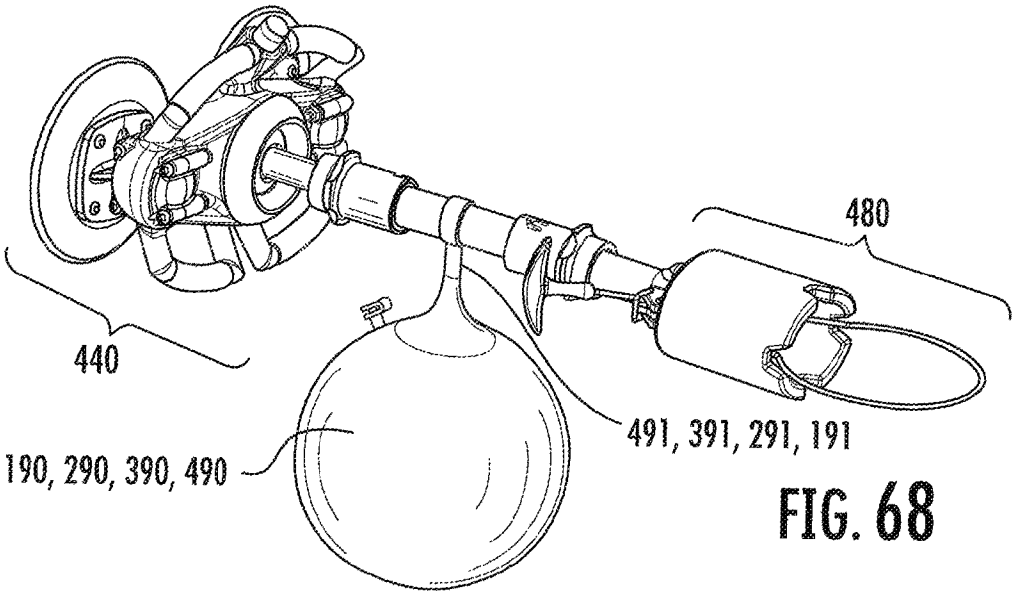
FIG. 68 is a perspective view for one embodiment of the present invention illustrating a safety device tethered to a connecting rod member.

As seen in reference to FIGS. 1 to 68, a watercraft mooring system 10, 20, 30, 40 is provided. Although certain features of the present invention may not be visible on the drawings provided in the FIGS. 1 to 68 for this disclosure, it is to be understood such features are presented within the written description of the present invention as provided herein.

In accordance with the embodiments disclosed for the present invention, a system for the temporary mooring of watercraft 10, 20, 30, 40, is herein disclosed having a plurality of interchangeable mooring members that are designed and adapted for 1) the temporary mooring of a first watercraft to a second watercraft, 2) the temporary mooring of a first watercraft to a cleat affixed to a dock, or to such other stationary object, or 3) the temporary mooring of a first watercraft to a cleat affixed to a second watercraft. The configurations of the interchangeable mooring members for certain preferred embodiments of the present invention may be directed by the size and type of the watercraft being temporarily moored, as well as the object to which a particular watercraft is being moored. Such watercraft include, but are not limited to, motorboats, pontoon boats, sail boats, non-motorized boat, and various personal watercraft.

In light of the similarities between the configurations of the embodiments for the present invent as disclosed herein, a labelling/numbering convention which highlights such configuration similarities is employed in the description of the four embodiments provided for the present invention. Embodiment 1 components are generally numbered with labels from 100-199. Embodiment 2 components are generally numbered with labels from 200-299. Embodiment 3 components are generally numbered with labels from 300-399. Embodiment 4 components are generally numbered with labels from 400-499. When possible analogous parts/components between embodiments are similarly numbered. For example, in Embodiment 1 for the present invention the [1$^{st}$] at least one vacuum-handle member and its components are numbered from 140 thru 159. In Embodiment 2 for the present invention the [2nd] at least one vacuum-handle member and its components are numbered from 240 thru 259. In Embodiment 3 for the present invention the [3rd] at least one vacuum-handle member and its components are numbered from 340 thru 359. In Embodiment 4 for the present invention the [4th] at least one vacuum-handle member and its components are numbered from 440 thru 459. It should be noted that although an interchangeable mooring member and its components are identified and shown in one embodiment configuration, the same interchangeable mooring member and its components may also be found in another embodiment configuration. However, such interchangeable mooring member and its components are numbered according to the embodiment configuration in which it is being described.

The present invention includes multiple interchangeable components which are subject to various configurations based on the needs of a user when temporarily mooring his watercraft. It is anticipated that a user will possess more than one of the various components at any one time in order to be optionally prepared for the mooring of his watercraft to another watercraft or to a dock. As such the following descriptions for the following embodiments of the present invention may identify/reference a component of the present invention as "at least one" followed by the name of the component.

The present invention provides a plurality of interchangeable mooring members designed and adapted for the temporary mooring of a first watercraft to a second watercraft of an equal or appropriate size range, or the temporary mooring of a first watercraft to a dock or such other stationary object. The plurality of interchangeable mooring members comprising at least one connecting rod member, at least one vacuum-handle member, and at least one cleat connector member. The present invention also includes a safety device that is detachably attached to the at least one connecting rod member via a tether such that the safety device is suspended above the water's surface to provide a visual warning to persons in the immediate proximity of the watercraft with which the watercraft mooring system is being used. The number of interchangeable mooring members and the configuration of those interchangeable mooring members used for the temporary mooring of a watercraft will generally be dictated by the size, type, shape, and number of watercraft being moored and whether or not the mooring is for one watercraft to another watercraft, or for a watercraft to a dock or such other stationary object.

The at least one connecting rod member of the present invention having an at least one connection rod adjustable length and includes an at least one connecting rod member first end, and an at least one connecting rod member second end. The at least one connecting rod member is comprised of at least one telescopic member having an at least one telescopic member first end and an at least one telescopic member second end. The at least one connecting rod member optionally includes a tubular coupler and a tubular coupler extension. The tubular coupler and the tubular coupler extension are designed and adapted to provide a user the option to longitudinally connect a $1^{st}$ at least one telescopic member to a $2^{nd}$ at least one telescopic member. The incorporation of the tubular coupler or the tubular coupler extension has a significant effect on the overall adjustable length of the at least one connecting rod member when comprised of a $1^{st}$ at least one telescopic member longitudinally connected to a $2^{nd}$ at least one telescopic member.

The at least one vacuum-handle member of the present invention is designed and adapted as a detachable attachment to a first watercraft or to a second watercraft, and as a detachable attachment to the at least one connecting rod member first end or to the at least one connecting rod member second end. The at least one vacuum-handle member having a handle mount, a first vacuum cup assembly and a second vacuum cup assembly, a separation distance between the first and second vacuum cup assemblies, at least one vacuum means for providing vacuum to the first and second vacuum cup assemblies, a counter displacement means to respond to the relative movement between the first watercraft and the second watercraft when these watercraft are temporarily moored to one another with the present invention, and a vacuum-handle member connector [that provides] for the interchangeable attachment of the at least one vacuum-handle member to the at least one connecting rod member first end or to the at least one connecting rod member second end.

The handle mount of the at least one vacuum handle member includes a handle mount inner surface and a handle mount outer surface. The handle mount defines a handle mount connector aperture which provides an interchangeable connectivity site for the at least one connecting rod member first end or the at least one connecting rod second end. Additionally, the handle mount also defines at least one handle mount handle-gripping aperture that incorporates a handle-like feature into the at least one vacuum-handle member for a user to grasp when using the present invention.

The first vacuum cup assembly of the at least one vacuum-handle member includes a first vacuum cup having a first vacuum cup diameter, a first vacuum cup mount" onto which the first vacuum cup is mounted, and a first ball joint which secures the first vacuum cup mount to the handle mount outer surface. The second vacuum cup assembly of the at least one vacuum-handle member contains the same components of the first vacuum cup assembly. The second vacuum cup assembly includes a second vacuum cup having a second vacuum cup diameter, a second vacuum cup mount" onto which the second vacuum cup is mounted, and a second ball joint which secures the first vacuum cup mount to the handle mount outer surface. The diameter of the first and second vacuum cups for embodiments of the present invention ultimately may be determined and/or adjusted by the size and kind of the watercraft to which the at least one vacuum-handle member is being detachably attached for temporary mooring with the minimum vacuum cup diameter being 6 inches.

The at least one vacuum-handle member also includes a separation distance is a particular aspect of the present invention. A separation distance is the specific distance between the first vacuum cup assembly and the second vacuum cup assembly that provides optimum functionality of the at least one vacuum-handle member. Generally, the separation distance will result with the inner edges of the first and second vacuum cups being 1.5 inches apart.

The at least one vacuum-handle member includes at least one vacuum means for providing a vacuum to the first vacuum cup of the first vacuum cup assembly and to the second vacuum cup of the second vacuum cup assembly for detachable attachment of the at least one at least one vacuum-handle member to the first or second watercraft. In certain embodiments for the present invention there may be a separate vacuum means for the first vacuum cup assembly and a separate vacuum means for the second vacuum cup assembly. In other embodiments of the present invention a single vacuum means may be configured and adapted to provide vacuum to both the first and second vacuum cup assemblies.

The at least one vacuum-handle member includes counter displacement means for counter-acting any relative movement that may occur during the temporary mooring of the first watercraft to the second watercraft or the temporary mooring of the first watercraft to a dock.

The at least one vacuum-handle member includes a vacuum handle member connector that provides for the interchangeable attachment of the at least one vacuum-handle member to the at least one connecting rod member first end or to said at least one connecting rod member second end.

The at least one cleat connector member of the present invention includes an adjustable cleat line that is designed and adapted for detachable attachment to a first watercraft cleat or to a second watercraft cleat or to a dock cleat. The at least one cleat connector member is also capable of detachable attachment to the at least one connecting rod member first end or to the at least one connecting rod member second end. The at least one cleat connector member includes a cleat assembly mount that is designed and adapted for detachable attachment to the at least one connecting rod member first end or to the at least one connecting rod member second end. A cleat attachment line assembly is affixed to the cleat assembly mount and provides for lengthening or the shortening of the cleat attachment line around a watercraft cleat or a dock cleat to secure the at least one cleat connector member to a watercraft cleat or to a dock cleat.

The safety device of the present invention is detachably tethered to the at least one connecting rod member. The safety device is designed and adapted to suspend vertically downward towards a water surface to provide a visual warning when said watercraft mooring system is in use.

Referring to FIGS. 1, 5, FIGS. 6 to 18, FIGS. 21, 22, FIGS. 34 to 38, and FIG. 68, a first embodiment of the present invention includes a plurality of interchangeable mooring members that are designed and adapted for the temporary mooring of a first watercraft having a length of least 40 feet to a second watercraft also having a length of at least 40 feet, or the mooring of the first watercraft to a dock or such other stationary object having a cleat for mooring watercraft. The plurality of interchangeable mooring members comprising a connecting rod member, or at least one connecting rod member being identified as a [1st] at least one connecting rod member infra to which other interchangeable mooring members are detachably attached, a vacuum-handle member, or at least one vacuum-handle member being identified as a [1st] at least one vacuum-handle member infra which detachably attaches to the hull of a watercraft, a cleat connector member, or at least one cleat connector member being identified as a [1st] at least one cleat connector member infra for the detachable attachment to watercraft cleats or to a dock cleat, and a safety device being identified as a [1st] safety device infra that is suspended from the [1st] at least one connecting rod member towards the water's surface.

The first at least one connecting rod member 100 for the first embodiment of the present invention has a first at least one connecting rod member adjustable length of 36 inches to 48 inches, a first at least one connecting rod member first end 101, and a first at least one connecting rod member second end 102. The first at least one connecting rod member 100 also includes a [1st] first telescopic member 110*a*, a [1st] second telescopic member, and a first tubular coupler 105 and a first tubular coupler extension 106 for longitudinally connecting a [1st] first telescopic member 110*a* and a [1st] second telescopic member 110*b* to one another.

The [1st] first telescopic member 110*a* of the first at least one connecting member 100 has a [1st] first telescopic member adjustable length from 12 inches to 18 inches, a [1st] first telescopic member first end 111*a*, and a [1st] first telescopic member second end 112*a*. The [1st] first telescopic member 110*a* comprises a [1st] first inner tube 113*a*, a [1st] first outer tube 117*a* and a [1st] first tubular extension lock 121*a*. The [1st] first inner tube has a [1st] first inner tube length of 12 inches, a [1st] first inner tube first end 114*a* and a [1st] first inner tube second end 115*a*.

The [1st] first inner tube first end 114*a* defines a pair of first inner tube fastener tabs that are in vertical alignment with each other. Additionally, the pair of first inner tube fastener tabs respectively comprise a pair of first inner tube fastener apertures. The pair of first inner tube fastener tabs extends longitudinally from the [1st] first inner tube first end and define a [1st] pair of parallel vertical notches in horizontal alignment from each other. Additionally, the [1st] first inner tube second end 115*a* has a [1st] upper stop-pin aperture [that secures a [1st] stop pin which is designed and adapted to limit the extension length of the [1st] first inner tube 113*a*.

The [1st] first inner tube 113*a* also has a [1st] first inner tube flat top wall and a [1st] first inner tube flat bottom wall that is parallel to the [1st] first inner tube flat top wall. The [1st] first inner tube flat top wall includes a [1st] first plurality of locking apertures 116*a* which pass through the [1st] first inner tube flat top wall and being equally spaced in linear alignment. In the 1st embodiment of the present invention the 1st plurality of locking apertures 116*a* consists of four apertures, however the number of such locking apertures may be increased or decreased in other embodiments depending on the needs of a user and the length of an inner tube of the telescopic member for such other embodiment(s). The [1st] first inner tube also includes a [1st] pair of opposing vertical convex side walls/sides connecting the [1st] first inner tube flat top wall to the [1st] first inner tube flat bottom wall.

The [1st] first outer tube 117*a* of the [1st] first telescopic member 110*a* has a [1st] first outer tube length of 10 inches and includes a [1st] first outer tube inner bore that is designed and adapted to slidably receive the [1st] first inner tube within the [1st] first outer tube. The [1st] first outer tube also comprises a [1st] first outer tube stepped first end 118*a* and a [1st] first outer tube second end 119*a* having a [1st] first outer tube second end pair of vertically aligned fastener apertures. The [1st] first outer tube inner bore for the first embodiment for the present invention is 1.120 inches in diameter, however diameter sizes may be appropriate provided that the structural integrity of the present invention is not comprised.

The [1st] first tubular extension lock 121*a* of the [1st] first telescopic member 110*a* has a [1st] first tubular extension lock length of about 2.75 inches. The [1st] first tubular extension lock being fastened and secured to the [1st] first outer tube [stepped] first end 118*a*. The [1st] first tubular extension lock 121*a* includes a [1st] first tubular extension lock first inner bore that is designed and adapted to slidably receive the [1st] first inner tube. The [1st] first tubular extension lock also includes a [1st] first tubular extension lock second inner bore that is adjacent to the [1st] first tubular extension lock first inner bore and is designed and adapted to receive and secure the [1st] first outer tube stepped first end 118*a*. The [1st] first tubular extension lock 121*a* also includes a [1st] first spring biased thumb lever designed and adapted to selectively engage the [1st] first plurality of locking apertures 116*a* being situate on the [1st] first inner tube flat top wall. The [1st] first tubular extension lock 121*a* and the [1st] first outer tube 117*a* are designed and adapted to slidably receive and lock the [1st] first inner tube 113*a* into position as desired by a user when increasing or decreasing the length of the [1st] first telescopic member 110*a*.

The first embodiment of the present invention includes a [1st] second telescopic member 110*b* that is an exact duplicate of the [1st] first telescopic member 110*a*, and such duplicity carries forward to each of the individual components of the respective [1st] first telescopic member 110*a* and the [1st] second telescopic member 110*a* as well as the functionality of such components. Although the [1st] second telescopic member 110*b* is an exact duplicate of the [1st] first telescopic member 110*a*, the following description and labels of and for the analogous components of the [1st] second telescopic member 100*b* are provided for a complete and thorough understanding of the first embodiment of the present invention.

The [1st] second telescopic member 110*b* of the 1st at least one connecting member 100 has a [1st] second telescopic member adjustable length from 12 inches to 18 inches, a [1st] second telescopic member first end 111*b*, and a [1st] second telescopic member second end 112*b*. The [1st] second telescopic member comprises a [1st] second inner tube 113*b*, a [1st] second outer tube 117*b* and a [1st] second tubular extension lock 121*b*. The [1st] second inner tube has a [1st] second inner tube length of 12 inches, a [1st] second inner tube first end 114*b* and a [1st] second inner tube second end 115*b*.

The [1st] second inner tube first end 114*b* defines a pair of second inner tube fastener tabs that are in vertical alignment with each other. Additionally, the pair of second inner tube fastener tabs respectively comprise a pair of second inner tube fastener apertures. The pair of second inner tube fastener tabs extends longitudinally from the [1st] second inner tube first end 114*b* and define a [2nd] pair of parallel vertical notches in horizontal alignment from each other. Additionally, the [1st] second inner tube second end has an upper [2nd] stop-pin aperture [that secures a [2nd] stop pin which is designed and adapted to limit the extension length of the [1st] second inner tube.

The [1st] second inner tube 114*b* also has a [1st] second inner tube flat top wall and a [1st] second inner tube flat bottom wall that is parallel to the [1st] second inner tube flat top wall. The [1st] second inner tube flat top wall includes a [1st] second plurality of [locking] apertures 116*b* which pass through the [1st] second inner tube flat top wall and being equally spaced in linear alignment. In the 1st embodiment of the present invention the 2nd plurality of locking apertures 116*b* consists of 4 apertures, however the number of such locking apertures may be increased or decreased in other embodiments depending on the needs of a user and the length of an inner tube of the telescopic member for such other embodiment(s). The [1st] second inner tube also includes a [2nd] pair of opposing vertical convex side walls/sides connecting the [1st] second inner tube flat top wall to the [1st] second inner tube flat bottom wall.

The [1st] second outer tube 117*b* of the [1st] second telescopic member has a [1st] second outer tube length of 10 inches and includes a [1st] second outer tube inner bore that is designed and adapted to slidably receive the [1st] second inner tube 113*b* within the [1st] second outer tube 117*b*. The [1st] second outer tube also comprises a [1st] second outer tube stepped first end 118*b* and a [1st] second outer tube second end 119 having a [1st] second outer tube second end pair of vertically aligned fastener apertures. The [1st] second outer tube inner bore for the first embodiment for the present invention is 1.120 inches in diameter, however diameter sizes may be acceptable provided that the structural integrity of the present invention is not comprised.

The [1st] second tubular extension lock 121*b* of the [1st] second telescopic member has a [1st] second tubular extension lock length of 2.75 inches. The [1st] second tubular extension lock being fastened and secured to the [1st] second outer tube [stepped] first end. The [1st] second tubular extension lock includes a [1st] second tubular extension lock first inner bore that is designed and adapted to slidably receive the [1st] second inner tube 113*b*. The [1st] second tubular extension lock also includes a [1st] second tubular extension lock second inner bore that is adjacent to the [1st] second tubular extension lock first inner bore and is designed and adapted to receive and secure the [1st] second outer tube stepped first end 118*b*. The [1st] second tubular extension lock also includes a [1st] second spring biased thumb lever designed and adapted to selectively engage the [1st] second plurality of locking apertures 116*b* being situate on the [1st] second inner tube flat top wall. The [1st] second tubular extension lock 121*b* and the [1st] second outer tube 117*b* are designed and adapted to slidably receive and lock the [1st] second inner tube 113*b* into position as desired by a user when increasing or decreasing the length of the [1st] second telescopic member.

The [1st] at least one connecting rod member 100 for the first embodiment of the present invention includes a [1st] tubular coupler 105 having a [1st] tubular coupler stepped first end with a pair of vertically aligned coupler fastener apertures and a [1st] tubular coupler stepped second end with a 2nd pair of vertically aligned coupler fastener apertures. The [1st] tubular coupler 105 is designed and adapted to longitudinally connect the [1st] first telescopic member second end 112*a* to the [1st] second telescopic member second end 112*b* via the alignment of the respective vertically aligned fastener apertures of the first and second [1st] telescopic member second ends with the vertically aligned fastener apertures of the [1st] tubular coupler stepped first and second ends with fasteners being inserted therein. In the first embodiment for the present invention the [1st] tubular coupler 105 has a length of 4 inches. When the [1st] tubular coupler 105 is used to connect the [1st] first telescopic member second end 112*a* to the [1st] second telescopic member second end 112*b*, the adjustable length of the [1st] at least one connecting rod member 100 is 36 inches to 48 inches.

The [1st] at least one connecting rod member 100 for the first embodiment of the present invention also includes a [1st] tubular coupler extension 106 having a [1st] tubular coupler extension stepped first end with a 1st pair of vertically aligned coupler extension fastener apertures and a [1st] tubular coupler extension stepped second end with a 2nd pair of vertically aligned coupler extension fastener apertures. The [1st] tubular coupler extension 106 is designed and adapted to be used in lieu of the [1st] tubular coupler 105 to further increase the [1st] at least one connecting rod member adjustable length. The [1st] tubular coupler extension 106 has a [1st] tubular extension length of 16 inches and is designed and adapted to connect the [1st] first telescopic member second end 112*a* to the [1st] second telescopic member second end 112*b* in same manner as when the [1st] tubular coupler 105 is used for such longitudinal connection via the alignment of the respective vertically aligned fastener apertures of the first and second [1st] telescopic member second ends with the vertically aligned fastener apertures of the [1st] tubular coupler extension stepped first and second ends with fasteners being inserted therein. When the [1st] tubular coupler extension 106 is used to connect the [1st] first telescopic member second end 112*a* to the [1st] second telescopic member second end 112*b*, the adjustable length of the [1st] at least one connecting rod member 100 is 48 inches to 60 inches The [1st] at least one vacuum-handle member 140 for the first embodiment of the present invention is designed and adapted for its detachable attachment to a [first] watercraft or to a [second] watercraft and for its detachable attachment to a [1st] at least one connecting rod member first end 101 or to a [1st] at least one connecting rod member second end 102. The [1st] at least one vacuum-handle member for the first embodiment of the present invention comprises a [1st] handle mount 141, a [1st] first vacuum cup assembly 150*a*, a [1st] second vacuum cup assembly 150*b*, a [1st] separation distance, a [1st] counter displacement means to respond to relative movement between a first watercraft and a second watercraft, or between a first watercraft and a dock during temporary mooring of a first watercraft, and a [1st] vacuum-handle member connector.

The [1st] handle mount 141 of the [1st] at least one vacuum-handle member 140 for the first embodiment of the present invention has a [1st] handle mount inner surface 142 and a [1st] handle mount outer surface 143. The [1st] handle mount includes a [1st] handle mount connector aperture 144 that facilitates the detachable attachment of the [1st] at least one vacuum-handle member with a connecting rod member. The [1st] handle mount connector aperture includes an upper rubber dampener and a lower rubber dampener which dampen the vertical movement of the [1st] at least one connecting rod member 100 due to such movement by the first and second watercraft. The [1st] handle mount includes also includes a [1st] at least one handle mount gripping aperture 145 which provides a user a handle-like surface and structure to grip when using the present invention.

The [1st] first vacuum cup assembly 150*a* of the [1st] at least one vacuum-handle member 140 for the first embodiment of the present invention includes a [1st] first vacuum cup 151*a*, a [1st] first vacuum cup assembly mount 152*a*, and a [1st] first ball joint 153*a*. The [1st] first vacuum cup 151*a* has [1st] first vacuum cup release tabs 158*a*, a [1st] first vacuum cup bottom side, a [1st] first vacuum cup top side, a [1st] first vacuum intake port 157*a*, and a [1st] first vacuum cup diameter of 6 inches. Although the [1st] first vacuum cup for the 1st embodiment has a diameter of 6 inches, it is understood that such diameter may be decreased or increased as necessary for other embodiments of the present invention to achieve maximum performance of the present invention in such other embodiment. The [1st ] first vacuum cup of the [1st] first vacuum cup assembly is designed and adapted to operationally engage a [1st] first at least one vacuum means which provides a [1st] first vacuum to the [1st] first vacuum cup. The [1st] first at least one vacuum means for the first embodiment of the present invention comprises a [1st] first thumb-operated vacuum plunger assembly 155*a*. The [1st] first thumb-operated vacuum plunger assembly 155*a* includes a [1st] first vacuum tube 156*a*, a pump knob with vacuum indicator rings to indicate the relative vacuum pressure within the first vacuum cup, a compression spring, compression spring collar, and rubber seal.

The [1st] first vacuum cup assembly mount 152*a* includes a [1st] first vacuum cup assembly mount top side and a [1st] first vacuum cup assembly mount bottom side to which the [1st] first vacuum cup top side is fastened. The [1st] first vacuum cup assembly mount bottom side defines a [1st] first vacuum cup assembly mount bottom edge that conforms to the cylindrical shape of the vacuum tube 156*a* of [1st] first thumb-operated vacuum plunger assembly 155*a* to hold the vacuum tube housing in position when the [1st] first vacuum cup assembly mount 152*a* is pivotally secured to the [1st] first vacuum cup top side.

The [1st] first ball joint 153*a* of the [1st] first vacuum cup assembly 150*a* is designed and adapted to fasten and pivotally secure the [1st] first vacuum cup assembly mount top side to the [1st] handle mount outer surface 143 of the [1st] handle mount 141. The use of the [1st] first ball joint provides 360-degree rotational movement of the [1st] first vacuum cup assembly relative to the [1st] handle mount inner surface and up to 5 degrees of vertical or horizontal movement from center position of the [1st] first vacuum cup assembly relative to and when attached to a watercraft hull. A [1st] first ball joint sleeve 154*a* surrounds the [1st] first ball joint to dampen the vertical or horizontal movement of the [1st] first ball joint from its center position.

The first embodiment of the present invention includes a [1st] second vacuum cup assembly 150*b* that is an exact duplicate of the [1st] first vacuum cup assembly 150*a*, and such duplicity carries forward to each of the individual components of the respective [1st] first vacuum cup assembly 150*a* and the [1st] second vacuum cup assembly 150*b* as well as the functionality of such components. Although the [1st] second vacuum cup assembly is an exact duplicate of the [1st] first vacuum cup assembly, the following description and labels of and for the analogous components of the [1st] second vacuum cup assembly 150*b* are provided for a complete and thorough understanding of the first embodiment of the present invention.

The [1st] second vacuum cup assembly 150*b* of the [1st] at least one vacuum-handle member 140 for the first embodiment of the present invention includes a [1st] second vacuum cup 151*b*, a [1st] second vacuum cup assembly mount 152*b*, and a [1st] second ball joint 153*b*. The [1st] second vacuum cup 151*b* has [1st] second vacuum cup release tabs 158*b*, a [1st] second vacuum cup bottom side, a [1st] second vacuum cup top side, a [1st] second vacuum intake port 157*b*, and a [1st] second vacuum cup diameter of 6 inches. Although the [1st] second vacuum cup for the 1st embodiment has a diameter of 6 inches, it is understood that such diameter may be decreased or increased as necessary for other embodiments of the present invention to achieve maximum performance of the present invention in such other embodiment. The [1st] second vacuum cup of the [1st] second vacuum cup assembly is designed and adapted to operationally engage a [1st] second at least one vacuum means which provides a [1st] second vacuum to the [1st] second vacuum cup. The [1st] second at least one vacuum means for the first embodiment of the present invention comprises a [1st] second thumb-operated vacuum plunger assembly 155*b*. The [1st] first thumb-operated vacuum plunger assembly 155*b* includes a [1st] second vacuum tube 156*b*, a pump knob with vacuum indicator rings to indicate the relative vacuum pressure within the first vacuum cup, a compression spring, compression spring collar, and rubber seal.

The [1st] second vacuum cup assembly mount 152*b* includes a [1st] second vacuum cup assembly mount top side and a [1st] second vacuum cup assembly mount bottom side to which the [1st] second vacuum cup top side is fastened. The [1st] second vacuum cup assembly mount bottom side defines a [1st] second vacuum cup assembly mount bottom edge that conforms to the cylindrical shape of the vacuum tube 156*b* of [1st] second thumb-operated vacuum plunger assembly 155*b* to hold the vacuum tube housing in position when the [1st] first vacuum cup assembly mount 152*b* is pivotally secured to the [1st] second vacuum cup top side.

The [1st] second ball joint 153*b* of the [1st] first vacuum cup assembly 150*b* is designed and adapted to fasten and pivotally secure the [1st] second vacuum cup assembly mount top side to the [1st] handle mount outer surface 143 of the [1st] handle mount 141. The use of the [1st] second ball joint provides 360-degree rotational movement of the [1st] second vacuum cup assembly relative to the [1st] handle mount inner surface and up to 5 degrees of vertical or horizontal movement from center position of the [1st] second vacuum cup assembly relative to and when attached to a watercraft hull. A [1st] second ball joint sleeve 154*b* surrounds the [1st] second ball joint to dampen the vertical or horizontal movement of the [1st] second ball joint from its center position.

The [1st] separation distance of the [1st] at least one vacuum-handle member 140 for the first embodiment of the present invention is a distance between the [1st] first vacuum cup assembly 150*a* and the [1st] second vacuum cup assembly 150*b* that provides optimal functionality of the [1st] at least one vacuum-handle 140 member upon the detachable attachment of the [1st] at least one vacuum-handle member to the hull of a watercraft. The [1st] separation distance for the present invention provides that the [1st] first and second vacuum cup assemblies will perform as a single unit as opposed to two separate vacuum cup assemblies which results in greater push and pull force. The separation distance for the embodiment of the present invention is 1.5 inches as measured from the closest edges of the [1st] first vacuum cup 151*a* of the [1st] first vacuum cup assembly 150*a* and the [1st] second vacuum cup 151*b* of the [1st] second vacuum cup assembly 150*b* when the [1st] first and second vacuum cups are fully engaged with vacuum. However, it may be expected that the $1^{st}$ separation distance may be greater or less depending on other configuration of the vacuum cup diameter relative to the diameter size of the handle mount.

The [$1^{st}$] at least one vacuum-handle member 140 for the first embodiment of the present invention includes a [$1^{st}$] counter displacement means for responding to relative movement may occur between the first watercraft and the second watercraft, or between the watercraft and a dock, during temporary mooring of the watercraft. The [$1^{st}$] counter displacement means for responding to such relative movement for the present invention comprises a [$1^{st}$] torsion spring assembly 170. The [$1^{st}$] torsion spring assembly is fastened horizontally to the [$1^{st}$] handle mount outer surface 143 such that it is situate over the [$1^{st}$] handle mount connector aperture 144. The [$1^{st}$] torsion spring assembly 170 is designed and adapted such that it responds to and dampens the vertical movement that may occur between the first watercraft and the second watercraft, or between the first watercraft and the dock, when the [$1^{st}$] at least one vacuum-handle member 140 is used for the temporary mooring of the first watercraft to the second watercraft or to the dock. The [$1^{st}$] torsion spring assembly for the first embodiment of the present invention includes a pair of (piano wire) torsion springs 172*a*, 172*b*, a torsion spring mounting disk 173, and a torsion spring collar/sleeve 174 being operatively housed cylindrical torsion spring housing 171*a*, 171*b*. When the retractable spring plunger T-handle 175 of the [$1^{st}$] torsion spring assembly is disengaged the torsion spring tension is released and thus allowing it to move freely to respond to any vertical movement that may occur between the watercraft temporarily moored to one another.

The [$1^{st}$] vacuum-handle member connector of the [$1^{st}$] at least one vacuum-handle member 100 for the first embodiment of the present invention is designed and adapted for the detachable attachment of the [$1^{st}$] torsion spring assembly 170 of the [$1^{st}$] at least one vacuum-handle member 140 to the $1^{st}$ at least one connecting rod member first end 101 or to the [$1^{st}$] at least one connecting rod member second end 102. The [$1^{st}$] vacuum-handle member connector comprising a [$1^{st}$] swivel joint 179 having a [$1^{st}$] swivel joint first end that is designed and adapted to engage the [$1^{st}$] torsion spring assembly 170 and a [$1^{st}$] swivel joint second end that is designed and adapted to operationally engage the [$1^{st}$] at least one connecting rod member first end 101 or the [$1^{st}$] at least one connecting rod member second end 102. The design and configuration of the [$1^{st}$] swivel joint is such that the [$1^{st}$] swivel joint second end responds to the horizontal movement that may occur between the first watercraft and the second watercraft, or between the first watercraft and the dock, during the temporary mooring of the first and/or second watercraft with the present invention.

The [$1^{st}$] swivel joint 179 of the present invention comprising and defining a [$1^{st}$] cylindrical body having a [$1^{st}$] swivel joint first end and a [$1^{st}$] swivel joint second end. The [$1^{st}$] swivel joint first end comprising a [$1^{st}$] threaded bolt member extending axially away from the [$1^{st}$] cylindrical body. The [$1^{st}$] threaded bolt member of the [$1^{st}$] swivel joint is designed and adapted for the detachable attachment to [$1^{st}$] the torsion spring assembly 170 of one of the [$1^{st}$] at least one vacuum-handle members 100. The [$1^{st}$] swivel joint second end comprising [$1^{st}$] vertically paired tabs extending longitudinally away from the [$1^{st}$] cylindrical body opposite to the [$1^{st}$] threaded bolt member defining [$1^{st}$] horizontally paired notches. The [$1^{st}$] vertically paired tabs having a [$1^{st}$] pair of centrally positioned fastener apertures designed and adapted for vertical alignment and fastening with and to the first pair of upper and lower [threaded] fastener apertures situate at the first [$1^{st}$] inner tube first end or the second pair of upper and lower [threaded] fastener apertures situate at the second [$1^{st}$] inner tube first end such that the [$1^{st}$] swivel joint is operationally secured to first [$1^{st}$] first telescopic member first end 111*a* or to the [$1^{st}$] second telescopic member first end 111*b*. The design and configuration of the first vertically paired tabs and the first horizontally paired notches of the [$1^{st}$] swivel joint and the first pair of parallel vertical notches of the first [$1^{st}$] inner tube first tubular end provide a 70-degree swivel span to address any horizontal movement that may occur between the temporarily moored watercraft using the present invention.

The first embodiment of the present invention includes a [$1^{st}$] at least one cleat connector member 180 that is designed and adapted for its detachable attachment to a first watercraft cleat or to a second watercraft cleat or to a dock cleat, and for detachable attachment to said [$1^{st}$] at least one connecting rod member first end 101 or to said [$1^{st}$] at least one connecting rod member second end 102. The [$1^{st}$] at least one cleat connector member can be used in conjunction with the [$1^{st}$] at least one vacuum-handle member 140 should such a configuration be needed or desired by a user. The [$1^{st}$] at least one cleat connector member includes a [$1^{st}$] cleat assembly mount 180 and a [$1^{st}$] cleat attachment line assembly 183.

The [$1^{st}$] cleat assembly mount 181 of the [$1^{st}$] at least one cleat connector member 180 for the present invention is designed and adapted for detachable attachment to the [$1^{st}$] first telescopic member 110*a* of the [$1^{st}$] at least one connecting rod member 100 or to the [$1^{st}$] second telescopic member 110*b* of the [$1^{st}$] at least one connecting rod member 100. The cleat assembly mount having a cleat assembly mount tubular body comprising a cleat assembly mount tubular body first end, a cleat assembly mount tubular body second end, and a rubber annular cleat dampener defining a pair of [$1^{st}$] cleat attachment line guide grooves affixed to the cleat assembly mount tubular body second end. The cleat assembly tubular body also includes a pair of cleat connector member fastener apertures being vertically aligned.

The pair of cleat connector member fastener apertures are designed and adapted fastening the [$2^{nd}$] cleat assembly mount 280 to the [$1^{st}$] first inner tube first end 114*a* of the first [$1^{st}$] telescopic member 110*a* of the [$1^{st}$] at least one connecting rod member 100 or the [$1^{st}$] second inner tube first end 114*b* of the first [$1^{st}$] telescopic member 110*b* of the [$1^{st}$] at least one connecting rod member 100. The [$1^{st}$] cleat attachment line assembly 183 of the [$1^{st}$] at least one cleat connector member 180 for the present invention is affixed to the [$1^{st}$] cleat assembly mount 181. The [$1^{st}$] cleat attachment line assembly defines a [1' ] adjustable cleat line loop 185 that is designed and adapted for detachable attachment to a watercraft cleat or to a dock cleat. The [$1^{st}$] cleat attachment line assembly 183 includes a cleat attachment line 184 having a handled first end 186 and a cleat attachment line second end and an attachment line fixed mount 187 that is fastened to the [$1^{st}$] cleat assembly mount 181 to secure the cleat attachment line second end to the [$1^{st}$] cleat assembly mount 181. The [$1^{st}$] cleat attachment line assembly also includes a cleat attachment line tension clip 188 that is operatively attached to the [$1^{st}$] cleat assembly mount 181 opposite to the attachment line fixed mount 187 and is used to secure the [$1^{st}$] cleat attachment line about a watercraft cleat or a dock cleat to temporarily moor a watercraft.

Now referring to FIG. 68, the first embodiment of the present invention includes a [$1^{st}$] safety device 190 that is designed and adapted to be detachably tethered to the [$1^{st}$] at least one connecting rod member 100 and suspend vertically downward towards and near a water's surface to provide a visual warning to swimmers and/or others that may be in close proximity of watercraft temporarily moored with the present invention.

The [$1^{st}$] safety device 190 comprises an inflatable spherical rubber device having at least a 10 inch diameter and manufactured in a high visibility color to properly convey a warning. The tether for detachably attaching the [$1^{st}$] safety device to the [$1^{st}$] at least one connecting rod member 100 may be manufactured for a hook and loop material to provide a simple and quick mechanism for detachable attachment to the [$1^{st}$] at least one connecting rod member 100. The safety device may also be manufactured from polyethylene foam or such other lightweight materials. An additional aspect of an inflatable [$1^{st}$] safety device or one manufactured from polyethylene foam is the buoyancy characteristic of such materials. In the event the present invention is dropped or falls into a body water, the buoyancy of such materials such may prevent the sinking and/or subsequent loss of the present invention under such circumstances.

The first embodiment of the present invention as disclosed supra is design specific to watercraft of 40 feet or more in length and is to be mounted horizontally to the watercraft and manufactured from of aluminum and is corrosion resistant. Each vacuum handle member has two vacuum cups that can pivot in multiple directions and operate independently from each other. The design and configuration of the present invention supports detachable attachment to uneven surfaces when being mounted to watercrafts. The vacuum cups have individual thumb operated vacuum plunger vacuum assemblies.

The present invention counter displacement means support vertical movement and horizontal movement. The handle mount of the vacuum handle member also supports a dampener to support vertical movement. The torsion spring assembly includes a spring lock pin system and when released the tension is in a neutral position. When the spring lock pin system is engaged it locks the torsion spring assembly thereby creating resistance for vertical movement. The vacuum handle member can be removed and a cleat connector member installed utilizing the same connecting rod member which allows for multiple configurations of the first embodiment of the present invention. The safety device of the present invention attaches to the connecting rod member and serves as a visual aid to communicate that a no swimming zone exist between the moored watercraft.

Similar to the first embodiment for the present invention, a second embodiment of the present invention includes a plurality of interchangeable mooring members that are designed and adapted for the temporary mooring of a first watercraft having a length of at least 35 feet to a second watercraft also having a length of at least 35 feet, or the mooring of the first watercraft to a dock or such other stationary object having a cleat for mooring watercraft. Also similar to the first embodiment, the second embodiment for the present invention includes a plurality of interchangeable mooring members comprising a connecting rod member, or at least one connecting rod member being identified as a [$2^{nd}$] at least one connecting rod member infra to which other interchangeable mooring members are detachably attached, a vacuum-handle member, or at least one vacuum-handle member being identified as a [$2^{nd}$] at least one vacuum-handle member infra which detachably attaches to the hull of a watercraft, a cleat connector member, or at least one cleat connector member being identified as a [$2^{nd}$] at least one cleat connector member infra for the detachable attachment to watercraft cleats or to a dock cleat, and a safety device being identified as a [$2^{nd}$] safety device infra that is suspended from the [$2^{nd}$] at least one connecting rod member towards the water's surface.

The [$2^{nd}$] at least one connecting rod member 200 for the second embodiment of the present invention is identical in form and function to the [$1^{st}$] at least one connecting rod member 100 for the first embodiment of the present invention as described supra in this written description. In light of the above detailed description for the [$1^{st}$] at least one connecting rod member 100 of the first embodiment, the [$2^{nd}$] at least one connecting rod member 100 for the second embodiment of the present invention is hereby summarily described below. In the event additional description and/or information is desired regarding the subject [$2^{nd}$] at least one connecting rod member 200, the reader is directed to the prior section(s) of this written description and applicable figures describing the [$2^{nd}$] at least one connecting rod member 200.

Now referring to FIGS. 2, 5, 17, 18, 19, 20, FIGS. 22 to 38, and FIG. 68, the [$2^{nd}$] at least one connecting rod member 200 for the second embodiment of the present invention is having a [$2^{nd}$] adjustable length 12 inches to 18 inches, a [$2^{nd}$] at least one connecting rod member first end 201, and a [$2^{nd}$] at least one connecting rod member second end 202. The [$2^{nd}$] at least one connecting rod member also includes a [$2^{nd}$] first telescopic member 210*a*, a [$2^{nd}$] second telescopic member 210*b*, and a [$2^{nd}$] tubular coupler 205 and a [$2^{nd}$] tubular coupler extension 206 for longitudinally connecting the [$2^{nd}$] first telescopic member 210*a* and to the [$2^{nd}$] second telescopic member 210*b*.

The [$2^{nd}$] first telescopic member 210*a* of the [$2^{nd}$] at least one connecting member 200 has a [$2^{nd}$] first telescopic member adjustable length from about 12 inches to about 18, a [$2^{nd}$] first telescopic member first end 211*a* and a [$2^{nd}$] first telescopic member second end 212*a*. The [$2^{nd}$] first telescopic member comprises a [$2^{nd}$] first inner tube 213*a*, a [$2^{nd}$] first outer tube 217*a* and a [$2^{nd}$] first tubular extension lock 221*a*. The [$2^{nd}$] first inner tube having a [$2^{nd}$] first inner tube length of 10 inches, a [$2^{nd}$] first inner tube first end 214*a*, and a [$2^{nd}$] first inner tube second end 215*a*. The [$2^{nd}$] first inner tube first end defines a [$2^{nd}$] pair of upper and lower parallel tabs. The [$2^{nd}$] pair of upper and lower parallel tabs comprising a respective [$2^{nd}$] pair of upper and lower fastener apertures. The [$2^{nd}$] pair of upper and lower parallel tabs extend longitudinally from the [$2^{nd}$] first inner tube first end 214*a* defining a [2" ] pair of parallel vertical notches. Additionally, the [$2^{nd}$] first inner tube second end 215*a* has a [$2^{nd}$] upper stop-pin aperture that secures a [$2^{nd}$] stop pin which is designed and adapted to limit the extension length of the [$2^{nd}$] first inner tube 213*a*. The [$2^{nd}$] first inner tube also has a [$2^{nd}$] first inner tube flat top wall and a [$2^{nd}$] first inner tube flat bottom wall that is parallel to the [$2^{nd}$] first inner tube flat top wall. The [$2^{nd}$] first inner tube flat top wall includes a [$2^{nd}$] first plurality of [locking] apertures 216*a* which pass through the [$2^{nd}$] first inner tube flat top wall and being equally spaced in linear alignment. The [$2^{nd}$] first inner tube 213*a* also includes a [$2^{nd}$] pair of opposing vertical convex side walls/sides connecting the [$2^{nd}$] first inner tube flat top wall to the [$2^{nd}$] first inner tube flat bottom wall.

The [$2^{nd}$] first outer tube 217*a* of the [$2^{nd}$] first telescopic member 210*a* has a [$2^{nd}$] first outer tube length of 9 inches and includes a [$2^{nd}$] first outer tube inner bore that is designed and adapted to slidably receive the [$2^{nd}$] first inner tube 213*a* within the [$2^{nd}$] first outer tube 217*a*. The [$2^{nd}$] first outer tube also comprises a [$2^{nd}$] first outer tube stepped first end 218*a* and a [$2^{nd}$] first outer tube second end 219*a* having a second [$2^{nd}$] first outer tube second end pair of vertically aligned fastener apertures.

The [$2^{nd}$] first tubular extension lock 221*a* includes a [2nd] first tubular extension lock first end and a [$2^{nd}$] first tubular extension lock first inner bore that is designed and adapted to slidably receive the [$2^{nd}$] first inner tube 213*a*. The [$2^{nd}$] first tubular extension lock also includes [2nd] first tubular extension lock second end and a [$2^{nd}$] first tubular extension lock second inner bore that is adjacent to the [$2^{nd}$] first tubular extension lock first inner bore and is designed and adapted to receive and secure the [$2^{nd}$] first outer tube stepped first end 218*a*. The [$2^{nd}$] first tubular extension lock also includes a [$2^{nd}$] first spring biased thumb lever 222*a* that is designed and adapted to selectively engage the [$2^{nd}$] first plurality of locking apertures 216*a* being situate on the [$2^{nd}$] first inner tube flat top wall. The [$2^{nd}$] first tubular extension lock 221*a* being fastened and secured to the [$2^{nd}$] first outer tube stepped first end 218*a*.

The [$2^{nd}$] first tubular extension lock 221*a* and the [$2^{nd}$] first outer tube 217*a* are designed and adapted to slidably receive and lock the [$2^{nd}$] first inner tube 213*b* into a specific position as desired by a user when increasing or decreasing the length of the [$2^{nd}$] first telescopic member 210*a* of the [$2^{nd}$] at least one connecting rod member 200.

The [$2^{nd}$] preferred embodiment of the present invention includes a [$2^{nd}$] second telescopic member 210*b* that is an exact duplicate of the [$2^{nd}$] first telescopic member 210*a*, and such duplicity carries forward to each of the individual components of the respective [$2^{nd}$] first telescopic member and the [$2^{nd}$] second telescopic member as well as the functionality of such components. Although the [$2^{nd}$] second telescopic member 210*b* is an exact duplicate of the [$2^{nd}$] first telescopic member 210*a*, the following description and labels of and for the analogous components of the [$2^{nd}$] second telescopic member are provided for a complete and thorough understanding of the $2^{nd}$ preferred embodiment of the present invention.

The [$2^{nd}$] second telescopic member 210*b* of the $2^{nd}$ at least one connecting member 200 has a [$2^{nd}$] second telescopic member adjustable length from about 12 inches to about 18 inches, a [$2^{nd}$] second telescopic member first end 211*b* and a [$2^{nd}$] second telescopic member second end 212*b*. The [$2^{nd}$] second telescopic member comprises a [$2^{nd}$] second inner tube 213*b*, a [$2^{nd}$] second outer tube 217*b* and a [$2^{nd}$] second tubular extension lock 221*b*. The [$2^{nd}$] second inner tube has a [$2^{nd}$] second inner tube length of 10 inches, a [$2^{nd}$] second inner tube first end 214*b* having vertically aligned second pair of fastener apertures, and a [$2^{nd}$] second inner tube second end 215*b*. The [$2^{nd}$] second inner tube first end defines a second pair of upper and lower parallel tabs, the second pair of upper and lower parallel tabs comprising a respective second pair of upper and lower fastener apertures. The second pair of upper and lower parallel tabs extend longitudinally from the [$2^{nd}$] second inner tube first end 214*b* defining a second pair of parallel vertical notches. Additionally, the [$2^{nd}$] second inner tube second end 215*b* has an upper second stop-pin aperture [that secures a second stop pin which is designed and adapted to limit the extension length of the [$2^{nd}$] second inner tube 213*b*. The [$2^{nd}$] second inner tube also has a [$2^{nd}$] second inner tube flat top wall and a [$2^{nd}$] second inner tube flat bottom wall that is parallel to the [$2^{nd}$] second inner tube flat top wall. The [$2^{nd}$] second inner tube flat top wall includes a [$2^{nd}$] second plurality of [locking] apertures 216*b* which pass through the [$2^{nd}$] second inner tube flat top wall and being equally spaced in linear alignment. The [$2^{nd}$] second inner tube also includes a $2^{nd}$ pair of opposing vertical convex side walls/sides connecting the [$2^{nd}$] second inner tube flat top wall to the [$2^{nd}$] second inner tube flat bottom wall.

The [$2^{nd}$] second outer tube 217*b* of the [$2^{nd}$] second telescopic member 210*b* has a [$2^{nd}$] second outer tube length of 9 inches and includes a [$2^{nd}$] second outer tube inner bore that is designed and adapted to slidably receive the [$2^{nd}$] second inner tube 213*b* within the [$2^{nd}$] second outer tube 217*b*. The [$2^{nd}$] second outer tube also comprises a [$2^{nd}$] second outer tube stepped first end 218*b* and a [$2^{nd}$] second outer tube second end 219*b* having a [$2^{nd}$] second outer tube second end pair of vertically aligned fastener apertures.

The [$2^{nd}$] second tubular extension lock 221*b* of the [211*c*1] second telescopic member 210*b* has a [$2^{nd}$] second tubular extension lock length of about 2.75 inches. The [$2^{nd}$] second tubular extension lock includes a [2nd] second tubular extension lock first end and a [$2^{nd}$] second tubular extension lock first inner bore that is designed and adapted to slidably receive the [$2^{nd}$] second inner tube. The [$2^{nd}$] second tubular extension lock also includes a [2nd] second tubular extension lock second end and a [$2^{nd}$] second tubular extension lock second inner bore that is adjacent to the [$2^{nd}$] second tubular extension lock first inner bore and is designed and adapted to receive and secure the [$2^{nd}$] second outer tube stepped first end 218*b*. The [$2^{nd}$] second tubular extension lock 221*b* also includes a [$2^{nd}$] second spring biased thumb lever 222*b* designed and adapted to selectively engage the [$2^{nd}$] second plurality of locking apertures 216*b* being situate on the [$2^{nd}$] second inner tube flat top wall. The [$2^{nd}$] second tubular extension lock 221*b* being fastened and secured to the [$2^{nd}$] second outer tube stepped first end 218*b*.

The [$2^{nd}$] second tubular extension lock 221*b* and the [$2^{nd}$] second outer tube 217*b* are designed and adapted to slidably receive and lock the [$2^{nd}$] second inner tube 213*b* into position as desired by a user when increasing r decreasing the length of the [$2^{nd}$] second telescopic member 210*b*.

The [$2^{nd}$] at least one connecting rod member for the 2nd preferred embodiment of the present invention includes a [$2^{nd}$] tubular coupler 205 having a [$2^{nd}$] tubular coupler stepped first end with a pair of vertically aligned fastener apertures and a [$2^{nd}$] tubular coupler stepped second end with a pair of vertically aligned fastener apertures. The [$2^{nd}$] tubular coupler 205 is designed and adapted to longitudinally connect the [$2^{nd}$] first telescopic member second end 212*a* to the [$2^{nd}$] second telescopic member second end 212*b* via the alignment of the respective vertically aligned fastener apertures of the [$2^{nd}$] first and [$2^{nd}$] second telescopic member second ends 212*a*, 212*b* with the vertically aligned fastener apertures of the [$2^{nd}$] tubular coupler stepped first and second ends with fasteners being inserted therein.

The [$2^{nd}$] at least one connecting rod member 200 for the [$2^{nd}$] embodiment of the present invention also includes a [$2^{nd}$] tubular coupler extension 206 that is designed and adapted to be used in lieu of the [$2^{nd}$] tubular coupler 205 to further increase the [$2^{nd}$] at least one connecting rod member adjustable length. The [$2^{nd}$] tubular coupler extension has a [$2^{nd}$] tubular extension length of about 12 inches and is designed and adapted to connect the [$2^{nd}$] first telescopic member second end to the [$2^{nd}$] second telescopic member second end in same manner as when the [$2^{nd}$] tubular coupler is used for such longitudinal connection via the alignment of the respective vertically aligned fastener apertures of the [$2^{nd}$] first and [$2^{nd}$] second telescopic member second ends with the vertically aligned fastener apertures of the [$2^{nd}$] tubular coupler extension stepped first and second ends with fasteners being inserted therein.

The [$2^{nd}$] at least one vacuum-handle member 240 for the 2nd embodiment of the present invention is designed and adapted for its detachable attachment to a [first] watercraft or to a [second] watercraft and for its detachable attachment to a [2nd] at least one connecting rod member first end 201 or to a [2nd] at least one connecting rod member second end 202. The [2nd] at least one vacuum-handle member for the [2nd] embodiment of the present invention comprises a [2nd] handle mount 241, a [2nd] first vacuum cup assembly 250*a*, a [2nd] second vacuum cup assembly 250*b*, a [2nd] separation distance, a [2nd] counter displacement means to respond to relative movement between a first watercraft and a second watercraft, or between a first watercraft and a dock during temporary mooring of a first watercraft, and a [2nd] vacuum-handle member connector.

The [2nd] handle mount 241 of the [2nd] at least one vacuum-handle member for the [2nd] embodiment of the present invention has a [2nd] handle mount inner surface 242 and a [2nd] handle mount outer surface 243. The [2nd] handle mount includes a [2nd] handle mount connector aperture 244 that facilitates the detachable attachment of the [2nd] at least one vacuum-handle member 240 with the [2nd] at least one connecting rod member 200. The [2nd] handle mount also defines and includes a [2nd] at least one handle mount gripping aperture 245 which provides a user a handle-like surface and structure to grip when using the present invention.

The [2nd] first vacuum cup assembly 250*a* of the [2nd] at least one vacuum-handle member 240 for the [2nd] embodiment of the present invention includes a [2nd] first vacuum cup 251*a*, a [2nd] first vacuum cup assembly mount 252*a*, and a [2nd] first ball joint 253*a*. The [2nd] first vacuum cup 251*a* has a [2nd] first vacuum cup diameter of 6 inches, a [2nd] first vacuum cup bottom side, and a [2nd] first vacuum cup top side. Although the [$2^{nd}$] first vacuum cup 251*a* for the [$2^{nd}$] embodiment has a diameter of 6 inches, it is understood that such diameter may be decreased or increased as necessary for other embodiments of the present invention to achieve maximum performance of the present invention in such other embodiment. The [2nd] first vacuum cup 251*a* of the [2nd] first vacuum cup assembly 250*a* is designed and adapted to operationally engage a [2nd] first at least one vacuum means which provides a [2nd] first vacuum to the [2nd] first vacuum cup. The [2nd] first at least one vacuum means for the [2nd] embodiment of the present invention comprises a [2nd] first thumb-operated vacuum plunger assembly which includes a [$2^{nd}$] first thumb-operated vacuum plunger assembly 255*a*. The [2nd] first thumb-operated vacuum plunger assembly 255*a* includes a [2nd] first vacuum tube 256*a*, a pump knob with vacuum indicator rings to indicate the relative vacuum pressure within the first vacuum cup, a compression spring, compression spring collar, and rubber seal.

The [2nd] first vacuum cup assembly mount 252*a* includes a [2nd] first vacuum cup assembly mount top side and a [2nd] first vacuum cup assembly mount bottom side to which the [2nd] first vacuum cup top side is fastened. The [2nd] first vacuum cup assembly mount bottom side defines a [2nd] first vacuum cup assembly mount bottom edge that conforms to the cylindrical shape of the vacuum tube 256*a* of [$2^{nd}$] first thumb-operated vacuum plunger assembly 255*a* to hold the vacuum tube housing in position when the [$2^{nd}$] first vacuum cup assembly mount 252*a* is pivotally secured to the [$2^{nd}$] first vacuum cup top side.

The [$2^{nd}$] first ball joint 253*a* of the [$2^{nd}$] first vacuum cup assembly 250*a* is designed and adapted to fasten and pivotally secure the [$2^{nd}$] first vacuum cup assembly mount top side to the [$2^{nd}$] handle mount outer surface 243 of the [$2^{nd}$] handle mount 241. The use of the [$2^{nd}$] first ball joint provides 360-degree rotational movement of the [$2^{nd}$] first vacuum cup assembly relative to the [$2^{nd}$] handle mount inner surface and up to 5 degrees of vertical or horizontal movement from center of the [$2^{nd}$] first vacuum cup assembly relative to and when attached to a watercraft hull. A [$2^{nd}$] first ball joint sleeve 254*a* surrounds the [$1^{st}$] first ball joint to dampen the vertical or horizontal movement of the [$2^{nd}$] first ball joint from its center position.

The second embodiment of the present invention includes a [$2^{nd}$] second vacuum cup assembly 250*b* that is an exact duplicate of the [$2^{nd}$] first vacuum cup assembly 250*a*, and such duplicity carries forward to each of the individual components of the respective [$2^{nd}$] first vacuum cup assembly 250*a* and the [$2^{nd}$] second vacuum cup assembly 250*b* as well as the functionality of such components. Although the [$2^{nd}$] second vacuum cup assembly is an exact duplicate of the [$2^{nd}$] first vacuum cup assembly, the following description and labels of and for the analogous components of the [$2^{nd}$] second vacuum cup assembly 250*b* are provided for a complete and thorough understanding of the first embodiment of the present invention.

The [2nd] second vacuum cup assembly 250*b* of the [2nd] at least one vacuum-handle member 240 for the first embodiment of the present invention includes a [2nd] second vacuum cup 251*b*, a [2nd] second vacuum cup assembly mount 252*b*, and a [2nd] second ball joint 253*b*. The [2nd] second vacuum cup 251*b* has [2nd] second vacuum cup release tabs 258*b*, a [2nd] second vacuum cup bottom side, a [2nd] second vacuum cup top side, a [2nd] second vacuum intake port 257*b*, and a [2nd] second vacuum cup diameter of 6 inches. Although the [2nd] second vacuum cup for the second embodiment has a diameter of 6 inches, it is understood that such diameter may be decreased or increased as necessary for other embodiments of the present invention to achieve maximum performance of the present invention in such other embodiment. The [2nd] second vacuum cup of the [2nd] second vacuum cup assembly is designed and adapted to operationally engage a [2nd] second at least one vacuum means which provides a [2nd] second vacuum to the [2nd] second vacuum cup. The [2nd] second at least one vacuum means for the first embodiment of the present invention comprises a [2nd] second thumb-operated vacuum plunger assembly 255*b*. The [2nd] first thumb-operated vacuum plunger assembly 255*b* includes a [2nd] second vacuum tube 256*b*, a pump knob with vacuum indicator rings to indicate the relative vacuum pressure within the first vacuum cup, a compression spring, compression spring collar, and rubber seal.

The [$2^{nd}$] second vacuum cup assembly mount 252*b* includes a [2nd] second vacuum cup assembly mount top side and a [2nd] second vacuum cup assembly mount bottom side to which the [2nd] second vacuum cup top side is fastened. The [2nd] second vacuum cup assembly mount bottom side defines a [2nd] second vacuum cup assembly mount bottom edge that conforms to the cylindrical shape of the vacuum tube 256*b* of [2nd] second thumb-operated vacuum plunger assembly 255*b* to hold the vacuum tube housing in position when the [2nd] second vacuum cup assembly mount 252*b* is pivotally secured to the [2nd] second vacuum cup top side.

The [2nd] second ball joint 253*b* of the [2nd] second vacuum cup assembly 250*b* is designed and adapted to fasten and pivotally secure the [2nd] second vacuum cup assembly mount top side to the [2nd] handle mount outer surface 243 of the [2nd] handle mount 241. The use of the [2nd] second ball joint provides 360-degree rotational movement of the [2nd] second vacuum cup assembly relative to the [2nd] handle mount inner surface and up to 5 degrees of vertical or horizontal movement from center position of the [2nd] second vacuum cup assembly relative to and when attached to a watercraft hull. A [2nd] second ball joint sleeve 254*b* surrounds the [2nd] second ball joint to dampen the vertical or horizontal movement of the [2nd] second ball joint from its center position.

The [2nd] separation distance of the [2nd] at least one vacuum-handle member 240 for the second embodiment of the present invention is a distance between the [2nd] first vacuum cup assembly 250*a* and the [2nd] second vacuum cup assembly 250*b* that provides optimal functionality of the [2nd] at least one vacuum-handle 240 member upon the detachable attachment of the [2nd] at least one vacuum-handle member to the hull of a watercraft. The [2nd] separation distance for the present invention provides that the [2nd] first and second vacuum cup assemblies will perform as a single unit as opposed to two separate vacuum cup assemblies which results in greater push and pull force. The separation distance for the second embodiment of the present invention is 1.5 inches as measured from the closest edges of the [2nd] first vacuum cup 251*a* of the [2nd] first vacuum cup assembly 250*a* and the [2nd] second vacuum cup 251*b* of the [2nd] second vacuum cup assembly 250*b* when the [2nd] first and second vacuum cups are fully engaged with vacuum. However, under some circumstances the size of the vacuum cups relative to the size of the handle mount may dictate a measurement other than 1.5 inches.

The [2nd] at least one vacuum-handle member 240 for the second embodiment of the present invention includes a [2nd] counter displacement means for responding to relative movement that may occur between the first watercraft and the second watercraft, or between the first watercraft and a dock, during temporary mooring of the first watercraft. The [2nd] counter displacement means for pivotally responding to such relative movement for the present invention comprises a [2nd] handle mount spherical joint 270 having a misalignment angle up to 30 degrees and having a spherical joint central channel passing horizontally through the [$2^{nd}$] handle mount spherical joint. The [2nd] handle mount spherical joint is secured within the [2nd] handle mount connector aperture 244 via a retaining ring. The [2nd] handle mount spherical joint 270 being oriented such that the spherical joint central channel providing a passageway through the [2nd] handle mount 241 from the [2nd] handle mount inner surface 242 to the [$2^{nd}$] handle mount outer surface 243. Unlike the torsion spring assembly of the [$1^{st}$] at least one vacuum-handle member of the first embodiment for the present invention which only responds to vertical movement between a first watercraft temporarily moored to a second watercraft, the [2nd] handle mount spherical joint is designed and adapted to pivotally respond to both vertical movement/displacement and horizontal movement/displacement of the first watercraft relative to the second watercraft or relative to a dock. Additionally, the [$2^{nd}$] handle mount spherical joint provides 360-degree rotation of the [$2^{nd}$] at least one vacuum-handle member thereby facilitating the detachable attachment of the [$2^{nd}$] at least one vacuum-handle member to a variety of watercraft surfaces.

The [2nd] at least one vacuum-handle member 240 for the present invention includes a [2nd] vacuum-handle member connector. The [2nd] vacuum-handle member connector is designed and adapted for the detachable attachment of the [2nd] at least one connecting rod member first end 201 or the [2nd] at least one connecting rod member second end 202 to the [$2^{nd}$] handle mount spherical joint 270. The [$2^{nd}$] vacuum-handle member connector for the $2^{nd}$ embodiment of the present invention comprises a [$2^{nd}$] spherical joint connector 279. The [2nd] spherical joint connector having a [$2^{nd}$] spherical joint connector cylindrical body comprising a [2nd] spherical joint connector first end that is designed and adapted for operative attachment to the [2nd] handle mount spherical joint 270 of the [$2^{nd}$] vacuum-handle member 240 and a [2nd] spherical joint connector second end that is designed and adapted for detachable attachment to the [$2^{nd}$] at least one connecting rod member first end 201 or to the [$2^{nd}$] at least one connecting rod member second end 202. The [2nd] spherical joint connector first end comprising a cylindrical bolt member extending axially from the [2nd] spherical joint connector first end of the [2nd] spherical joint connector cylindrical body. The cylindrical bolt member having a proximate end and a distal end. The cylindrical bolt member proximate end being contiguous to the [2nd] spherical joint connector first end and defines a spherical joint connector annular collar. The spherical joint connector annular collar having a rubber dampener affixed thereto for dampening the connecting rod movements. The cylindrical bolt member distal end defining an axial fastener bore designed and adapted to receive a threaded fastener bolt to secure the cylindrical bolt member to the handle mount spherical joint central channel. The [2nd] spherical joint connector second end defining a spherical joint internal bore and a pair of vertically aligned fastener apertures. The [2nd] spherical joint second end designed and adapted to slidably receive and secure the [$2^{nd}$] first inner tube first end 214*a* of the [$2^{nd}$] first telescopic member 210*a* or [$2^{nd}$] second inner tube first end 214*b* of the [$2^{nd}$] second telescopic member 210*b* of said [$2^{nd}$] at least one connecting rod member 200.

The first embodiment of the present invention includes a [2nd] at least one cleat connector member 280 that is designed and adapted for its detachable attachment to a first watercraft cleat or to a second watercraft cleat or to a dock cleat, and for detachable attachment to said [2nd] at least one connecting rod member first end 201 or to said [2nd] at least one connecting rod member second end 202. The [2nd] at least one cleat connector member can be used in conjunction with the [2nd] at least one vacuum-handle member 240 should such a configuration be needed or desired by a user. The [2nd] at least one cleat connector member includes a [2nd] cleat assembly mount 280 and a [2nd] cleat attachment line assembly 283.

The [2nd] cleat assembly mount 281 of the [2nd] at least one cleat connector member 280 for the present invention is designed and adapted for detachable attachment to the [2nd] first telescopic member 210*a* of the [2nd] at least one connecting rod member 200 or to the [2nd] second telescopic member 210*b* of the [2nd] at least one connecting rod member 200. The cleat assembly mount having a cleat assembly mount tubular body comprising a cleat assembly mount tubular body first end, a cleat assembly mount tubular body second end, and a rubber annular cleat dampener defining a pair of [2nd] cleat attachment line guide grooves affixed to the cleat assembly mount tubular body second end. The cleat assembly tubular body also includes a pair of cleat connector member fastener apertures being vertically aligned. The pair of cleat connector member fastener apertures are designed and adapted fastening the [$2^{nd}$] cleat assembly mount 280 to the [2nd] first inner tube first end 214*a* of the first [2nd] telescopic member 210*a* of the [2nd] at least one connecting rod member 200 or the [2nd] second inner tube first end 214*b* of the first [2nd] telescopic member 210*b* of the [2nd] at least one connecting rod member 100.

The [2nd] cleat attachment line assembly 283 of the [2nd] at least one cleat connector member 280 for the present invention is affixed to the [2nd] cleat assembly mount 281. The [2nd] cleat attachment line assembly defines a [1' ] adjustable cleat line loop 285 that is designed and adapted for detachable attachment to a watercraft cleat or to a dock cleat. The [2nd] cleat attachment line assembly 283 includes a cleat attachment line 284 having a handled first end 286 and a cleat attachment line second end and an attachment line fixed mount 287 that is fastened to the [2nd] cleat assembly mount 281 to secure the cleat attachment line second end to the [2nd] cleat assembly mount 281. The [2nd] cleat attachment line assembly also includes a cleat attachment line tension clip 288 that is operatively attached to the [2nd] cleat assembly mount 281 opposite to the attachment line fixed mount 287 and is used to secure the [2nd] cleat attachment line about a watercraft cleat or a dock cleat to temporarily moor a watercraft.

The [$2^{nd}$] safety device 290 comprises an inflatable spherical rubber device having at least a 10 inch diameter and manufactured in a high visibility color to properly convey a warning. The tether for detachably attaching the [21" ] safety device to the [21" ] at least one connecting rod member 200 may be manufactured for a hook and loop material to provide a simple and quick mechanism for detachable attachment to the [2nd] at least one connecting rod member 200. The safety device may also be manufactured from polyethylene foam or such other lightweight materials. An additional aspect of an inflatable [2nd] safety device or one manufactured from polyethylene foam is the buoyancy characteristic of such materials. In the event the present invention is dropped or falls into a body water, the buoyancy of such materials such may prevent the sinking and/or subsequent loss of the present invention under such circumstances.

Similar to the first and second embodiments for the present invention, a third embodiment of the present invention includes a plurality of interchangeable mooring members that are designed and adapted for the temporary mooring of a first watercraft to a second watercraft, or the mooring of the first watercraft to a dock or such other stationary object having a cleat for mooring watercraft. However, the third embodiment is directed to watercraft having a length of at least 30 feet. Also similar to the first and second embodiments, the third embodiment for the present invention includes a plurality of interchangeable mooring members comprising a connecting rod member, or at least one connecting rod member being identified as a [$3^{rd}$] at least one connecting rod member infra to which other interchangeable mooring members are detachably attached, a vacuum-handle member, or at least one vacuum-handle member being identified as a [$3^{rd}$] at least one vacuum-handle member infra which detachably attaches to the hull of a watercraft, a cleat connector member, or at least one cleat connector member being identified as a [$3^{rd}$] at least one cleat connector member infra for the detachable attachment to watercraft cleats or to a dock cleat, and a safety device being identified as a [$3^{rd}$] safety device infra that is suspended from the [$3^{rd}$] at least one connecting rod member towards the water's surface.

Now referring to FIGS. 3, 5, FIGS. 17 to 20, FIGS. 30, 31, 32, 33, FIGS. 39 to 48, and FIG. 68, the [3rd] at least one connecting rod member 300 for the third embodiment of the present invention has a [3rd] adjustable length 30 inches to 42 inches a [3rd] at least one connecting rod member first end 301, and a [3rd] at least one connecting rod member second end 302. The [3rd] at least one connecting rod member includes a [3rd] telescopic member 310 having a [3rd] telescopic member first end 311 and a [3rd] telescopic member second end 312. The [3rd] telescopic member also comprises a [3rd] inner tube 320, a [3rd] first extension lock 331, a [3rd] second extension lock 335, a [3rd] first outer tube 360*a*, and a [3rd] second outer tube 360*b*.

The [3rd] inner tube 320 of the [3rd] telescopic member has a [3rd] inner tube length of 16.5 inches and a [3rd] inner tube inner bore of about 0.824 inches.

Additional aspects and features of the [3rd] inner tube include a [3rd] inner tube first-half length, a [3rd] inner tube second-half length, a [3rd] inner tube first end 321, a [3rd] inner tube second end 322, a [3rd] inner tube upper and lower walls connecting the [3rd] inner tube first and second ends, a [3rd] inner tube first end upper locking aperture 323 which extends through the [3rd] inner tube upper wall, a [3rd] inner tube first end lower slide groove aperture which extends through the [3rd] inner tube lower wall and is parallel to the a [3rd] inner tube first end upper locking aperture, a [3rd] inner tube second end upper locking aperture 325 that extends through the [3rd] inner tube upper wall, a [3rd] inner tube second end lower slide groove aperture which extends through the [3rd] inner tube lower wall and is parallel to the [3rd] inner tube second end upper locking aperture, The [$3^{rd}$] first extension lock 331 of the [3rd] telescopic member 310 includes a [$3^{rd}$] first pair of spring biased extension lock buttons that are located at the [3rd] inner tube first end 321 and within the [$3^{rd}$] inner tube inner bore. The [$3^{rd}$] first pair of spring biases extension lock buttons are designed and adapted to operatively extend outward through the [3rd] inner tube first end upper locking aperture 323 and the [$3^{rd}$] inner tube first end lower slide groove aperture. The [$3^{rd}$] first pair of spring biased extension lock buttons comprising a [$3^{rd}$] first end upper extension lock button, a [$3^{rd}$] first end lower slide groove button, and a [3rd] first extension lock spring urging the [$3^{rd}$] first end upper extension lock button away from the [$3^{rd}$] first end lower slide groove button.

The [3rd] telescopic member 310 also includes a [$3^{rd}$] second extension lock 335 which includes a [$3^{rd}$] second pair of spring biased extension lock buttons located at the [3rd] inner tube second end 322 and within the [$3^{rd}$] inner tube inner bore and being designed and adapted to operatively extend outward through the [$3^{rd}$] inner tube second end upper locking aperture 325 and the [$3^{rd}$] inner tube second end lower slide groove aperture. The [$3^{rd}$] second pair of spring biased extension lock buttons comprising a [$3^{rd}$] second end upper extension lock button, a [$3^{rd}$] second end lower slide groove button, and a [$3^{rd}$] second extension lock spring urging said [$3^{rd}$] second end upper extension lock button away from the [$3^{rd}$] second end lower slide groove button.

The [3rd] telescopic member includes a [$3^{rd}$] first outer tube 360*a* having a [$3^{rd}$] first outer tube length of about 9 inches and a [$3^{rd}$] first outer tube inner bore of about 1.070 inches. The [3rd] first outer tube 360*a* is designed and adapted to slidably receive the [$3^{rd}$] inner tube first-half length to extend or shorten the length of the [3rd] at least one connecting rod member 300 of the present invention.

The [3rd] first outer tube also includes a [3rd] first outer tube first end 361*a*, a [3rd] first outer tube second end 363*a*, [3rd] first outer tube first end upper and lower fastener apertures, a [3rd] first outer tube upper wall having a plurality of first outer tube locking apertures 365*a* being aligned along the [3rd] first outer tube upper wall and passing therethrough, and a [3rd] first outer tube lower wall having a first outer tube elongated slide groove 366*a* passing therethrough.

The plurality of first outer tube locking apertures 365*a* are designed and adapted to selectively engage the first end upper extension lock button of the [3rd] first extension lock 331 when a user is increasing or decreasing the adjustable length of the [3rd] at least one connecting rod member via movement of the [3rd] first outer tube.

The [3rd] first outer tube elongated slide groove 366*a* is designed and adapted to slidably engaged the first end lower slide groove button when a user is increasing or decreasing the adjustable length of the [3rd] at least one connecting rod member 300. Additionally, the first tube elongate slide groove and the first end lower groove button provide structural integrity and improved functionality for the [3rd] telescopic member 310.

The [3rd] telescopic member also includes a [3rd] second outer tube 360*b* being the identical opposite of the [3rd] first outer tube 360*a* and is used to increase or decrease the adjustable length of the [3rd] at least one connecting rod member 300 for the 3rd embodiment of the present invention. The [3rd] second outer tube 360*b* having a [3rd] second outer tube length of about 9 inches and a [3rd] second outer tube inner bore of about 1.070 inches and designed and adapted to slidably receive the 3rd inner tube second-half length to extend or shorten the length of the [3rd] at least one connecting rod member of the present invention.

The [3rd] second outer tube also includes a [3rd] second outer tube first end 361*b*, a [3rd] second outer tube second end 363*b*, [3rd] second outer tube first end upper and lower fastener apertures, a [3rd] second outer tube upper wall having a plurality of second outer tube locking apertures 365*b* being aligned along the [3rd] second outer tube upper wall and passing therethrough, and a [3rd] second outer tube lower wall having a second outer tube elongated slide groove 366*b* passing therethrough. The plurality of second outer tube locking apertures 365*b* are designed and adapted to selectively engage the second end upper extension lock button of the [3rd] second extension lock 335 when a user is increasing or decreasing the adjustable length of the [3rd] at least one connecting rod member. The second outer tube elongated slide groove is designed and adapted to slidably engaged the second end lower slide groove button when a user is increasing or decreasing the adjustable length of the [3rd] at least one connecting rod member 300. Additionally, the second tube elongate slide groove and the second end lower groove button provide structural integrity and improved functionality for the [3rd] telescopic member 310.

The 3rd embodiment of the present invention includes a [3rd] at least one vacuum-handle member. The [3rd] at least one vacuum-handle member for the 3rd embodiment for the present invention is identical in form and function to the [2nd] at least one vacuum-handle member for the 2nd embodiment for the present invention. With the exception of the numerical/alpha-numerical labels used in the following description and on the various figures illustrating the present invention to identify the various components of the present invention, the following written description is the same as the written description provided supra for the [2nd] at least one vacuum-handle member for the 2nd embodiment for the present invention.

The [3rd] at least one vacuum-handle member 340 for the 2nd embodiment of the present invention is designed and adapted for its detachable attachment to a [first] watercraft or to a [second] watercraft and for its detachable attachment to a [3rd] at least one connecting rod member first end 301 or to a [3rd] at least one connecting rod member second end 302. The [3rd] at least one vacuum-handle member for the [3rd] embodiment of the present invention comprises a [3rd] handle mount 341, a [3rd] first vacuum cup assembly 350*a*, a [3rd] second vacuum cup assembly 350*b*, a [3rd] separation distance, a [3rd] counter displacement means to respond to relative movement between a first watercraft and a second watercraft, or between a first watercraft and a dock during temporary mooring of a first watercraft, and a [3rd] vacuum-handle member connector.

The [3rd] handle mount 341 of the [3rd] at least one vacuum-handle member for the [3rd] embodiment of the present invention has a [3rd] handle mount inner surface 342 and a [3rd] handle mount outer surface 343. The [3rd] handle mount includes a [3rd] handle mount connector aperture 344 that facilitates the detachable attachment of the [3rd] at least one vacuum-handle member 340 with the [3rd] at least one connecting rod member 300. The [3rd] handle mount also defines and includes a [3rd] at least one handle mount gripping aperture 345 which provides a user a handle-like surface and structure to grip when using the present invention.

The [3rd] first vacuum cup assembly 350*a* of the [3rd] at least one vacuum-handle member 340 for the [3rd] embodiment of the present invention includes a [3rd] first vacuum cup 351*a*, a [3rd] first vacuum cup assembly mount 352*a*, and a [3rd] first ball joint 353*a*. The [3rd] first vacuum cup 351*a* has a [3rd] first vacuum cup diameter of 6 inches, a [3rd] first vacuum cup bottom side, and a [3rd] first vacuum cup top side. Although the [3rd] first vacuum cup 351*a* for the [3rd] embodiment has a diameter of 6 inches, it is understood that such diameter may be decreased or increased as necessary for other embodiments of the present invention to achieve maximum performance of the present invention in such other embodiment. The [3rd] first vacuum cup 351*a* of the [3rd] first vacuum cup assembly 350*a* is designed and adapted to operationally engage a [3rd] first at least one vacuum means which provides a [3rd] first vacuum to the [3rd] first vacuum cup. The [3rd] first at least one vacuum means for the [3rd] embodiment of the present invention comprises a [3rd] first thumb-operated vacuum plunger assembly which includes a [3rd] first thumb-operated vacuum plunger assembly 355*a*. The [3rd] first thumb-operated vacuum plunger assembly 355*a* includes a [3rd] first vacuum tube 356*a*, a pump knob with vacuum indicator rings to indicate the relative vacuum pressure within the first vacuum cup, a compression spring, compression spring collar, and rubber seal.

The [3rd] first vacuum cup assembly mount 352*a* includes a [3rd] first vacuum cup assembly mount top side and a [3rd] first vacuum cup assembly mount bottom side to which the [3rd] first vacuum cup top side is fastened. The [3rd] first vacuum cup assembly mount bottom side defines a [3rd] first vacuum cup assembly mount bottom edge that conforms to the cylindrical shape of the vacuum tube 356*a* of [3rd] first thumb-operated vacuum plunger assembly 355*a* to hold the vacuum tube housing in position when the [3rd] first vacuum cup assembly mount 352*a* is pivotally secured to the [3rd] first vacuum cup top side.

The [3rd] first ball joint 353*a* of the [3rd] first vacuum cup assembly 350*a* is designed and adapted to fasten and pivotally secure the [3rd] first vacuum cup assembly mount top side to the [3rd] handle mount outer surface 343 of the [3rd] handle mount 341. The use of the [3rd] first ball joint provides 360-degree rotational movement of the [3rd] first vacuum cup assembly relative to the [3rd] handle mount inner surface and up to 5 degrees of vertical or horizontal movement from center of the [3rd] first vacuum cup assembly relative to and when attached to a watercraft hull. A [3rd] first ball joint sleeve 354*a* surrounds the [3rd] first ball joint to dampen the vertical or horizontal movement of the [3rd] first ball joint from its center position.

The third embodiment of the present invention includes a [3rd] second vacuum cup assembly 350*b* that is an exact duplicate of the [3rd] first vacuum cup assembly 350*a*, and such duplicity carries forward to each of the individual components of the respective [3rd] first vacuum cup assembly 350*a* and the [3rd] second vacuum cup assembly 350*b* as well as the functionality of such components. Although the [3rd] second vacuum cup assembly is an exact duplicate of the [3rd] first vacuum cup assembly, the following description and labels of and for the analogous components of the [3rd] second vacuum cup assembly 350*b* are provided for a complete and thorough understanding of the first embodiment of the present invention.

The [3rd] second vacuum cup assembly 350*b* of the [3rd] at least one vacuum-handle member 340 for the first embodiment of the present invention includes a [3rd] second vacuum cup 351*b*, a [3rd] second vacuum cup assembly mount 352*b*, and a [3rd] second ball joint 353*b*. The [3rd] second vacuum cup 351*b* has [3rd] second vacuum cup release tabs 358*b*, a [3rd] second vacuum cup bottom side, a [3rd] second vacuum cup top side, a [3rd] second vacuum intake port 357*b*, and a [3rd] second vacuum cup diameter of 6 inches. Although the [3rd] second vacuum cup for the second embodiment has a diameter of 6 inches, it is understood that such diameter may be decreased or increased as necessary for other embodiments of the present invention to achieve maximum performance of the present invention in such other embodiment. The [3rd] second vacuum cup of the [3rd] second vacuum cup assembly is designed and adapted to operationally engage a [3rd] second at least one vacuum means which provides a [3rd] second vacuum to the [3rd] second vacuum cup. The [3rd] second at least one vacuum means for the first embodiment of the present invention comprises a [3rd] second thumb-operated vacuum plunger assembly 355*b*. The [3rd] first thumb-operated vacuum plunger assembly 355*b* includes a [3rd] second vacuum tube 356*b*, a pump knob with vacuum indicator rings to indicate the relative vacuum pressure within the first vacuum cup, a compression spring, compression spring collar, and rubber seal.

The [3rd] second vacuum cup assembly mount 352*b* includes a [3rd] second vacuum cup assembly mount top side and a [3rd] second vacuum cup assembly mount bottom side to which the [3rd] second vacuum cup top side is fastened. The [3rd] second vacuum cup assembly mount bottom side defines a [3rd] second vacuum cup assembly mount bottom edge that conforms to the cylindrical shape of the vacuum tube 356*b* of [3rd] second thumb-operated vacuum plunger assembly 355*b* to hold the vacuum tube housing in position when the [3rd] second vacuum cup assembly mount 352*b* is pivotally secured to the [3rd] second vacuum cup top side.

The [3rd] second ball joint 353*b* of the [3rd] second vacuum cup assembly 350*b* is designed and adapted to fasten and pivotally secure the [3rd] second vacuum cup assembly mount top side to the [3rd] handle mount outer surface 343 of the [3rd] handle mount 341. The use of the [3rd] second ball joint provides 360-degree rotational movement of the [3rd] second vacuum cup assembly relative to the [3rd] handle mount inner surface and up to 5 degrees of vertical or horizontal movement from center position of the [3rd] second vacuum cup assembly relative to and when attached to a watercraft hull. A [3rd] second ball joint sleeve 354*b* surrounds the [3rd] second ball joint to dampen the vertical or horizontal movement of the [3rd] second ball joint from its center position.

The [3rd] separation distance of the [3rd] at least one vacuum-handle member 340 for the third embodiment of the present invention is a distance between the [3rd] first vacuum cup assembly 350*a* and the [3rd] second vacuum cup assembly 350*b* that provides optimal functionality of the [3rd] at least one vacuum-handle 340 member upon the detachable attachment of the [3rd] at least one vacuum-handle member to the hull of a watercraft. The [3rd] separation distance for the present invention provides that the [3rd] first and second vacuum cup assemblies will perform as a single unit as opposed to two separate vacuum cup assemblies which results in greater push and pull force. The separation distance for the second embodiment of the present invention is 1.5 inches as measured from the closest edges of the [3rd] first vacuum cup 351*a* of the [3rd] first vacuum cup assembly 350*a* and the [3rd] second vacuum cup 351*b* of the [3rd] second vacuum cup assembly 350*b* when the [3rd] first and second vacuum cups are fully engaged with vacuum. However, under some circumstances the size of the vacuum cups relative to the size of the handle mount may dictate a measurement other than 1.5 inches.

The [3rd] at least one vacuum-handle member 340 for the second embodiment of the present invention includes a [3rd] counter displacement means for responding to relative movement that may occur between the first watercraft and the second watercraft, or between the first watercraft and a dock, during temporary mooring of the first watercraft. The [3rd] counter displacement means for pivotally responding to such relative movement for the present invention comprises a [3rd] handle mount spherical joint 370 having a misalignment angle up to 30 degrees and having a spherical joint central channel passing horizontally through the [3rd] handle mount spherical joint. The [3rd] handle mount spherical joint is secured within the [3rd] handle mount connector aperture 344 via a retaining ring. The [3rd] handle mount spherical joint 370 being oriented such that the spherical joint central channel providing a passageway through the [3rd] handle mount 341 from the [3rd] handle mount inner surface 342 to the [3rd] handle mount outer surface 343. Unlike the torsion spring assembly of the [1st] at least one vacuum-handle member of the first embodiment for the present invention which only responds to vertical movement between a first watercraft temporarily moored to a second watercraft, the [3rd] handle mount spherical joint is designed and adapted to pivotally respond to both vertical movement/displacement and horizontal movement/displacement of the first watercraft relative to the second watercraft or relative to a dock. Additionally, the [3rd] handle mount spherical joint provides 360-degree rotation of the [3rd] at least one vacuum-handle member thereby facilitating the detachable attachment of the [3rd] at least one vacuum-handle member to a variety of watercraft surfaces.

The [3rd] at least one vacuum-handle member 340 for the present invention includes a [3rd] vacuum-handle member connector. The [3rd] vacuum-handle member connector is designed and adapted for the detachable attachment of the [3rd] at least one connecting rod member first end 301 or the [3rd] at least one connecting rod member second end 302 to the [3rd] handle mount spherical joint 370. The [3rd] vacuum-handle member connector for the $2^{nd}$ embodiment of the present invention comprises a [3rd] spherical joint connector 379. The [3rd] spherical joint connector having a [3rd] spherical joint connector cylindrical body comprising a [3rd] spherical joint connector first end that is designed and adapted for operative attachment to the [3rd] handle mount spherical joint 370 of the [3rd] vacuum-handle member 340 and a [3rd] spherical joint connector second end that is designed and adapted for detachable attachment to the [3rd] at least one connecting rod member first end 301 or to the [3rd] at least one connecting rod member second end 302. The [3rd] spherical joint connector first end comprising a cylindrical bolt member extending axially from the [3rd] spherical joint connector first end of the [3rd] spherical joint connector cylindrical body. The cylindrical bolt member having a proximate end and a distal end. The cylindrical bolt member proximate end being contiguous to the [3rd] spherical joint connector first end and defines a spherical joint connector annular collar. The spherical joint connector annular collar having a rubber dampener affixed thereto for to dampen the connecting rod member.

The cylindrical bolt member distal end defining an axial fastener bore designed and adapted to receive a threaded fastener bolt to secure the cylindrical bolt member to the handle mount spherical joint central channel. The [3rd] spherical joint connector second end defining a spherical joint internal bore and a pair of vertically aligned fastener apertures. The [3rd] spherical joint second end designed and adapted for slidable insertion into either the [3rd] first outer tube first end 361*a* for alignment of the [3rd] first outer tube first end upper and lower fastener apertures with the pair of vertically aligned fastener apertures of the [3rd] spherical joint connector second for fastening thereto or the [3rd] second outer tube first end 361*b* for alignment of the [3rd] second outer tube first end upper and lower fastener apertures with the pair of vertically aligned fastener apertures of the [3rd] spherical joint connector second for fastening thereto.

The [3rd] embodiment of the present invention includes a [3rd] at least one cleat connector member 380 that is designed and adapted for detachable attachment to a first watercraft cleat, to a second watercraft cleat, or to a dock cleat for the temporary mooring of a first and/or second watercraft. Additionally, [$3^{rd}$] at least one cleat connector member 380 is designed and adapted for detachable attachment to the [$3^{rd}$] at least one connecting rod member first end 301 or to the [$3^{rd}$] at least one connecting rod member second end 302 for the temporary mooring of a first and/or second watercraft. The [$3^{rd}$] at least one cleat connector member 380 can be used in conjunction with the [$3^{rd}$] at least one vacuum-handle member 340 should such a configuration be needed or desired by a user. The [$3^{rd}$] at least one cleat connector member 380 for the [$3^{rd}$] embodiment of the present invention includes a [3rd] cleat assembly mount 381 and a [3rd] cleat attachment line assembly 383.

The a [3rd] cleat assembly mount for the present invention includes a [3rd] cleat assembly mount cylindrical body having a [3rd] cleat assembly mount cylindrical body first end designed and adapted for detachable attachment to said [3rd] first outer tube first end of said [3rd] telescopic member or to said [3rd] second outer tube first end of [3rd] telescopic member.

The [3rd] cleat assembly mount cylindrical body also includes a [3rd] cleat assembly mount cylindrical body second end, a [3rd] cleat assembly oval-shaped mounting disk affixed to the [3rd] cleat assembly mount cylindrical body second end defining a clam-cleat fastener 388 to selectively engage the [3rd] cleat attachment line and a stepped edge, a [3rd] pair of longitudinal cleat line channels 389 traversing the [3rd] cleat assembly mount cylindrical body, and a [3rd] pair of horizontal fastener apertures designed and adapted to engage the a [3rd] first outer tube first end upper and lower fastener apertures of the [3rd] first outer tube first end 361*a* of the [3rd] at least one connecting rod member 300 or the [3rd] second outer tube first end upper and lower fastener apertures of the [3rd] first outer tube first end 361*b* of the [3rd] at least one connecting rod member 300 for detachable attachment of the [3rd] at least one cleat connector member 380.

The a [3rd] cleat attachment line assembly 383 for the present invention is affixed to the [3rd] cleat assembly mount 381. The [3rd] cleat attachment line assembly operationally defines a [3rd] adjustable cleat line loop 385 that is designed and adapted for detachable attachment to a watercraft cleat or to a dock cleat.

The [3rd] cleat attachment line assembly includes a [3rd] tubular cleat dampener 382 that defines a [3rd] tubular cleat dampener interior and has a [3rd] tubular cleat dampener first end affixed to the [3rd] cleat assembly oval-shaped mounting disk, a [3rd] cleat attachment line 384 having a [3rd] handled first end 386 and a [3rd] cleat attachment line second end 387. The [3rd] cleat attachment line second end 387 travels outward through the claim cleat fastener 388 outward from the tubular cleat dampener 382 forming a [3rd] adjustable cleat line loop 385 then inward to and through the [3rd] pair of longitudinal channels 389 back to said to a [3rd] cleat assembly oval-shaped mounting disk top surface where the [3rd] cleat attachment line second end is knotted to secure [3rd] cleat attachment line second end to the [$3^{rd}$] cleat assembly mount.

The [3rd] embodiment of the present invention includes a [3rd] safety device 390 comprising an inflatable spherical rubber device having at least a 10 inch diameter and manufactured in a high visibility color to properly convey a warning. The tether for detachably attaching the [$3^{rd}$] safety device to the [$3^{rd}$] at least one connecting rod member 300 may be manufactured for a hook and loop material to provide a simple and quick mechanism for detachable attachment to the [3rd] at least one connecting rod member 300. The safety device may also be manufactured from polyethylene foam or such other lightweight materials. An additional aspect of an inflatable [3rd] safety device or one manufactured from polyethylene foam is the buoyancy characteristic of such materials. In the event the present invention is dropped or falls into a body water, the buoyancy of such materials such may prevent the sinking and/or subsequent loss of the present invention under such circumstances.

Similar to the first, second, and third embodiments for the present invention, a fourth embodiment of the present invention includes a plurality of interchangeable mooring members that are designed and adapted for the temporary mooring of a first watercraft to a second watercraft, or the mooring of the first watercraft to a dock or such other stationary object having a cleat for mooring watercraft. Generally, the fourth embodiment of the present invention is directed to watercraft having a length of 30 feet or less. However, depending on the size, shape, and current environmental conditions, the fourth embodiment of the present invention may be used on watercraft of lengths greater than 30 feet as may be determined as appropriate and safe by the user. Also similar to the first, second, and third embodiments, the fourth embodiment for the present invention includes a plurality of interchangeable mooring members comprising a connecting rod member, or at least one connecting rod member being identified as a [$4^{th}$] at least one connecting rod member infra to which other interchangeable mooring members are detachably attached, a vacuum-handle member, or at least one vacuum-handle member being identified as a [$4^{th}$] at least one vacuum-handle member infra which detachably attaches to the hull of a watercraft, a cleat connector member, or at least one cleat connector member being identified as a [$4^{th}$] at least one cleat connector member infra for the detachable attachment to watercraft cleats or to a dock cleat, and a safety device being identified as a [$4^{th}$] safety device infra that is suspended from the [$4^{th}$] at least one connecting rod member towards the water's surface.

Now referring to FIGS. 4, 5, FIGS. 49 to 68, the fourth embodiment of the present invention comprises a [$4^{th}$] first at least one connecting rod member 400, a [$4^{th}$] second at least one connecting rod member 410, a [4th] at least one vacuum-handle member 440, a [4th] at least one cleat connector member 480, and a [4th] safety device 490.

The [4th] first at least one connecting rod member 400 for the fourth embodiment of the present invention has an adjustable length from 15 inches to 21 inches, a length of 7.5 inches, and a [$4^{th}$] first at least one connecting rod inner bore. The [$4^{th}$] first at least one connecting rod member having a [$4^{th}$] first at least one connecting rod member first end 401 with the [$4^{th}$] first at least one connecting rod member first end having a [$4^{th}$] first first end extension lock 403, the [$4^{th}$] first first end extension lock being a first quick-release type connector and a [$4^{th}$] first at least one tubular connecting rod member second end 402 with the [$4^{th}$] first at least one connecting rod member second end having a [$4^{th}$] first second end extension lock 404, the [$4^{th}$] first second end extension lock being a second quick-release type connector The fourth embodiment of the present invention also includes a [$4^{th}$] second at least one connecting rod member 410 that has a [$4^{th}$] second at least one tubular connecting rod member second length of 15 inches which increases the adjustable length of the 4th embodiment of present invention from 22 inches to 29 inches. The [$4^{th}$] second at least one connecting rod member also includes a [$4^{th}$] second at least one connecting rod inner bore. The a [$4^{th}$] second at least one connecting rod member 410 having a [$4^{th}$] second at least one connecting rod member first end 411 with the [$4^{th}$] second at least one connecting rod member first end having a [$4^{th}$] second first end extension lock 413, the [$4^{th}$] second first end extension lock being a third quick-release type connector and a [$4^{th}$] second at least one connecting rod member second end 412 with the [$4^{th}$] second at least one connecting rod member second end having a [$4^{th}$] second second end extension lock 414, the [$4^{th}$] second second end extension lock being a fourth quick-release type connector.

The fourth embodiment of the present invention includes a [$4^{th}$] at least one vacuum-handle member 440 that is designed and adapted for detachable attachment to a watercraft and for detachable attachment to the [$4^{th}$] first or second at least one connecting rod member first end 401, 411 or to the [4th] first or second at least one connecting rod member second end 402, 412. The [$4^{th}$] at least one vacuum-handle member 440 comprising a [$4^{th}$] handle mount 441, a [$4^{th}$] first vacuum cup assembly 450*a*, a [$4^{th}$] second vacuum cup assembly 450*b*, a [$4^{th}$] separation distance, a [$4^{th}$] initial vacuum means for providing an initial vacuum to the [$4^{th}$] first vacuum cup assembly and to the [$4^{th}$] second vacuum cup assembly to detachably attach said [$4^{th}$] at least one vacuum-handle member to a watercraft, and a [$4^{th}$] motion-actuated vacuum means for providing a continuous vacuum to the [$4^{th}$] first vacuum cup assembly and to the [$4^{th}$] second vacuum cup assembly to maintain the [$4^{th}$] at least one vacuum-handle member's detachable attachment to a watercraft.

The [$4^{th}$] handle mount 441 of the [$4^{th}$] at least one vacuum-handle member 440 comprises a [$4^{th}$] handle mount inner surface 442 and a [$4^{th}$] handle mount outer surface 443. Additionally, the [$4^{th}$] handle mount defines a [4th] lower handle grip 444, a [$4^{th}$] upper handle grip 445, a [$4^{th}$] cylindrical socket 446 being defined by said [$4^{th}$] upper handle grip and designed and adapted to house the [$4^{th}$] initial vacuum means, the [$4^{th}$] initial vacuum means comprising a [$4^{th}$] thumb-plunger vacuum assembly 430, a [$4^{th}$] handle mount inner surface spherical socket 447 designed and adapted to house the [$4^{th}$] motion-actuated vacuum means, the [$4^{th}$] motion-actuated vacuum means comprising a [4th] spherical continuous vacuum assembly 420, a [$4^{th}$] first vacuum cup ball socket 448*a* that is designed and adapted to operatively engage and pivotally secure the [$4^{th}$] first vacuum cup assembly 450*a* to the [$4^{th}$] handle mount 441; a [$4^{th}$] second vacuum cup ball socket 448*b* that is designed and adapted to operatively engage and pivotally secure the [$4^{th}$] first vacuum cup assembly 450*b* to the [$4^{th}$] handle mount 441. The design and configuration of the [$4^{th}$] spherical continuous vacuum assembly provides 1) 360-degree rotation of the [$4^{th}$] at least one vacuum-handle member 440 about the first or second end 401, 402, 411, 412 of the [$4^{th}$] first or second at least one tubular connecting rod member 400, 410, and 2) pivotal functionality as also provided by the handle mount spherical joint 270, 370 in embodiments 2 and 3 of the present invention.

The [$4^{th}$] handle mount also defines a plurality of vacuum channels 498 operatively connecting the [$4^{th}$] thumb plunger vacuum assembly 430 and the [$4^{th}$] spherical joint vacuum assembly to the [4th] first and second vacuum cup assemblies 450*a* and 450*b* for the [$4^{th}$] at least one vacuum handle member 440 remains detachably attached to a watercraft. The plurality of vacuum channels includes a vacuum release channel operatively connected to the [$4^{th}$] thumb plunger vacuum assembly and the [4th] first and second vacuum cup assemblies 450*a* and 450*b* that is designed and adapted to release the vacuum within the [$4^{th}$] first and second vacuum cup assemblies 450*a* and 450*b* for detaching the [$4^{th}$] at least one vacuum handle member from the watercraft.

The [$4^{th}$] first vacuum cup assembly 450*a* of the [$4^{th}$] at least one vacuum-handle member 440 comprising a [$4^{th}$] first vacuum cup 451*a* having a [$4^{th}$] first vacuum cup diameter of 6 inches, a [$4^{th}$] first vacuum cup bottom side, a [$4^{th}$] first vacuum cup top side, and a [$4^{th}$] first vacuum cup vacuum port 452*a*. The [$4^{th}$] first vacuum cup assembly also includes [$4^{th}$] first vacuum cup ball joint mount 453*a* to which the [$4^{th}$] first vacuum cup is fastened and which is operatively engaged and pivotally secured to the a [$4^{th}$] first vacuum cup ball socket 448*a*.

The [$4^{th}$] second vacuum cup assembly 450*b* of the [$4^{th}$] at least one vacuum-handle member 440 comprising a [$4^{th}$] second vacuum cup 451*b* having a [$4^{th}$] second vacuum cup diameter of 6 inches, a [$4^{th}$] second vacuum cup bottom side, a [$4^{th}$] second vacuum cup top side, and a [$4^{th}$] second vacuum cup vacuum port 452*b*. The [$4^{th}$] first vacuum cup assembly also includes [$4^{th}$] first vacuum cup ball joint mount 453*b* to which the [4$^{th}$] second vacuum cup is fastened and which is operatively engaged and pivotally secured to the a [4$^{th}$] first vacuum cup ball socket 448*b*. Although the [4$^{th}$] first and second vacuum cups 451*a*, 451*b* for the [4$^{th}$] embodiment has a diameter of 6 inches, it is understood that such diameter may be decreased or increased as necessary for other embodiments of the present invention to achieve maximum performance of the present invention in such other embodiment.

The [4$^{th}$] separation distance of the [4th] at least one vacuum-handle member 440 for the fourth embodiment of the present invention is a distance between the [4th] first vacuum cup assembly 450*a* and the [4th] second vacuum cup assembly 450*b* that provides optimal functionality of the [4$^{th}$] at least one vacuum-handle 440 member upon the detachable attachment of the [4th] at least one vacuum-handle member to the hull of a watercraft. The [4$^{th}$] separation distance for the present invention provides that the [4th] first and second vacuum cup assemblies will perform as a single unit as opposed to two separate vacuum cup assemblies which results in greater push and pull force. The separation distance for the second embodiment of the present invention is 1.5 inches as measured from the closest edges of the [4th] first vacuum cup 451*a* of the [4th] first vacuum cup assembly 450*a* and the [4th] second vacuum cup 451*b* of the [4th] second vacuum cup assembly 450*b* when the [4th] first and second vacuum cups are fully engaged with vacuum. However, under some circumstances the size of the vacuum cups relative to the size of the handle mount may dictate a measurement other than 1.5 inches.

The [4$^{th}$] initial vacuum means of the fourth embodiment of the present invention for providing vacuum to the [4$^{th}$] first vacuum cup assembly 450*a* and to the [4th] second vacuum cup assembly 450*b* is the [4$^{th}$] thumb-plunger vacuum assembly 430. The [4$^{th}$] thumb-plunger assembly comprising a thumb-plunger with vacuum level indicia, o'rings, springs, manifold valve, lip valve, and flat valve. The thumb-plunger vacuum assembly is a 3-in-1 system in light of its functionality. First, it works as a vacuum pump for the initial installation and attachment of the present invention to a watercraft and to provide additional vacuum for calm days on the water. Second, the thumb-plunger vacuum assembly serves as a vacuum indicator. As the vacuum dissipates in the [4$^{th}$] first vacuum cup 451*a* and the [4$^{th}$] second vacuum cup 451*b*, the thumb-plunger will rise to exhibit the vacuum level color indicia. The appearance of the red indicia safety band indicates that additional vacuum should be provided to [4$^{th}$] first and second vacuum cups 451*a*, 451*b*. Third, the thumb-plunger vacuum assembly incorporates a vacuum release valve. The vacuum release valve is activated when the thumb plunger is pressed all the way down into the [4$^{th}$] cylinder socket upon which vacuum is released from the [4$^{th}$] first and second vacuum cups 451*a*, 451*b* for detachment of the [4th] at least one vacuum-handle member 440 from the watercraft.

The [4th] motion-actuated vacuum means for the fourth embodiment of the present invention for providing vacuum to the [4$^{th}$] first vacuum cup assembly 450*a* and to the [4th] second vacuum cup assembly 450*b* is a [4$^{th}$] spherical continuous vacuum assembly 420. The [4$^{th}$] spherical continuous vacuum assembly comprising a spherical housing 421 defining a vacuum piston portal 422 and an inner cavity where the inner cavity comprising a vacuum chamber 423. The a [4th] spherical continuous vacuum assembly also includes a vacuum piston 424 including a piston head 425 and a piston connecting rod 426 extending longitudinally from the piston head and outward through the vacuum piston portal. The piston head being designed and adapted to operationally engage the vacuum chamber to produce vacuum via movement of a watercraft moored with the fourth embodiment of the present invention which results with the movement of the piston 424 within the vacuum chamber 423 of the a [4$^{th}$] spherical continuous vacuum assembly 420.

The piston connecting rod 426 having a distal length 438 comprising a plurality of annular grooves 427 being equally spaced along the distal length 438 of the piston connecting rod. The distal length of the piston connecting rod being designed and adapted to slidably engage the [4th] first at least one connecting rod inner bore at the [4$^{th}$] first at least one connecting rod member first or second end 401, 402 or the [4th] second at least one connecting rod inner bore at the [4th] second at least one connecting rod member first or second end 411, 412. A user actuates the [4$^{th}$] first first or second end extension lock 403, 404 of the [4$^{th}$] first at least one connecting rod member 400 or the [4$^{th}$] second first or second end extension lock 413, 414 of the [4$^{th}$] second at least one connecting rod member to selectively engage at least one of the plurality of annular grooves 427 to select an operational length for the [4$^{th}$] first at least one connecting rod member 400 or for the [4$^{th}$] second at least one tubular connecting rod member 410.

The [4$^{th}$] embodiment of the present invention includes a [4th] at least one cleat connector member 480 that is designed and adapted for detachable attachment to a watercraft cleat or to a dock cleat for the temporary mooring of a watercraft. Additionally, [4$^{th}$] at least one cleat connector member 480 is designed and adapted for detachable attachment to the [4th] at least one connecting rod member first end 401 or to the [4th] at least one connecting rod member second end 402 for the temporary mooring of a watercraft. The [4$^{th}$] at least one cleat connector member 480 can be used in conjunction with the [4th] at least one vacuum-handle member 440 should such a configuration be needed or desired by a user. The [4th] at least one cleat connector member 480 for the [4th] embodiment of the present invention includes a [4th] cleat assembly mount 481 and a [4th] cleat attachment line assembly 484.

The [4$^{th}$] cleat assembly mount 481 for the fourth embodiment of the present invention includes a [4$^{th}$] cleat assembly mount disk having a [4th] cleat assembly mount disk top surface and a [4th] cleat assembly mount disk bottom surface that is designed and adapted to secure a [4$^{th}$] cleat assembly mount connector rod proximate end of the [4$^{th}$] cleat assembly mount connector rod 482. The [4$^{th}$] cleat assembly mount connector rod extends longitudinally from the [4$^{th}$] cleat assembly mount disk bottom surface to a [4$^{th}$] cleat assembly mount connector rod distal end 483. The [4$^{th}$] cleat assembly mount connector rod distal end 483 being designed and adapted for detachable attachment to the [4th] first at least one connecting rod member first or second end 401, 402 or to the [4th] second at least one tubular connecting rod member first or second end 411, 412. The [4th] cleat assembly mount also includes a [4th] cleat assembly mount disk having top surface fastener aperture, a pair of longitudinal channels traversing the [4th] cleat assembly mount disk, a [4th] cleat assembly mount tension clip 489 fastened to the [4th] cleat assembly mount being designed and adapted to operatively engage the [4th] cleat attachment line 485.

The [4th] cleat attachment line assembly 484 for the fourth embodiment of the present invention is affixed to the [4th] cleat assembly mount having a [4$^{th}$] cleat attachment line 485 with a [4$^{th}$] handled first end 487, a [4$^{th}$] cleat attachment line second end 488 and defining a [4th] adjustable cleat line loop 486 that is designed and adapted for detachable attachment to a watercraft cleat or to a dock cleat. The [4th] cleat attachment line assembly further comprising a [4th] tubular cleat dampener 499 that defines a [4th] tubular cleat dampener interior and having a [4th] tubular cleat dampener bottom fastened to the [4th] cleat assembly mount disk top surface.

Now referring to FIG. 68, the fourth embodiment of the present invention includes a [$4^{th}$] safety device 490 that is designed and adapted to be detachably tethered to the [$4^{th}$] at least one connecting rod member 400 and suspend vertically downward towards and near a water's surface to provide a visual warning to swimmers and/or others that may be in close proximity of watercraft temporarily moored with the present invention.

The [$4^{th}$] safety device 490 comprises an inflatable spherical rubber device having at least a 10 inch diameter and manufactured in a high visibility color to properly convey a warning. The tether for detachably attaching the [4th] safety device to the [4th] at least one connecting rod member 400 may be manufactured from a hook and loop material to provide a simple and quick mechanism for detachable attachment to the [$4^{th}$] at least one connecting rod member 400. The safety device may also be manufactured from polyethylene foam or such other lightweight materials. An additional aspect of an inflatable [4th] safety device or one manufactured from polyethylene foam is the buoyancy characteristic of such materials. In the event the present invention is dropped or falls into a body water, the buoyancy of such materials such may prevent the sinking and/or subsequent loss of the present invention under such circumstances.

The fourth embodiment of the present invention is design specific for watercraft of 30 feet less. However, depending on watercraft size and same as well as environmental conditions, the present may possibly be used on watercraft of greater than 30 feet in length. The present invention may be mounted in multiple configurations of 360 degrees. The present invention can be made out of plastic, aluminum, stainless steel such that it is corrosion and UV resistant. The connecting rod member utilizes a quick-release connector for adjusting its operational length. Each vacuum handle member includes vacuum cups that are able to pivot multiple directions and operate independently from each other. The design and configuration of the present invention supports it use on uneven surfaces when being mounted to watercraft. The vacuum handle member handle mount has internal vacuum channels and utilizes are 3-in-1 button system. From the thumb plunger vacuum assembly a vacuum channel goes directly to the suction cups. There are seals within the individual vacuum channels that direct the flow of the vacuum and its maintenance. The thumb plunger vacuum assembly is also a vacuum indicator. Its vacuum channel that is in direct communication with the vacuum cups allows the thumb plunger to rise as vacuum dissipates in the suction cups. The vacuum channel also goes directly from the spherical joint continuous vacuum assembly is in direct communication with the vacuum cups for providing continuous vacuum. All the vacuum channels are connected one another and can operate independently. The thumb plunger vacuum assembly also serves as release valve utilizing the same vacuum channels to the suction cups. The counter displacement mechanism for the fourth embodiment of the present invention support 360 degrees of movement. The vacuum handle member can be removed for installation of the cleat connector member utilizing the same connecting rod member which allows for multiple configurations of the present invention. A safety device attaches to the connecting rod member and thus serves as a visual warning aid with respect to no swimming zone and the like.

Benefits of the present invention are generally the same for each of the disclosed embodiments 1, 2, 3, and 4. The present invention provides a simple innovative manner for bringing various kinds of boats and personal watercrafts together. The present invention eliminates the complications of using fenders and ropes when mooring one watercraft to another watercraft. The present invention is both simple to install and to remove. The safety/buoyancy device. Serves as a visual aid identifying no swim zone between watercrafts. This helps reduce personal injury.

Figure 5A:
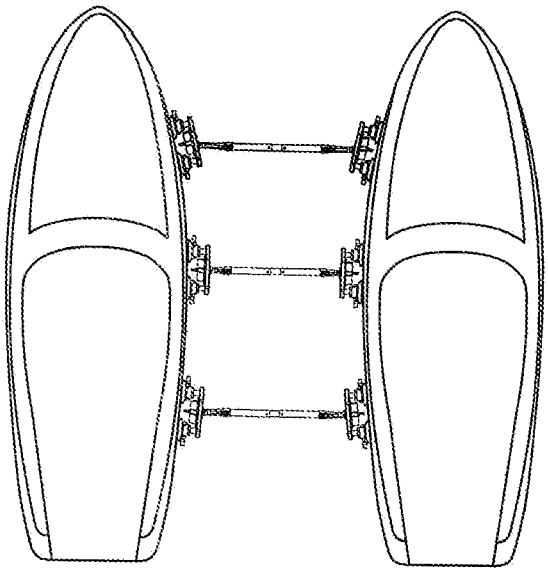
FIG. 5A is a top plan view of one configuration for one embodiment of the present invention.
Figure 5B:
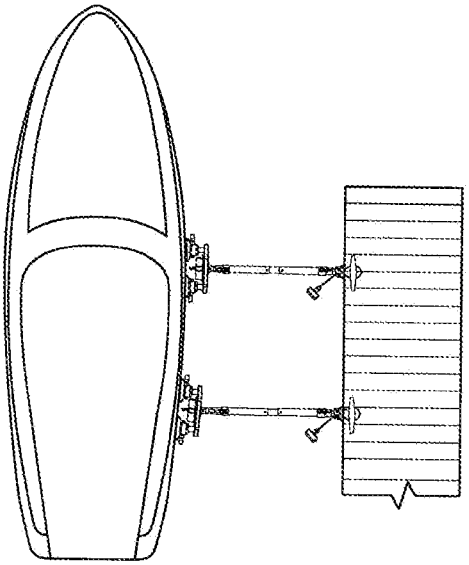
FIG. 5B is a top plan view of an alternative configuration for one embodiment of the present invention.
Figure 5C:
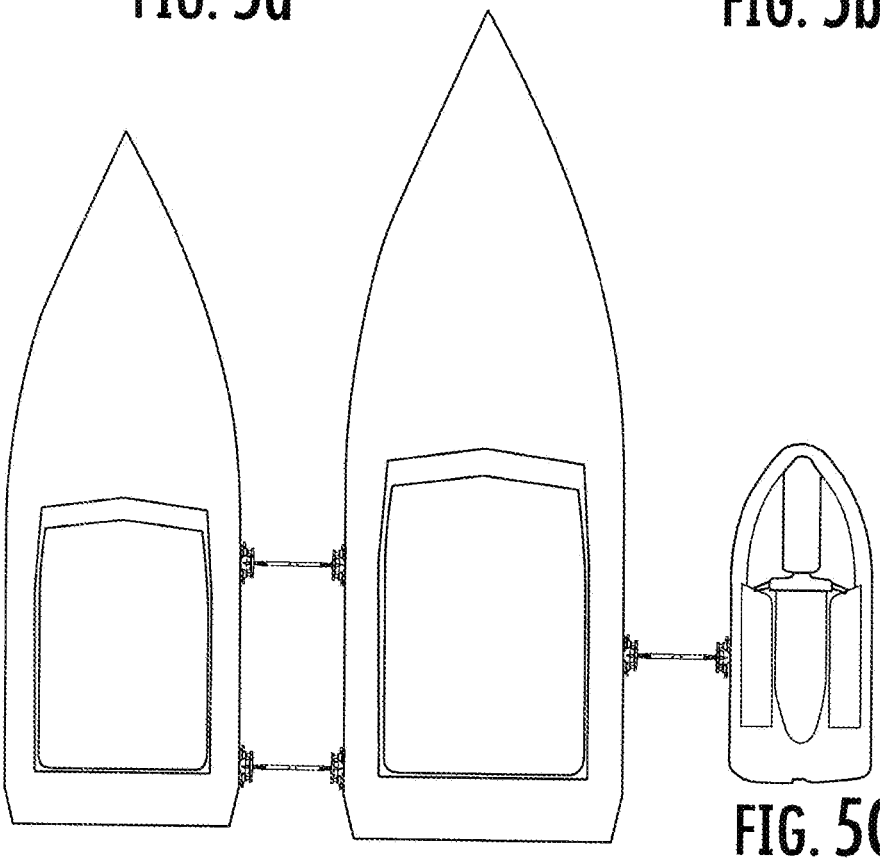
FIG. 5C is a top plan view of an alternative configuration for one embodiment of the present invention.
Figure 6:
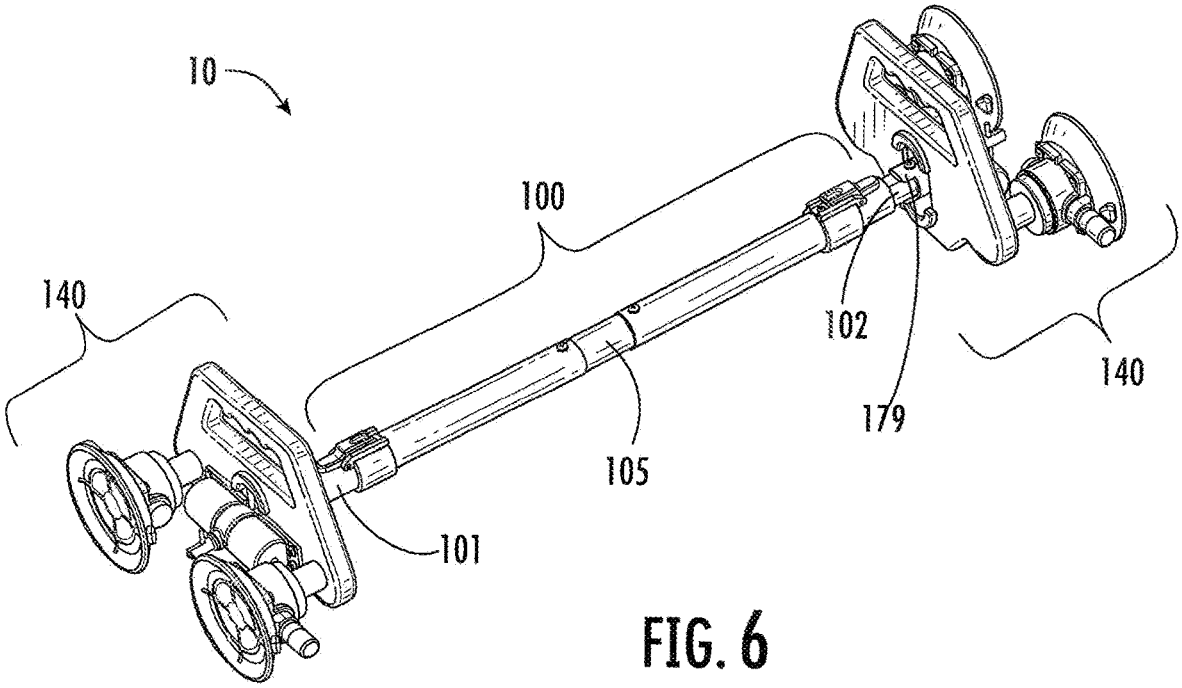
FIG. 6 is a perspective view for one embodiment of the present invention.
Figure 7:
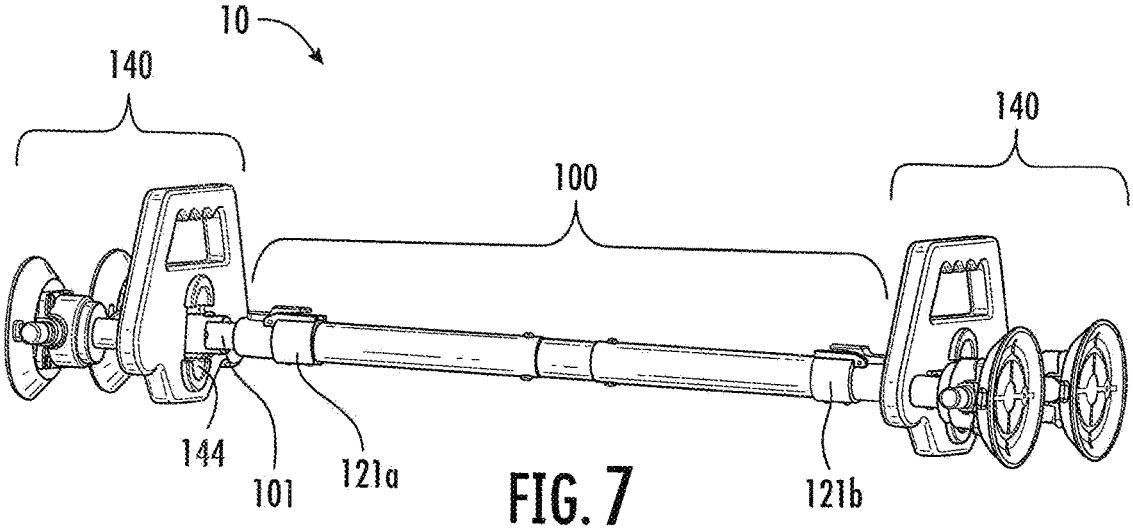
FIG. 7 is a lateral perspective view of the invention embodiment illustrated in FIG. 6.
Figure 8:
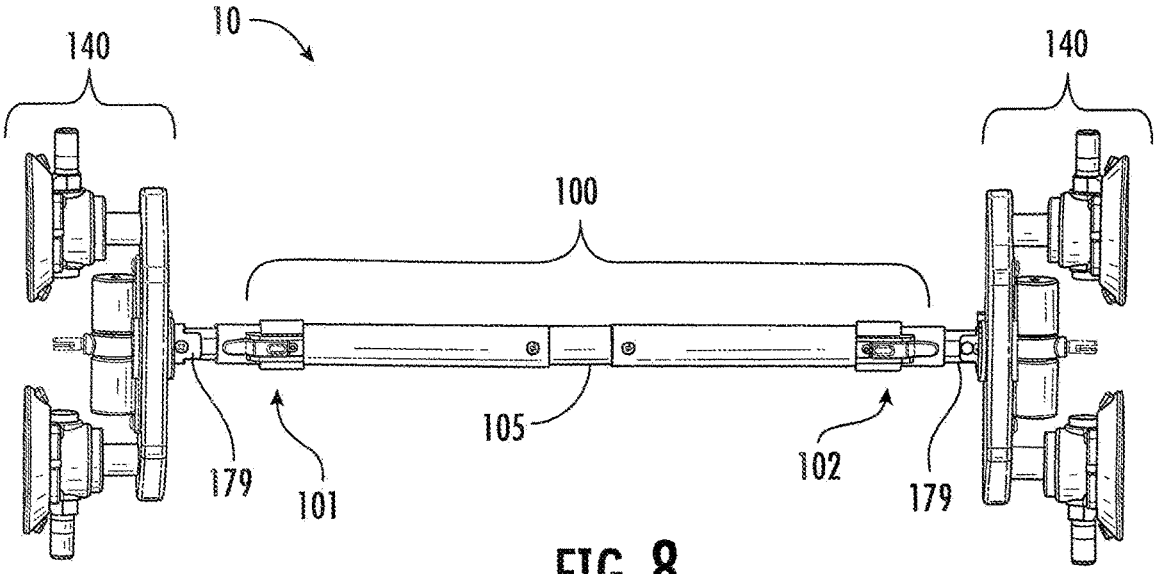
FIG. 8 is a top plan view of the invention embodiment illustrated in FIG. 6.
Figure 9:
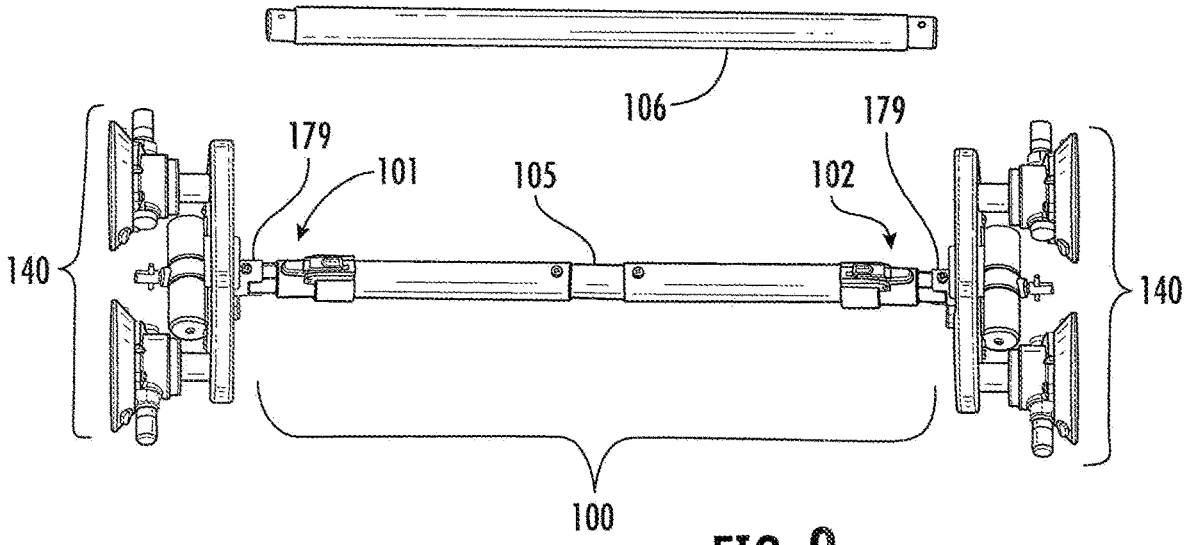
FIG. 9 is an upper perspective view for one embodiment of the present invention shown with a coupler extension.
Figure 10A:
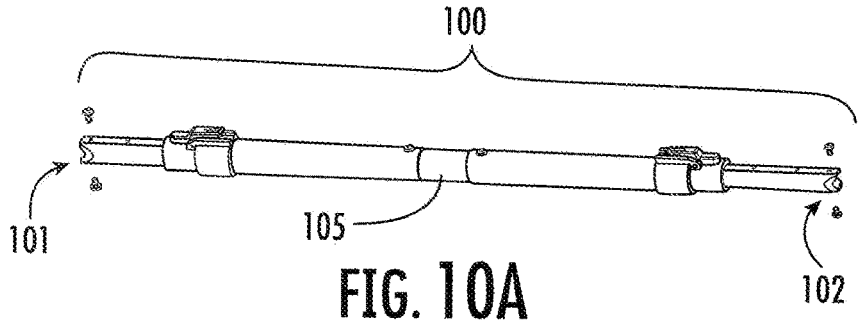
FIG. 10A is a lateral view of a connecting rod member for one embodiment of the present invention.
Figure 10B:
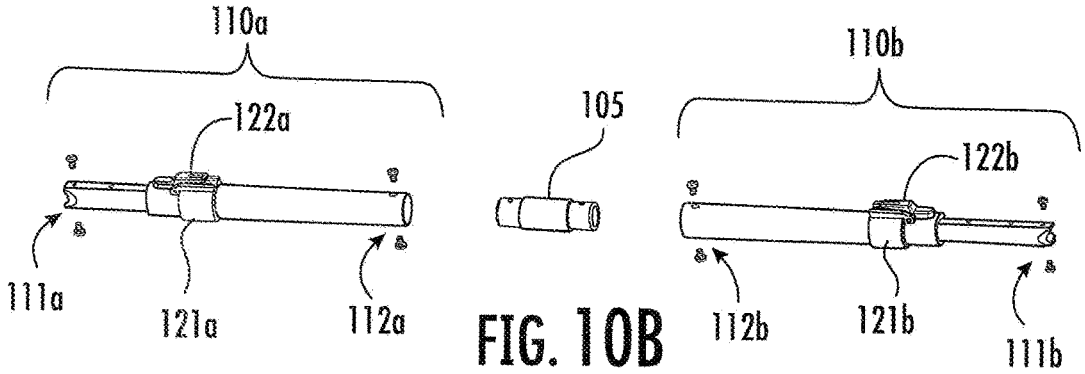
FIG. 10B is an exploded lateral view of the connecting rod member illustrated in FIG. 10A.
Figure 10C:
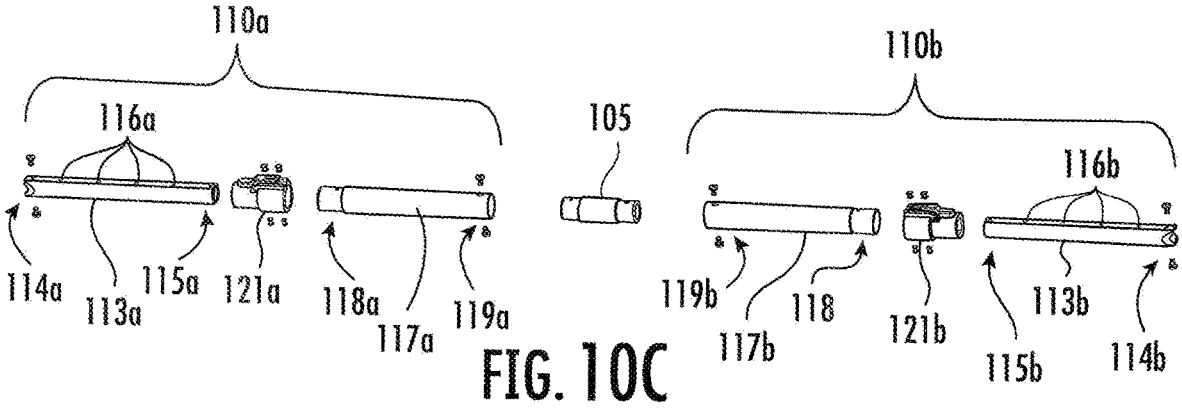
FIG. 10C is an exploded lateral view of the connecting rod member illustrated in FIG. 10B.
Figure 11:
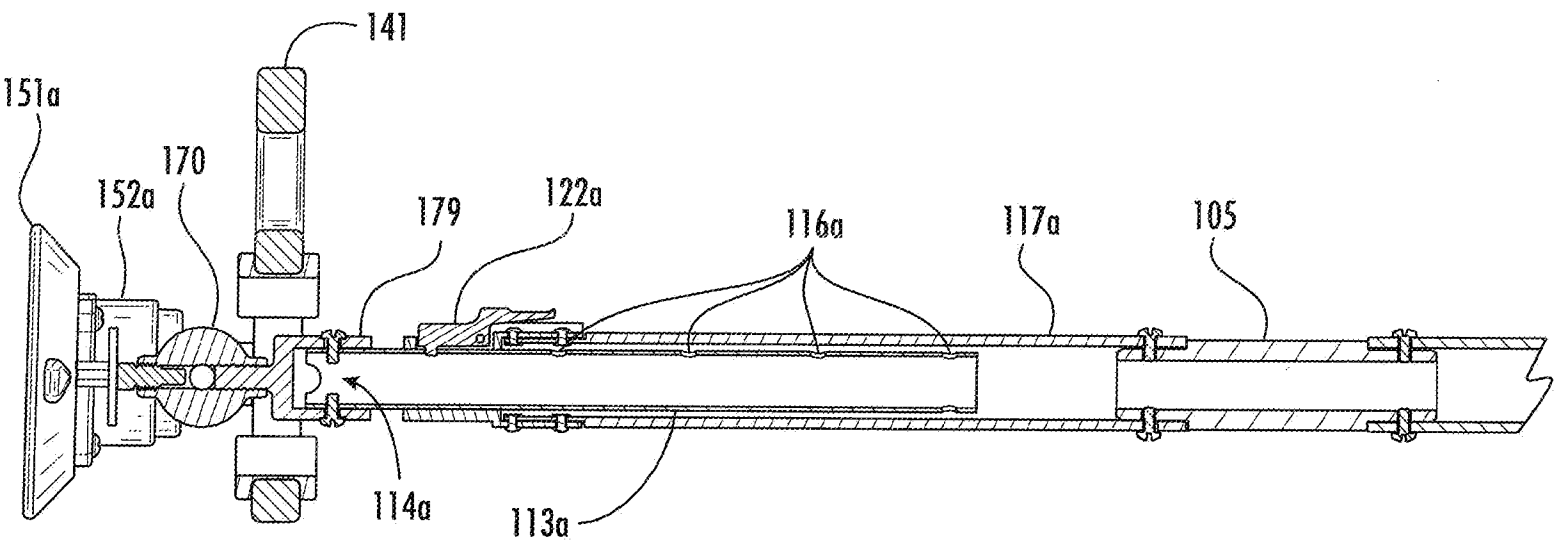
FIG. 11 is a longitudinal cross-sectional view of a telescopic member for one embodiment of the present invention.
Figure 12:
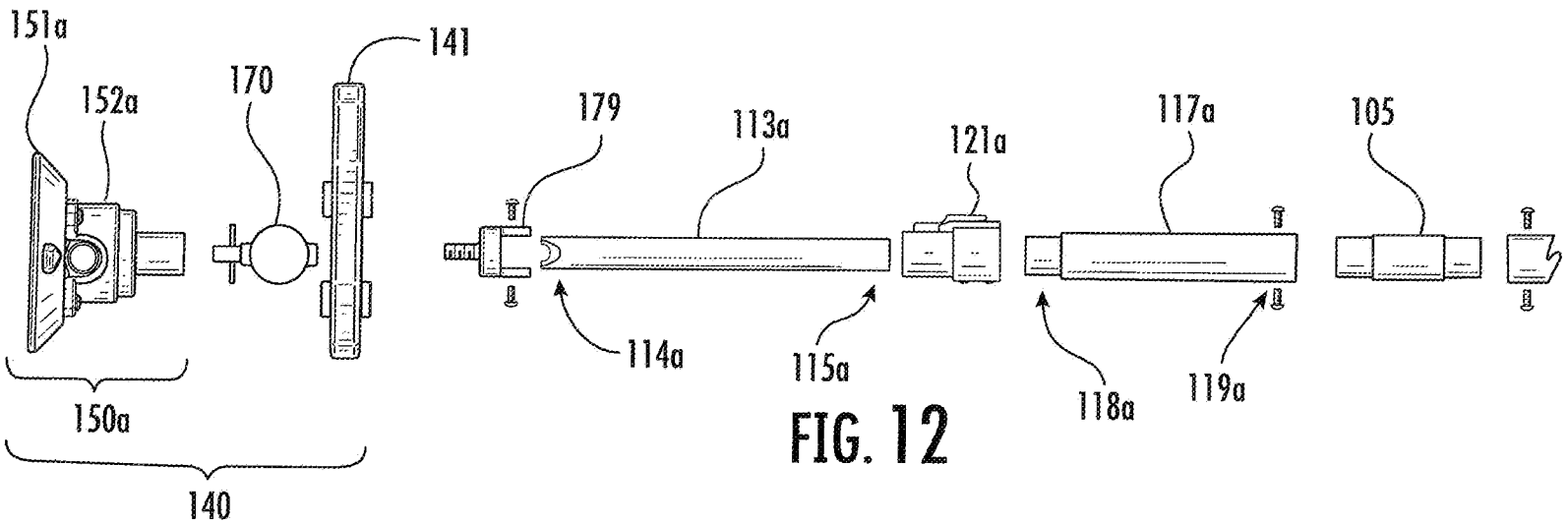
FIG. 12 is an exploded lateral view of the invention embodiment illustrated in FIG. 11.
Figure 13:
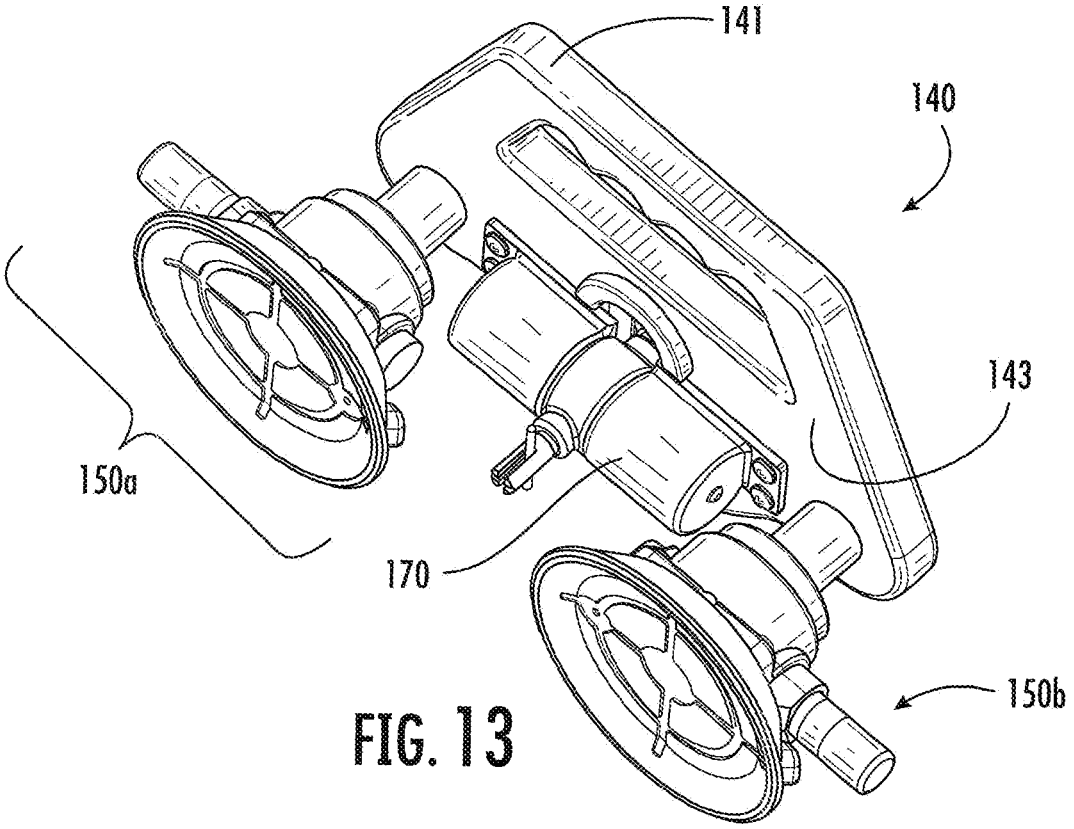
FIG. 13 is a top perspective view of a vacuum handle member for one embodiment of the present invention.
Figure 14:
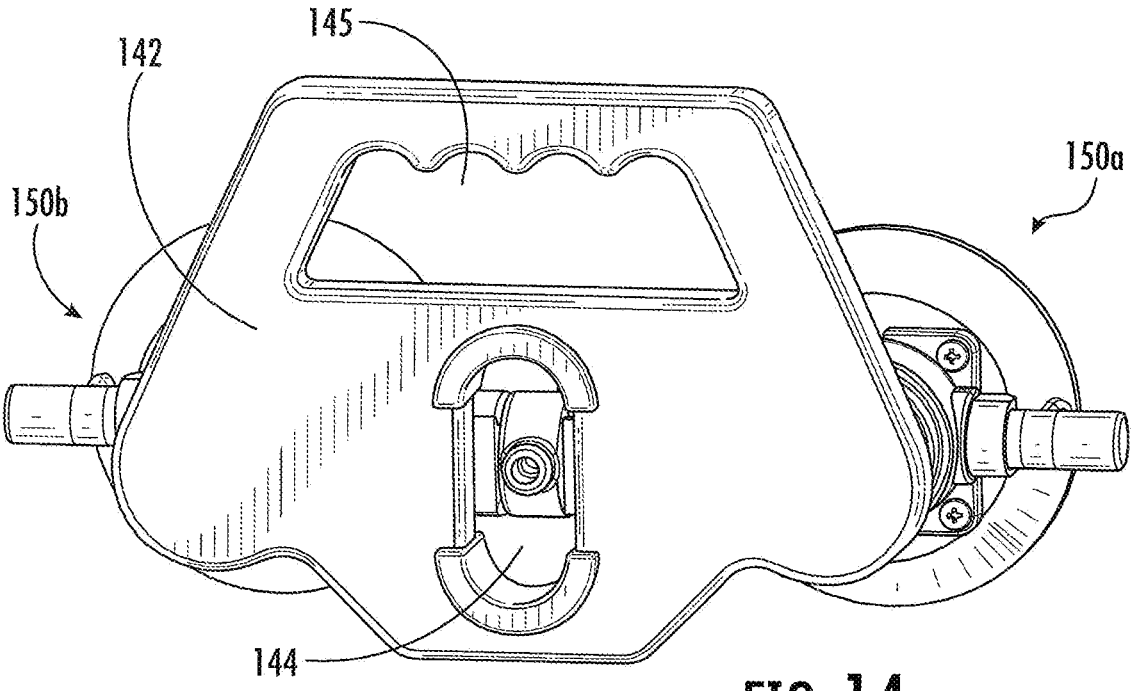
FIG. 14 is an inner surface view of a vacuum handle member for one embodiment of the present invention.
Figure 15:
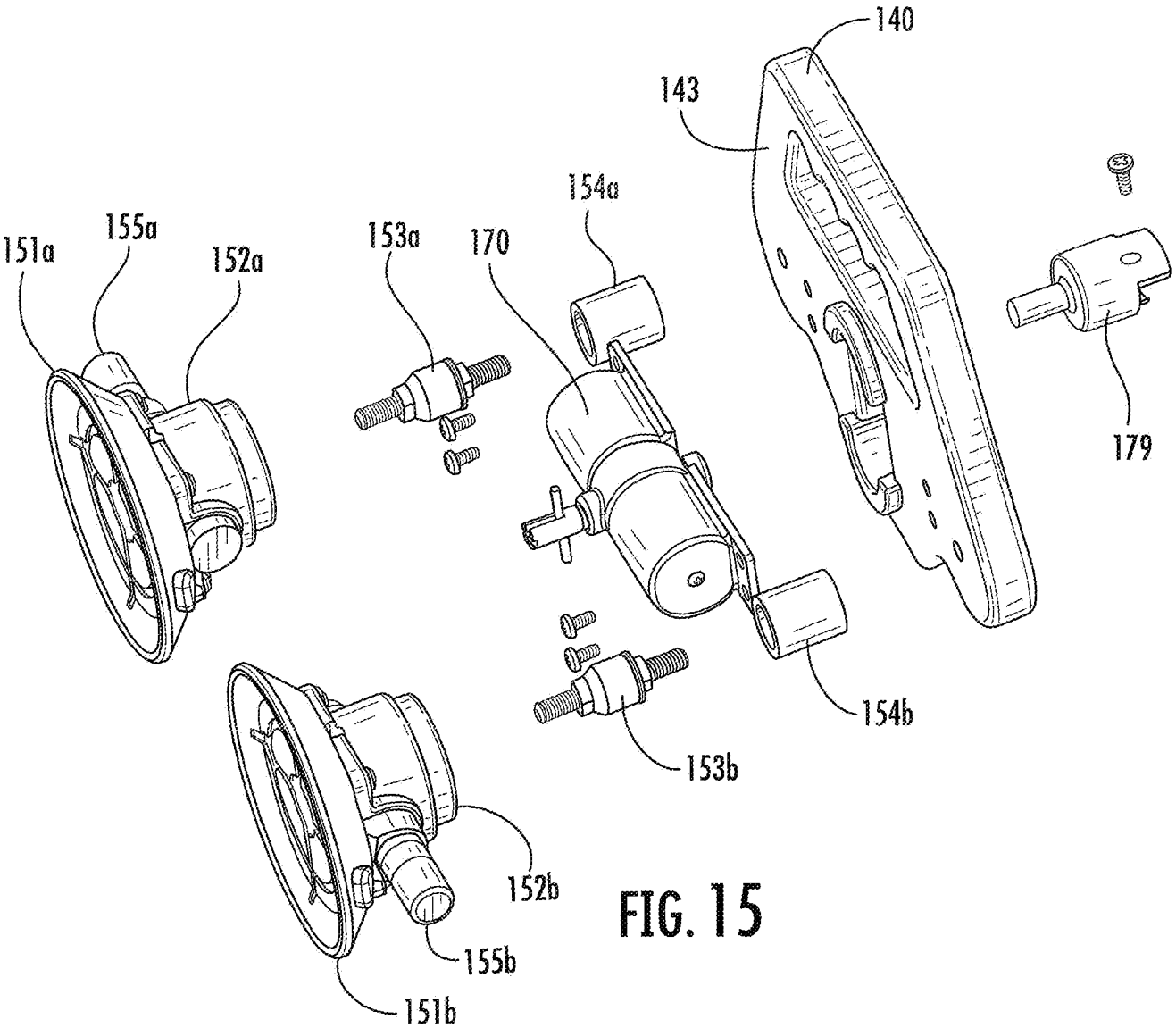
FIG. 15 is an exploded view of a vacuum handle member for one embodiment of the present invention.
Figure 16:
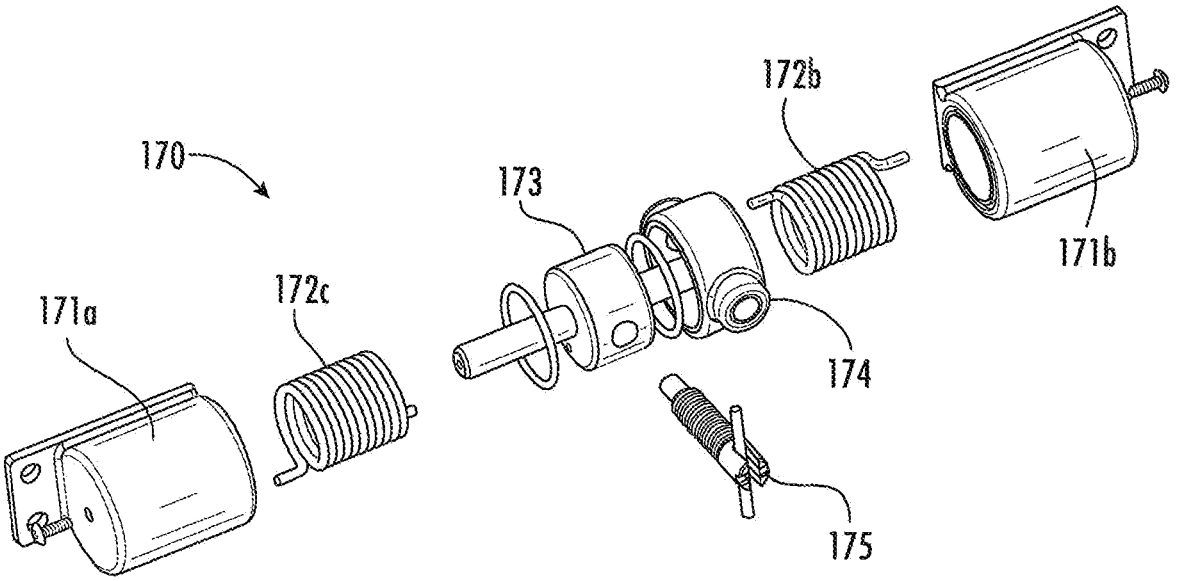
FIG. 16 is an exploded view of a torsion spring assembly for one embodiment of the present invention.
Figure 17:
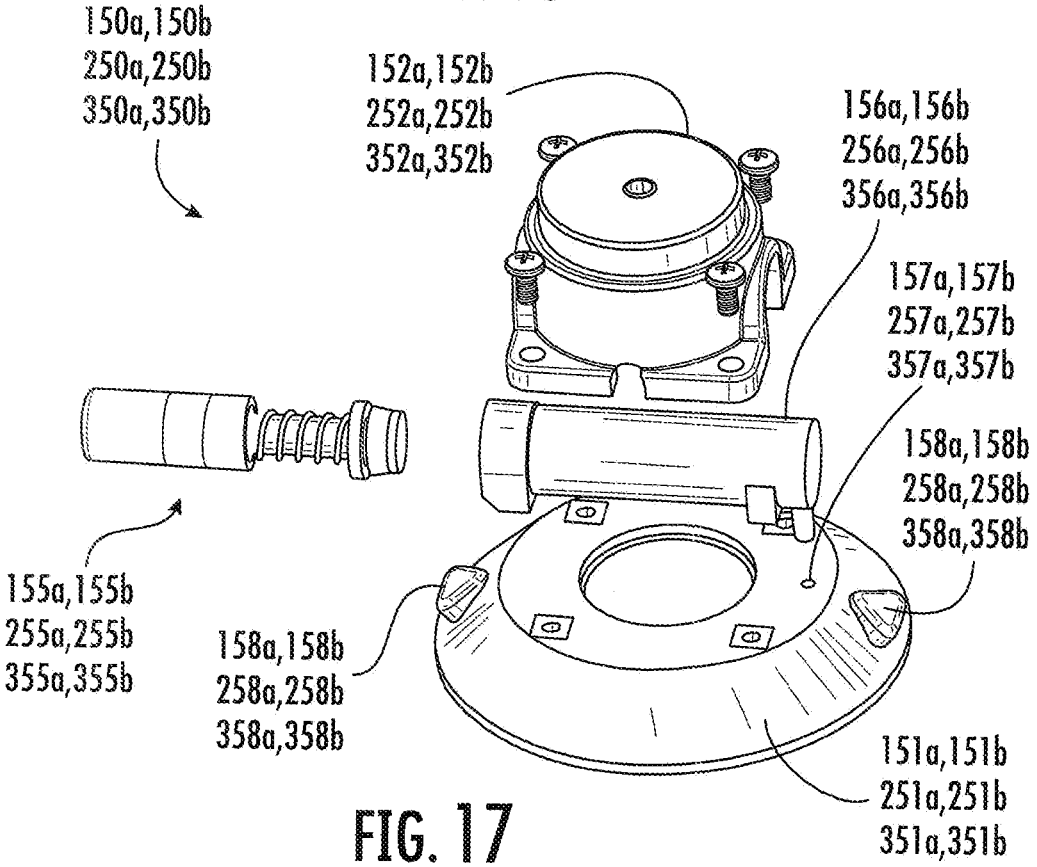
FIG. 17 is an exploded view of a vacuum cup assembly for one embodiment of the present invention.
Figure 18:
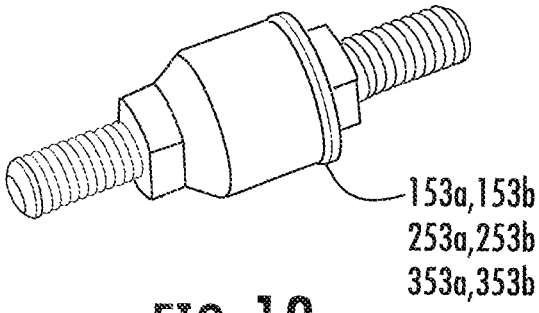
FIG. 18 is a perspective view of a ball joint for one embodiment of the present invention.
Figure 19:
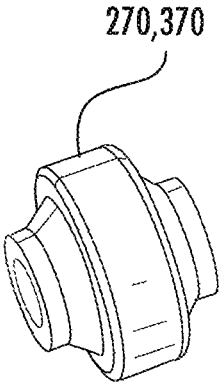
FIG. 19 is perspective view of a handle mount spherical joint for one embodiment of the present invention.
Figure 20:
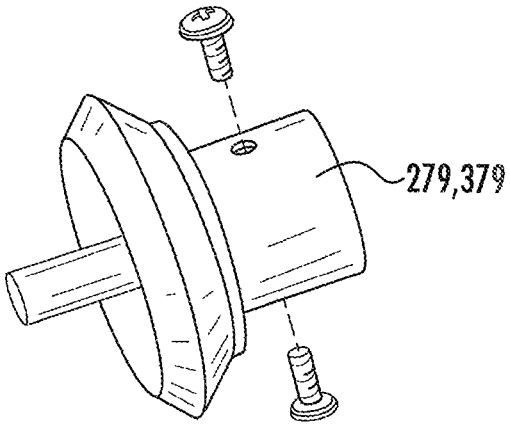
FIG. 20 is a perspective view of a spherical joint connector for one embodiment of the present invention.
Figure 21:
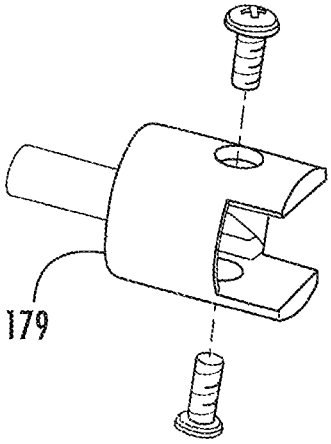
FIG. 21 is a perspective view of a swivel joint for one embodiment of the present invention.
Figure 22:
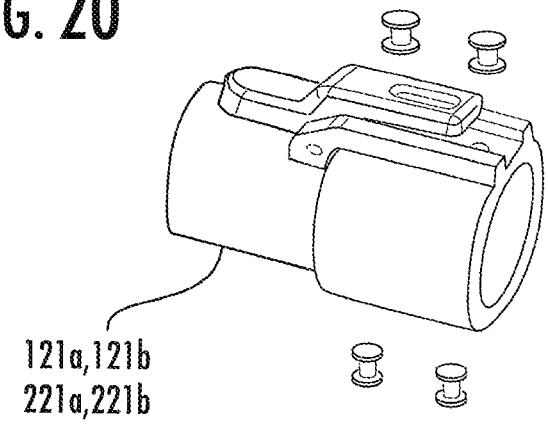
FIG. 22 is a perspective view of a tubular extension lock for one embodiment of the present invention.
Figure 23:
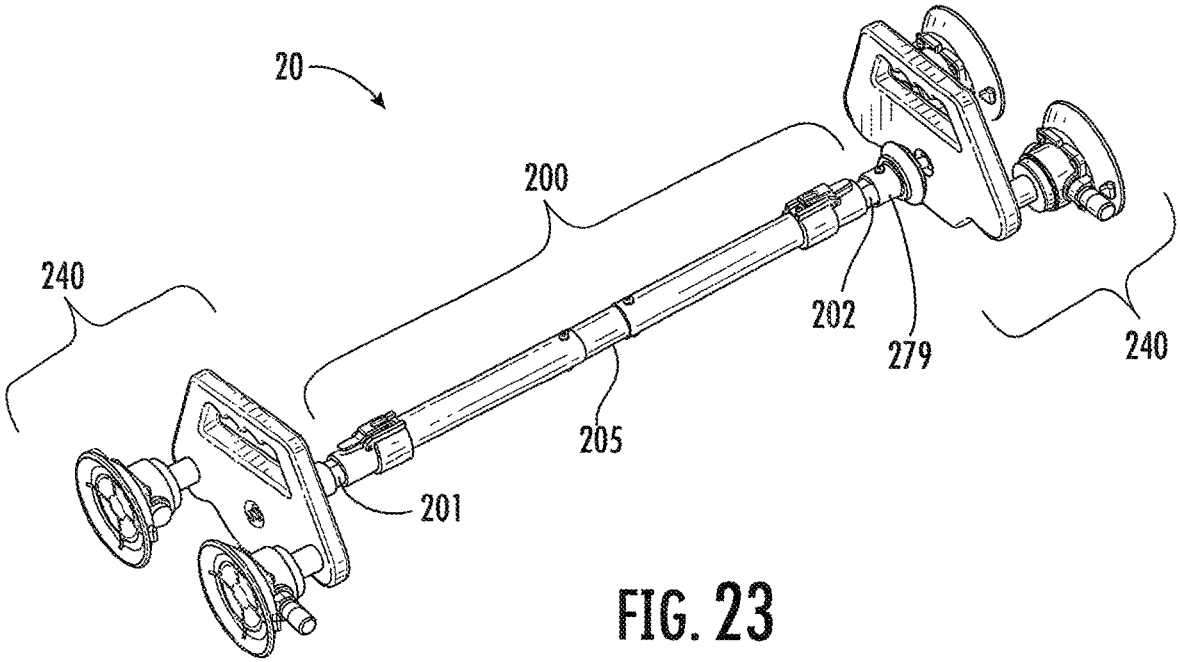
FIG. 23 is a perspective view for one embodiment of the present invention.
Figure 24:
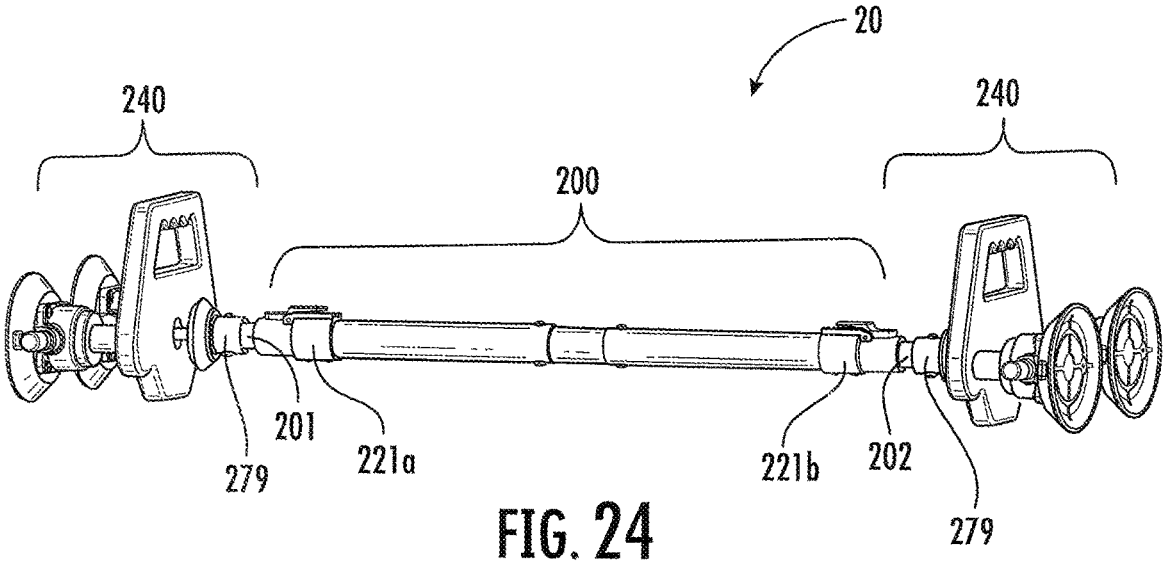
FIG. 24 is a lateral perspective view of the invention embodiment illustrated in FIG. 23.
Figure 25:
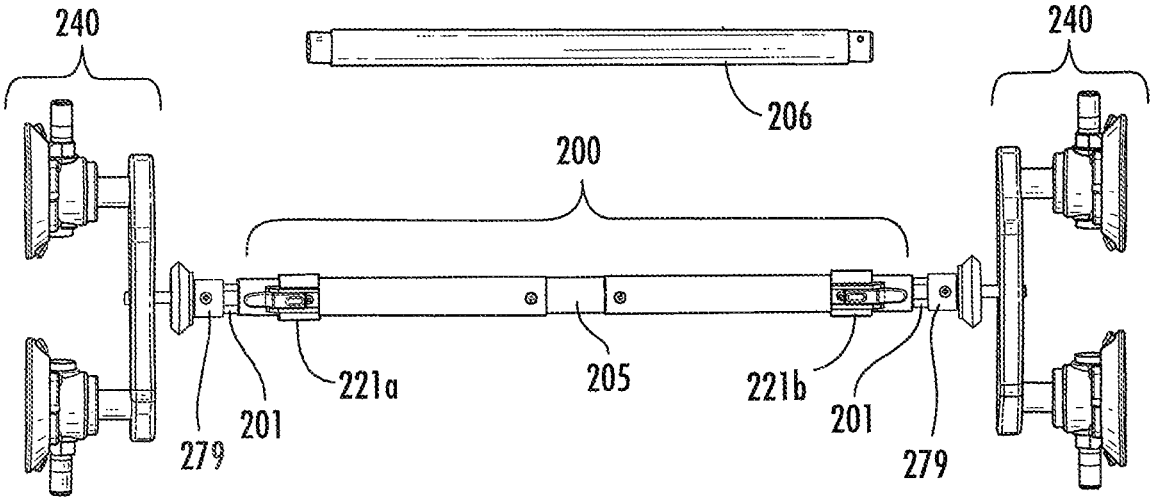
FIG. 25 is a top plan view for one embodiment of the present invention shown with a coupler extension.
Figure 26:
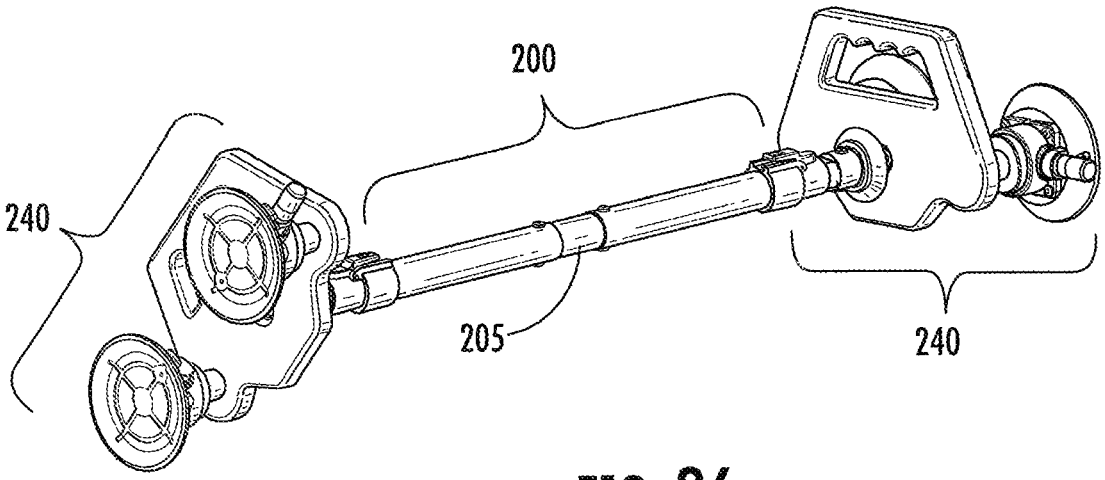
FIG. 26 is a perspective view for one embodiment of the present invention illustrating the rotational ability of a vacuum handle member.
Figure 27A:
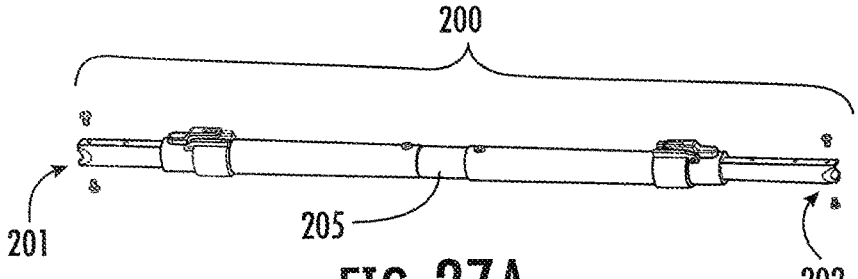
FIG. 27A is a lateral view of a connecting rod member for one embodiment of the present invention.
Figure 27B:
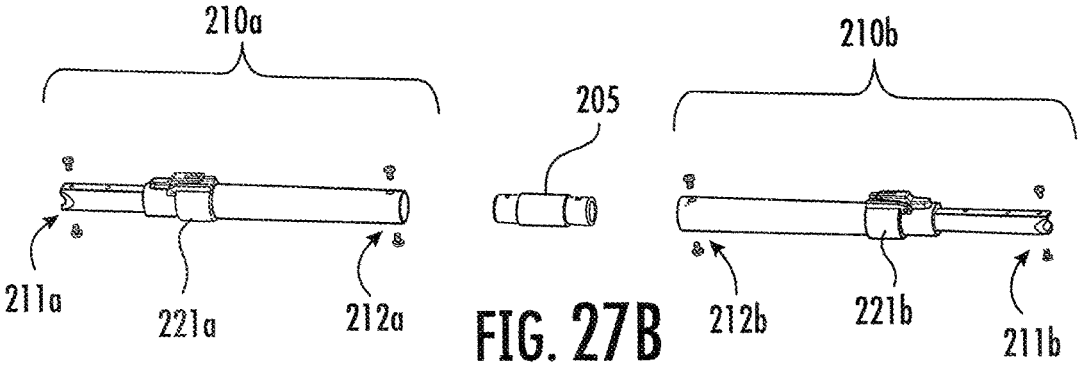
FIG. 27B is an exploded lateral view of the connecting rod member illustrated in FIG. 27A.
Figure 27C:
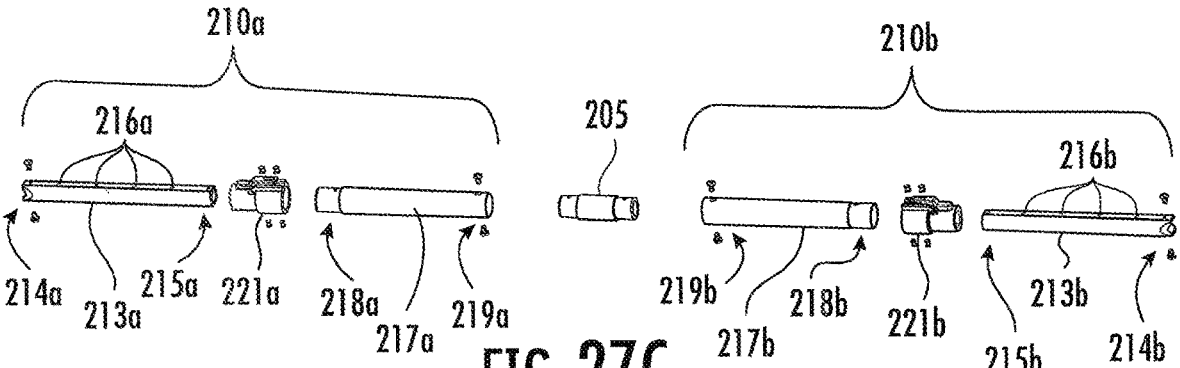
FIG. 27C is an exploded lateral view of the connecting rod member illustrated in FIG. 27B.
Figure 28:
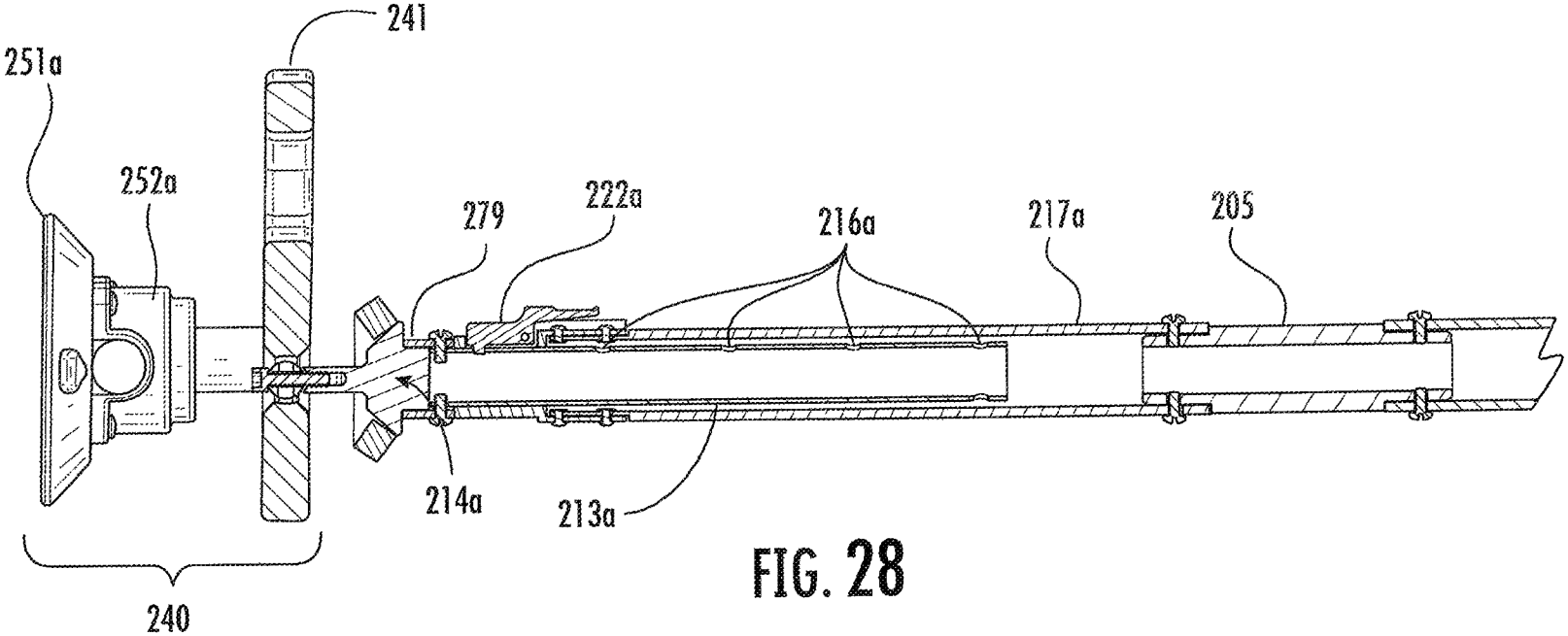
FIG. 28 is an cross sectional lateral view of a telescopic member for one embodiment of the invention.
Figure 29:
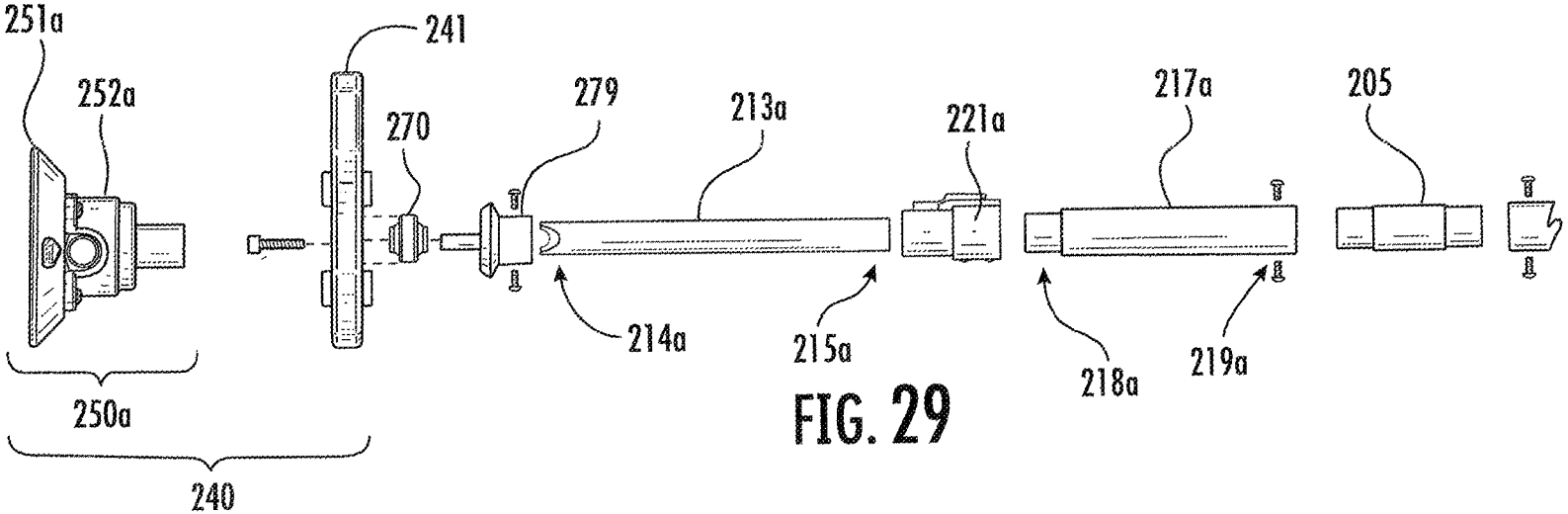
FIG. 29 is an exploded lateral view of a telescopic member for one embodiment of the present invention.
Figure 30:
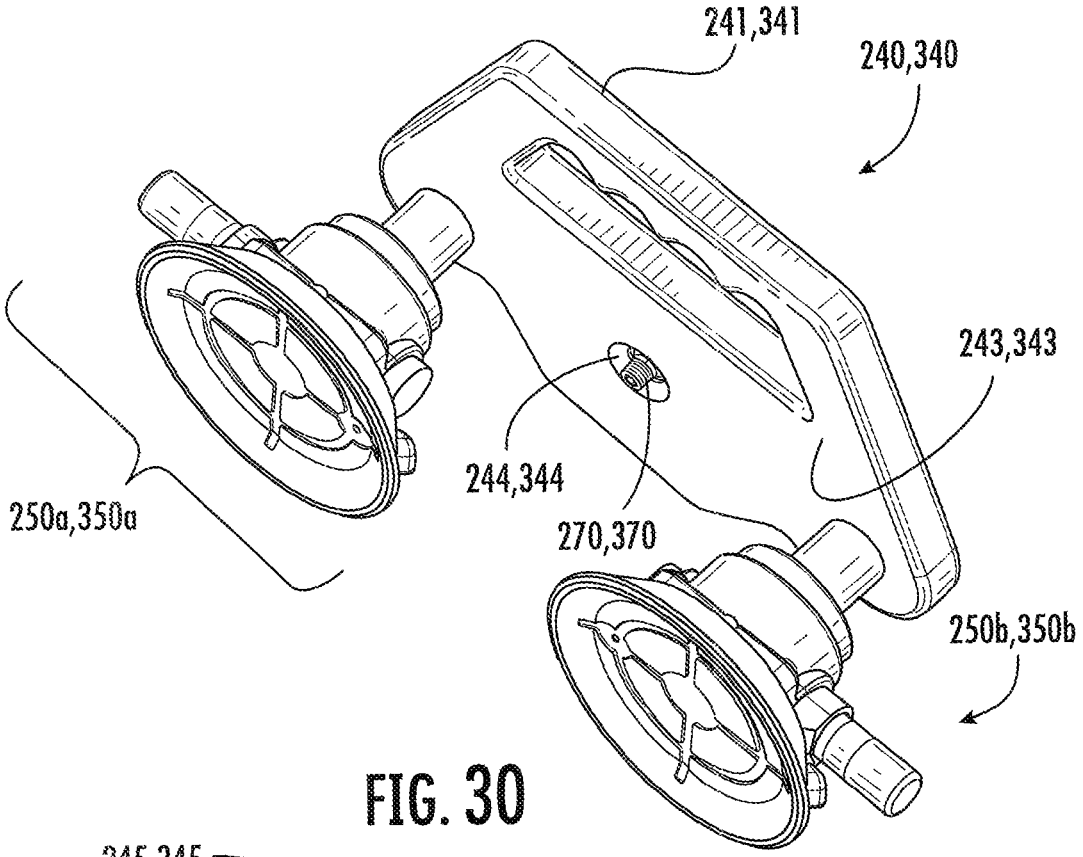
FIG. 30 is a perspective view of a vacuum handle member for one embodiment of the present invention.
Figure 31:
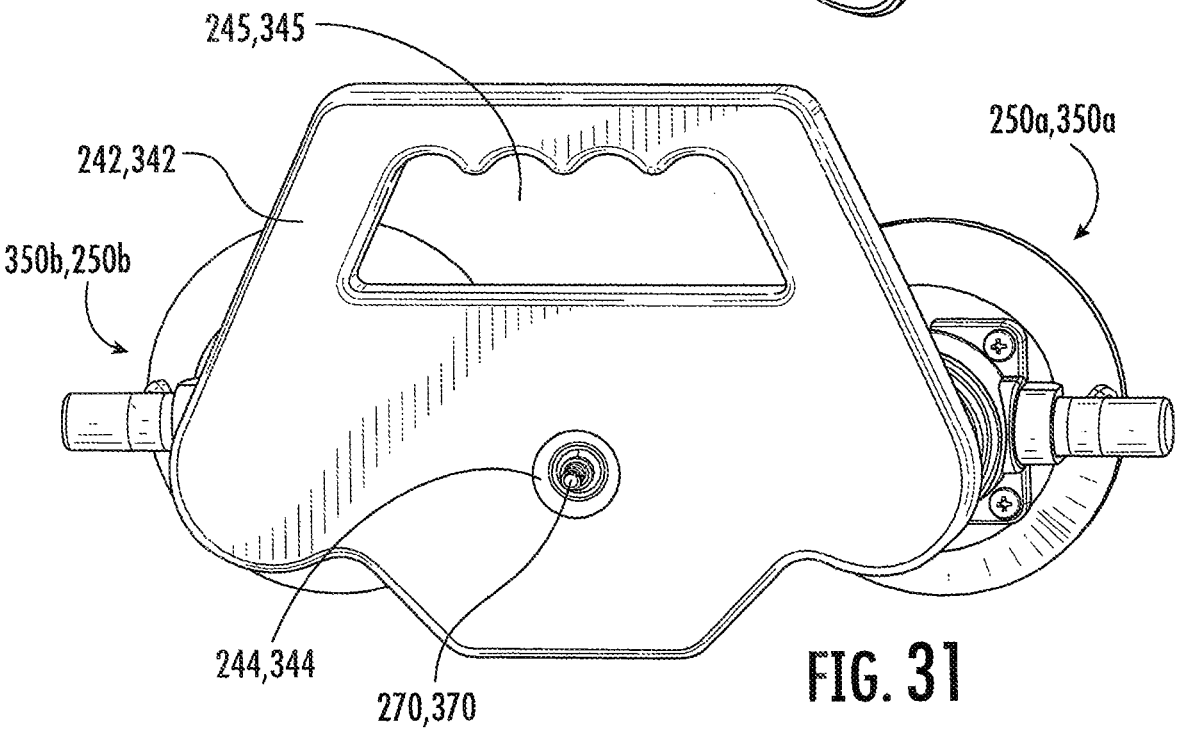
FIG. 31 is an inner surface view of a vacuum handle member for one embodiment of the present invention.
Figure 32:
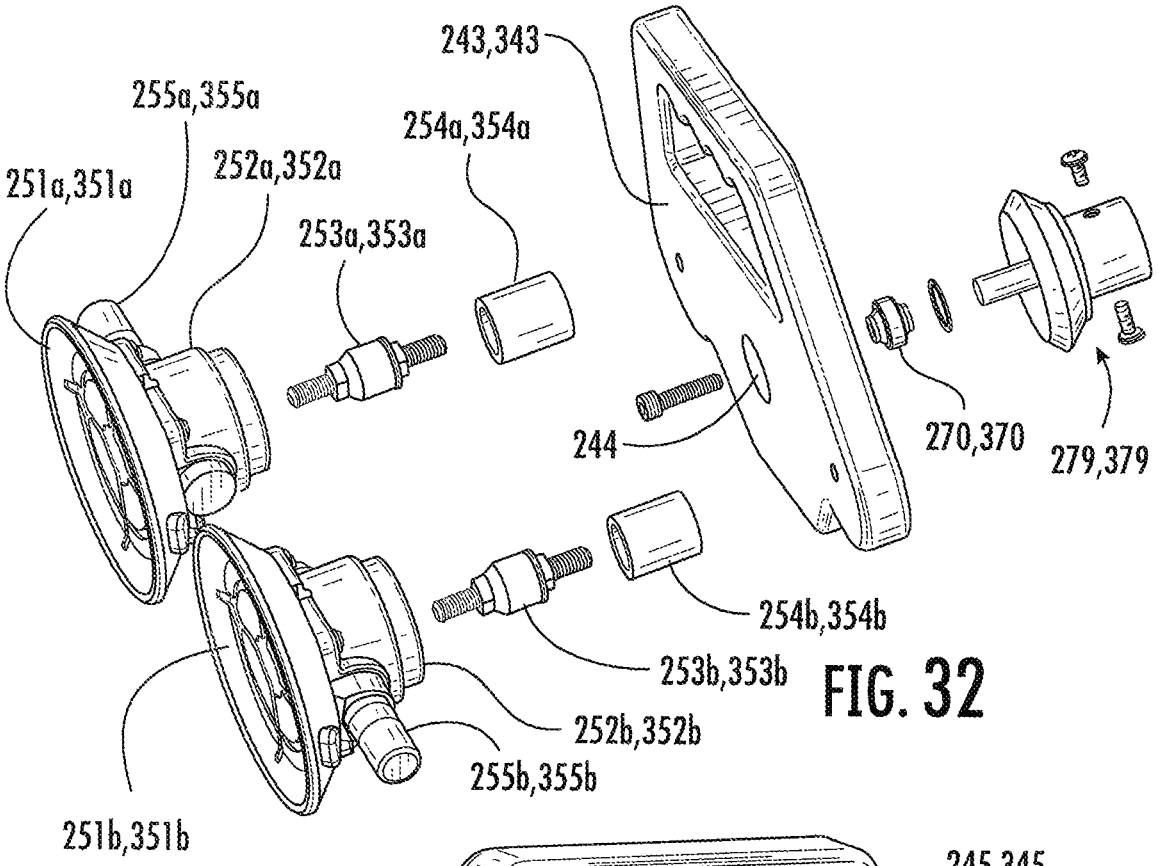
FIG. 32 is an exploded perspective view of a vacuum handle member for one embodiment of the present invention.
Figure 33:
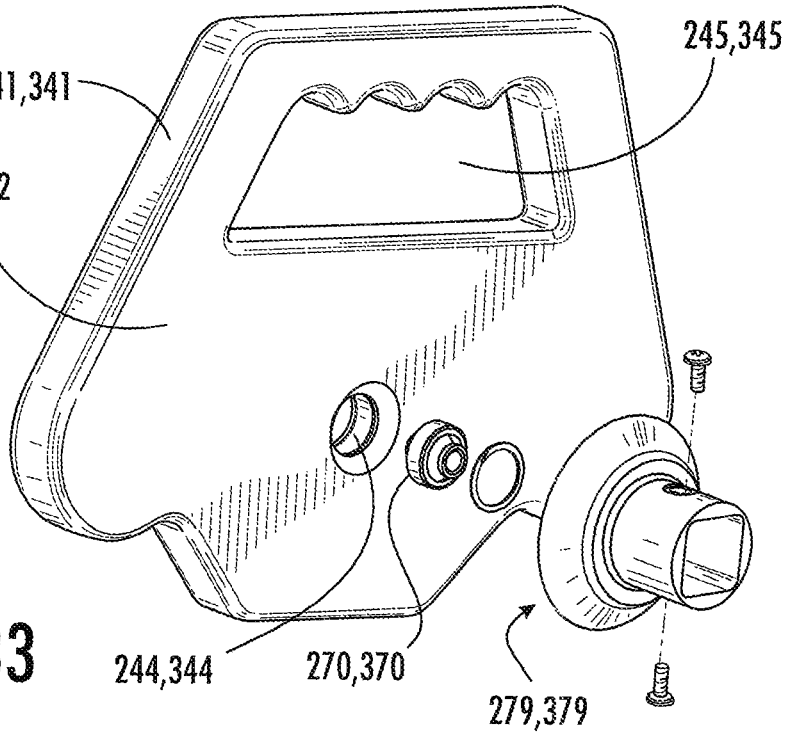
FIG. 33 is an exploded inner surface perspective view of a vacuum handle member for one embodiment of the present invention.
Figure 34:
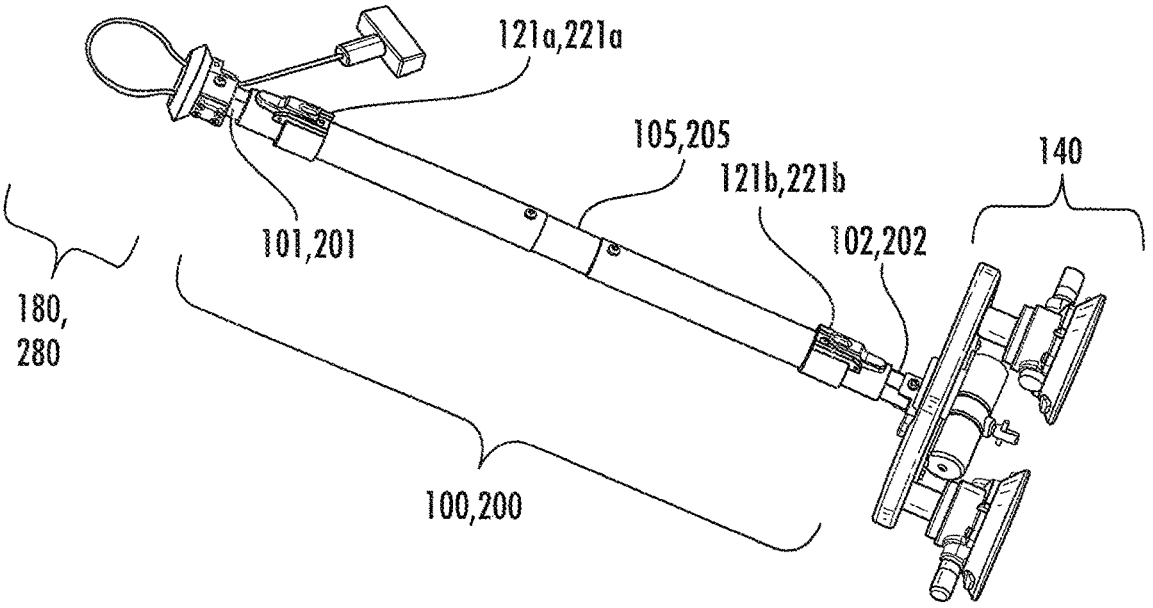
FIG. 34 is a perspective view for one embodiment of the present invention illustrating a cleat connector member and a vacuum handle member attached to a connecting rod member.
Figure 35:
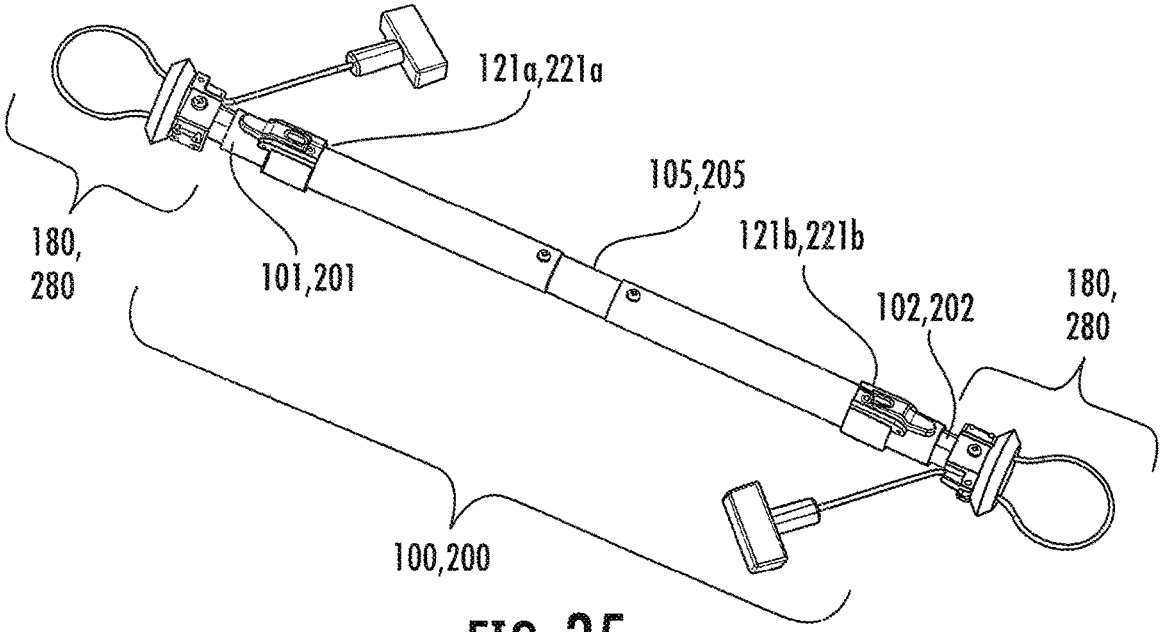
FIG. 35 is a perspective view for one embodiment of the present invention illustrating two cleat connector members attached to a connecting rod member.
Figure 36:
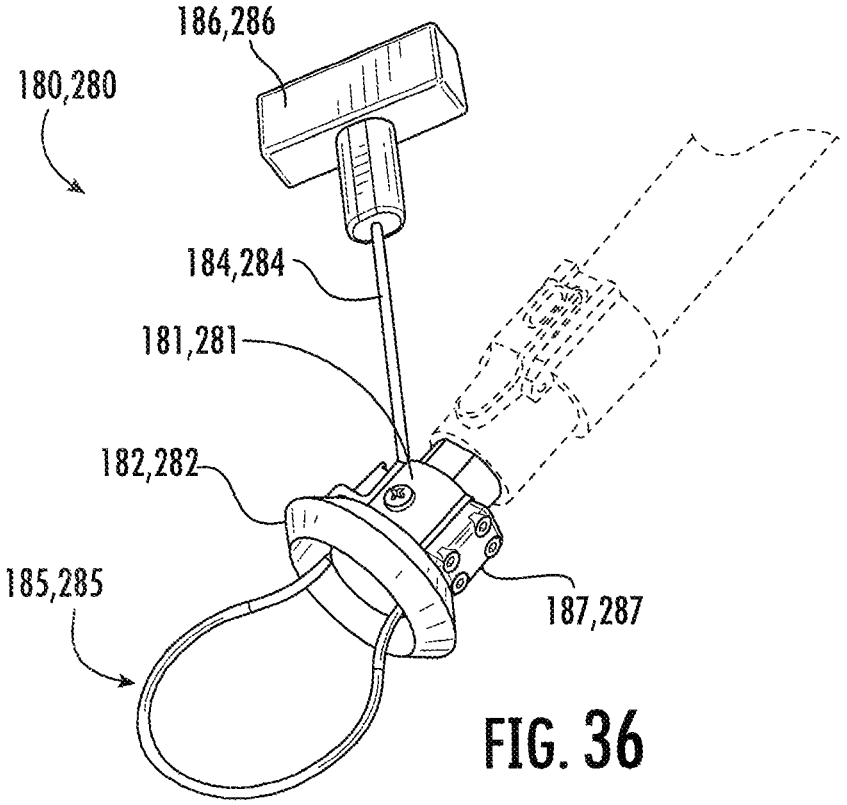
FIG. 36 is a perspective view of a cleat connector member for one embodiment of the present invention.
Figure 37:
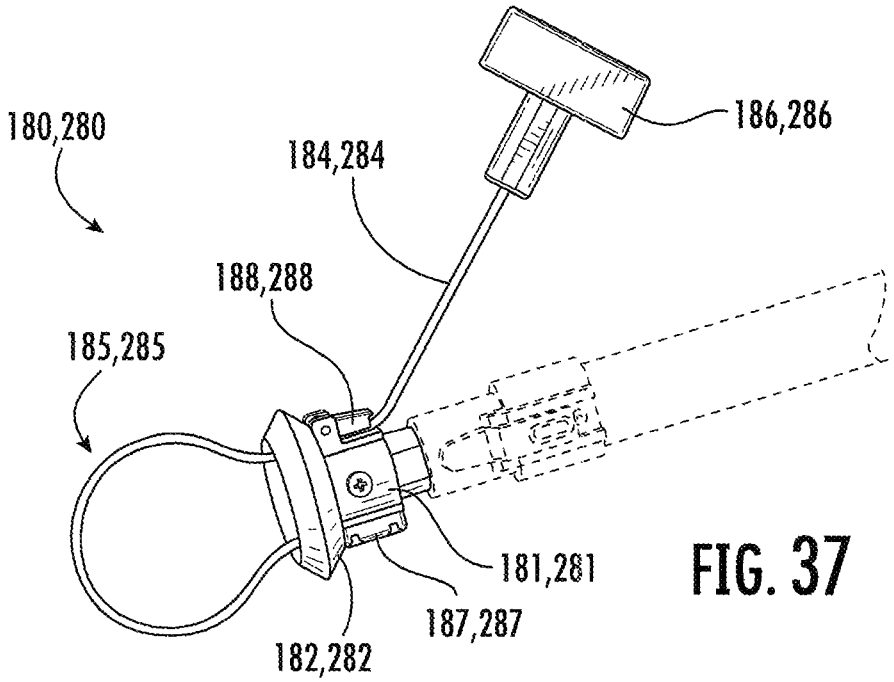
FIG. 37 is a lateral perspective view of a cleat connector member for one embodiment of the present invention.
Figure 38:
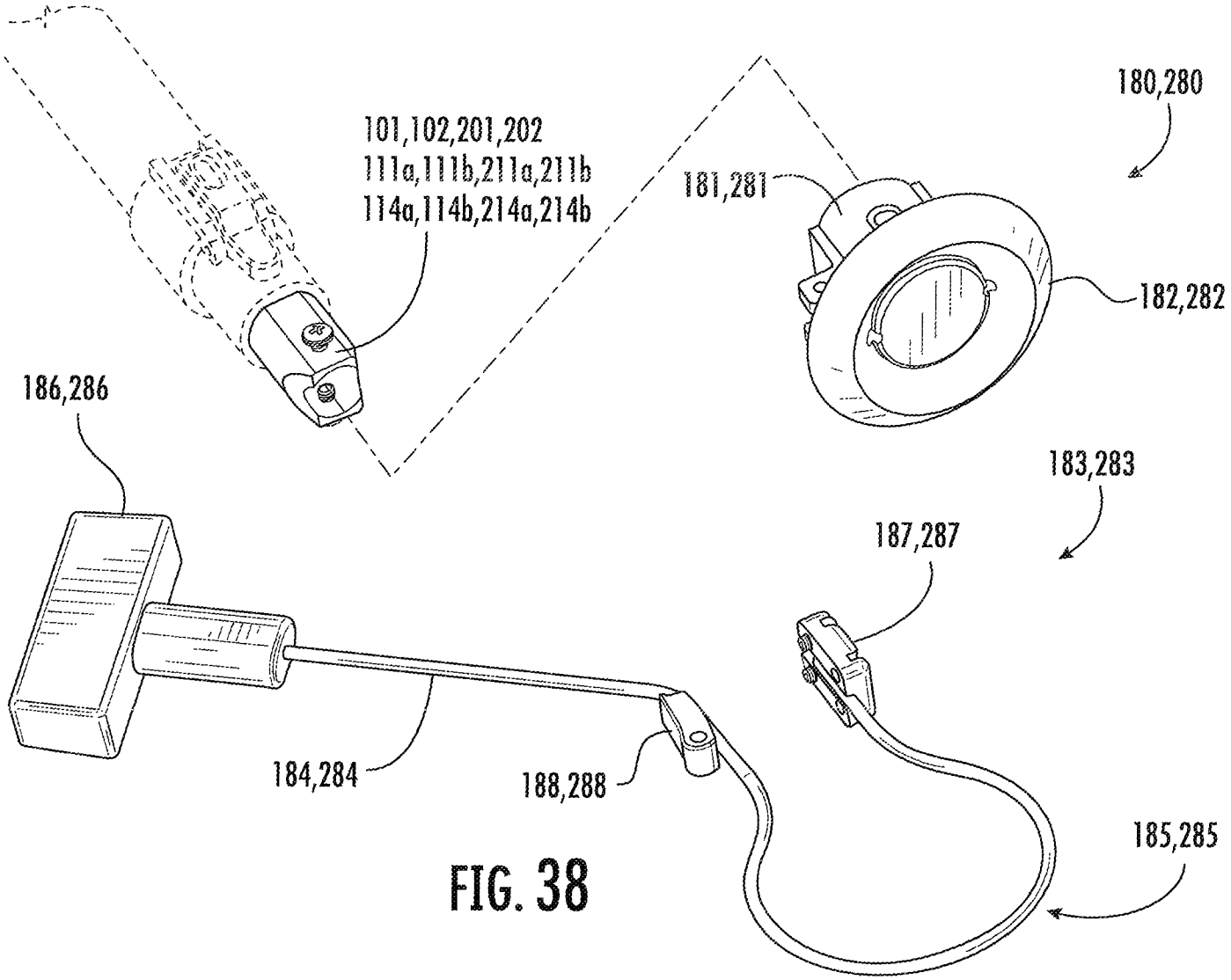
FIG. 38 is an exploded view of a cleat connector member for one embodiment of the present invention.
Figure 39:
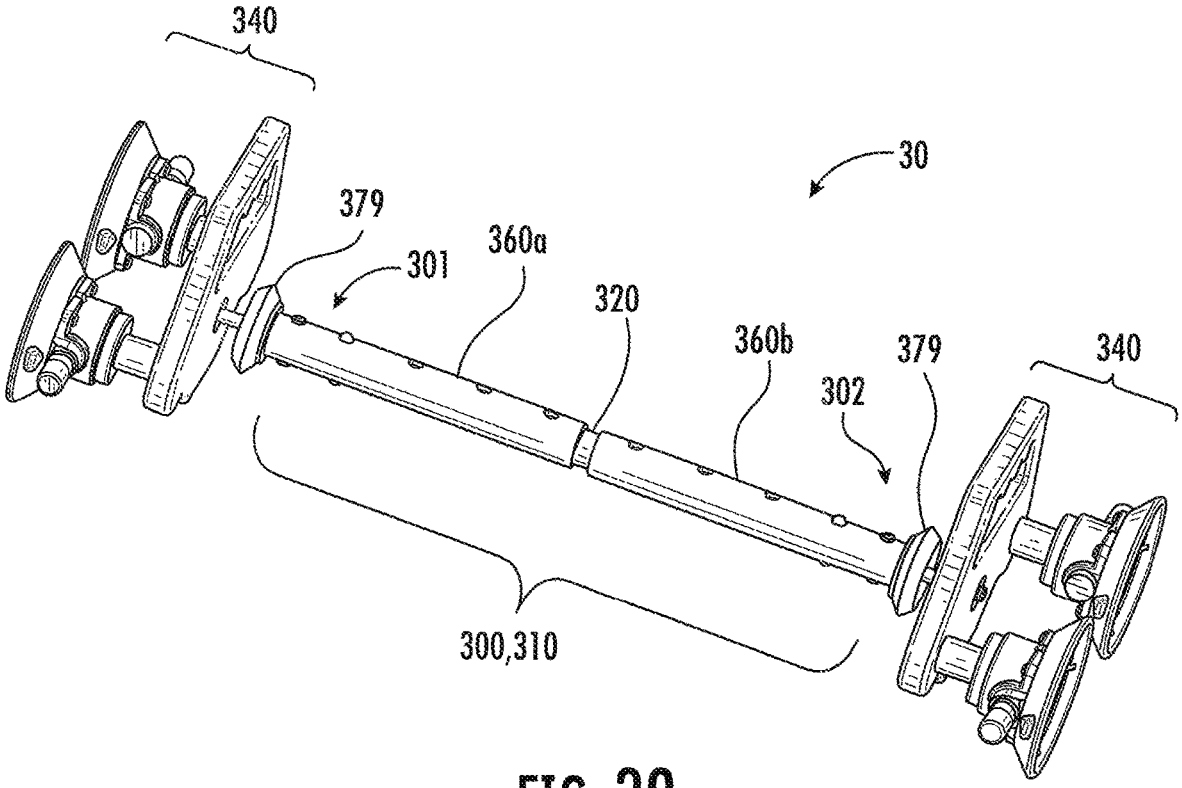
FIG. 39 is a perspective view for one embodiment of the present invention.
Figure 40:
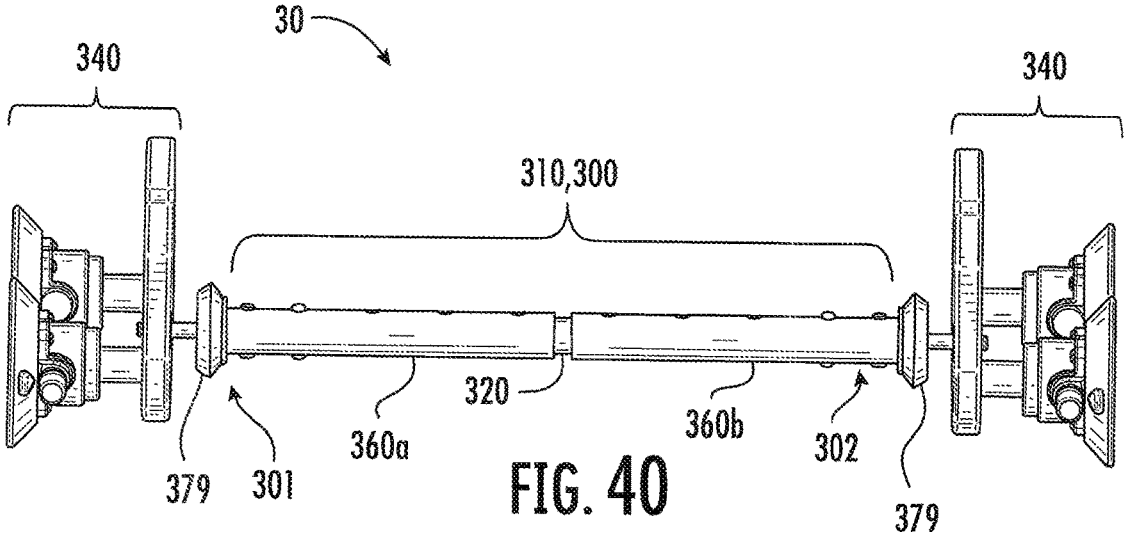
FIG. 40 is a lateral view of the invention embodiment illustrated in FIG. 39.
Figure 41:
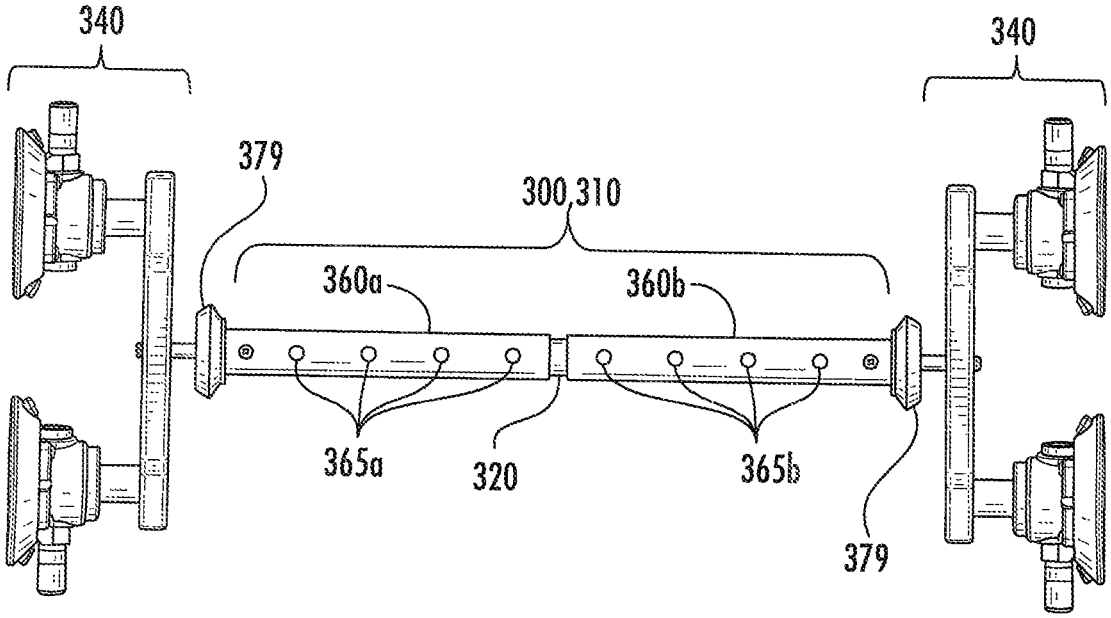
FIG. 41 is a top plan view of the invention embodiment illustrated in FIG. 39.
Figure 42:
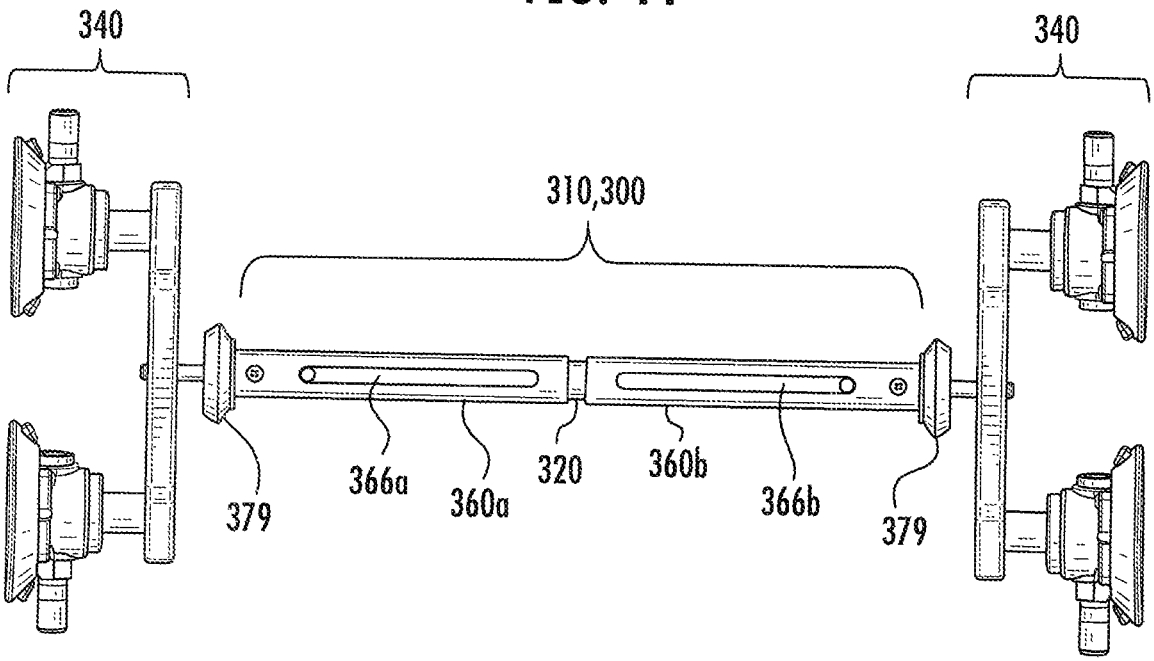
FIG. 42 is a bottom view of the invention embodiment illustrated in FIG. 39.
Figure 43:
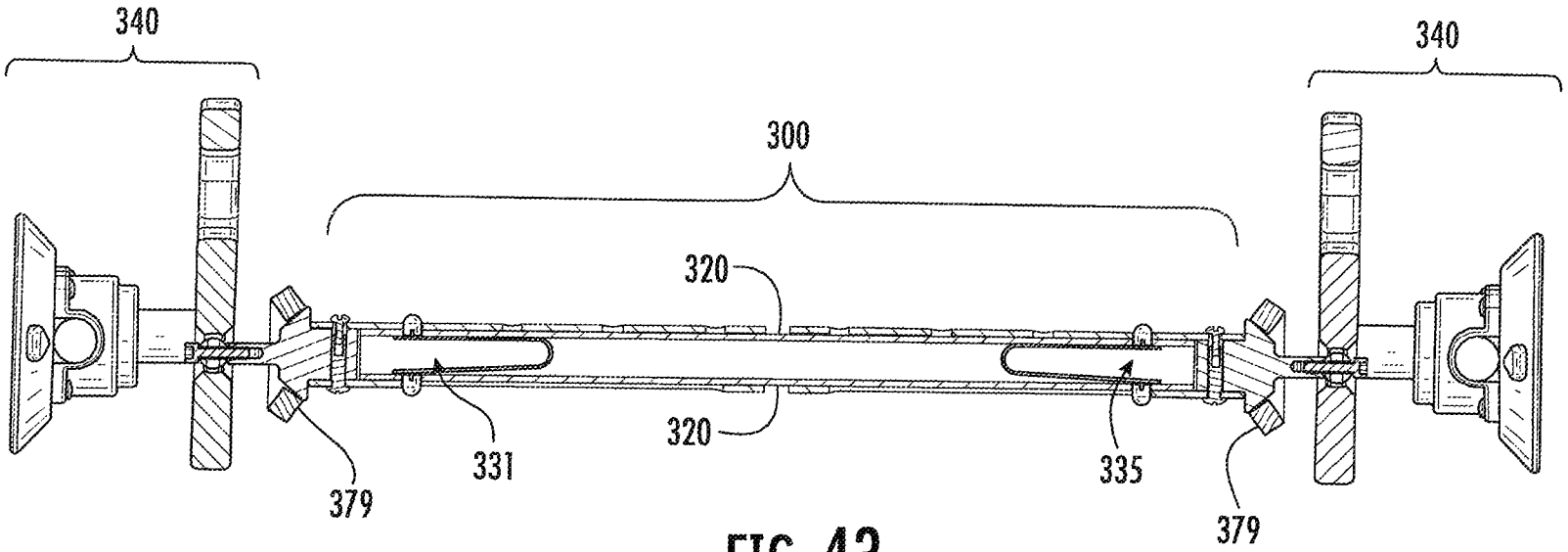
FIG. 43 is a longitudinal cross sectional view of one embodiment for the present invention.
Figure 44:
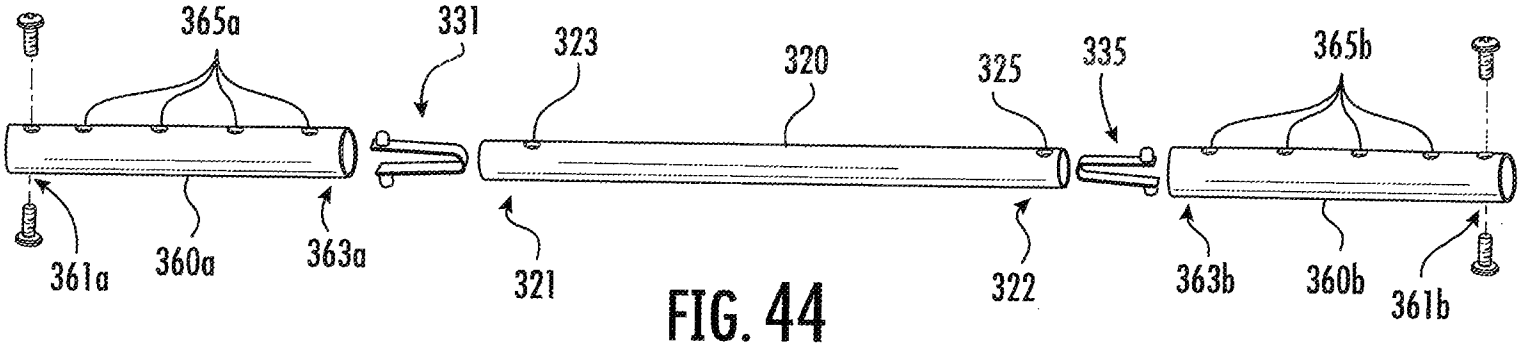
FIG. 44 is an exploded lateral view of a connecting rod member for one embodiment of the present invention.
Figure 45:
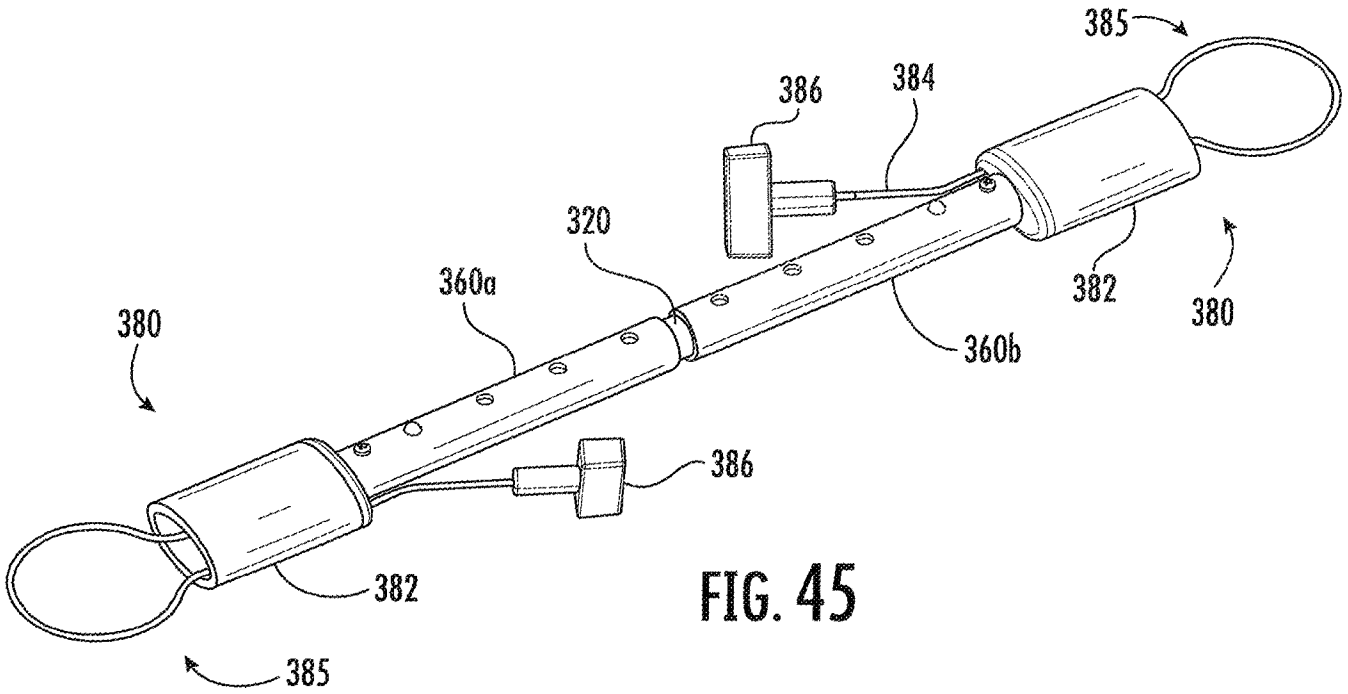
FIG. 45 is perspective view of a connecting rod member with two cleat connector members attached.
Figure 46:
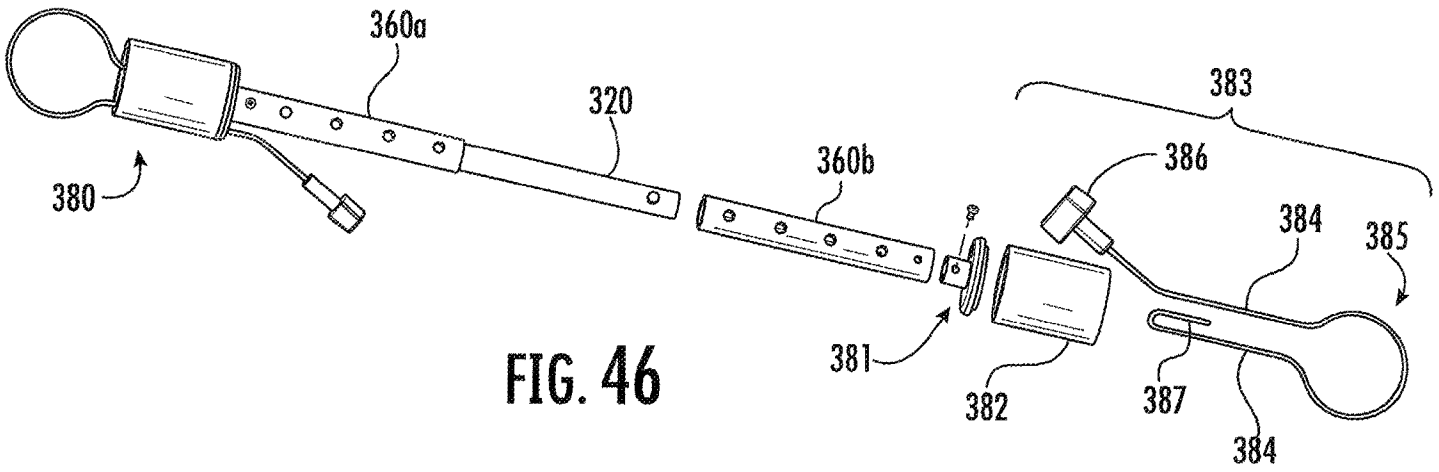
FIG. 46 is a partial exploded view of the connecting rod with two cleat connector members attached illustrated in FIG. 45.
Figure 47:
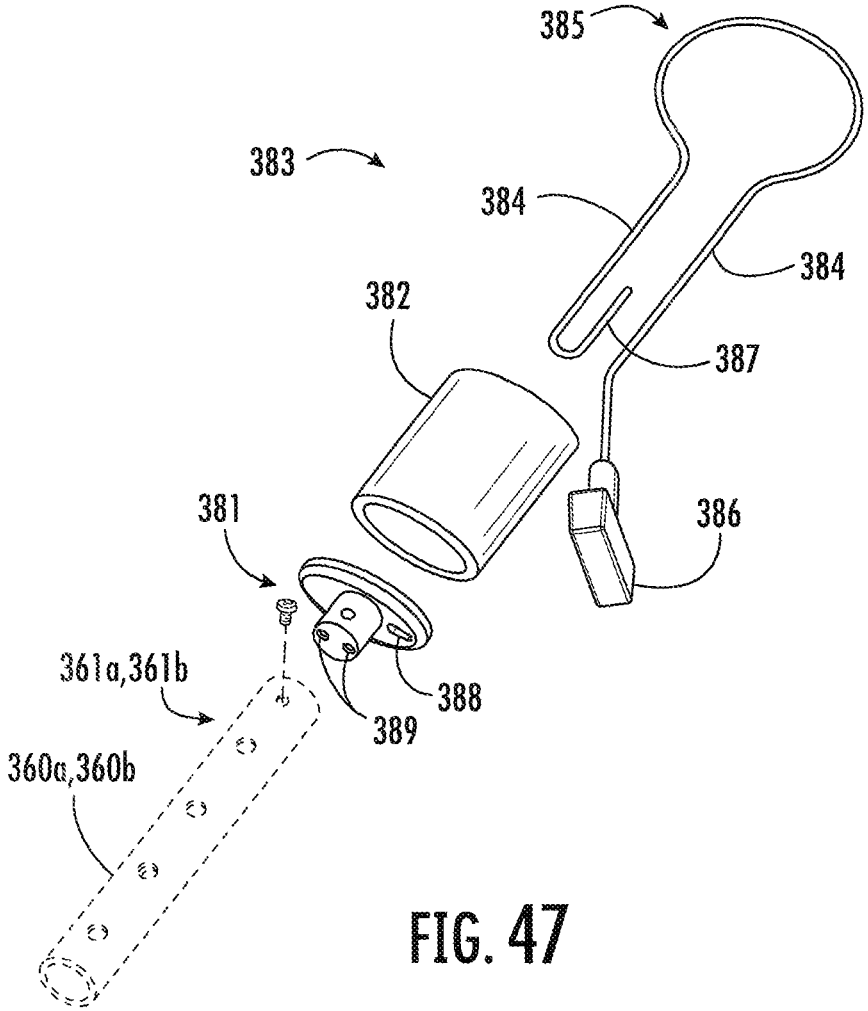
FIG. 47 is an exploded view of a cleat attachment line assembly for one embodiment of the present invention.
Figure 48:
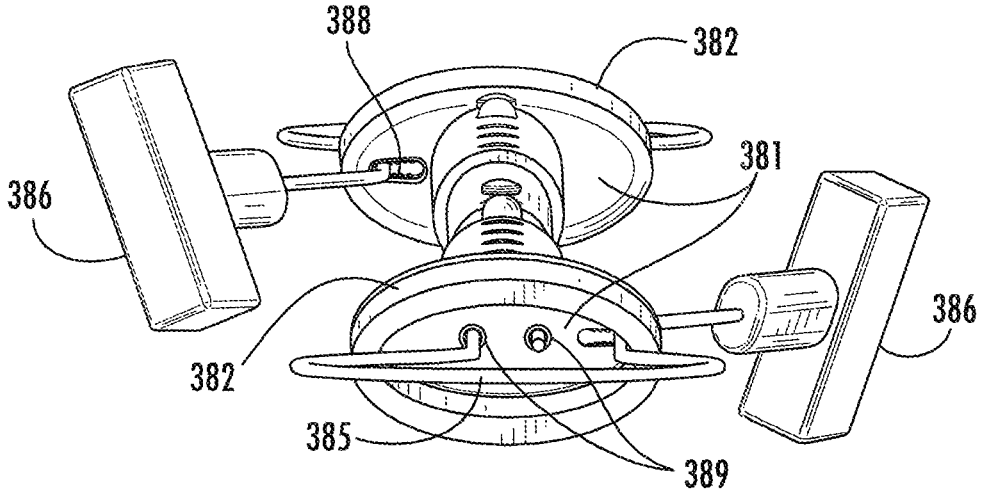
FIG. 48 is an end perspective view of a cleat attachment line assembly for one embodiment of the present invention.
Figure 49:
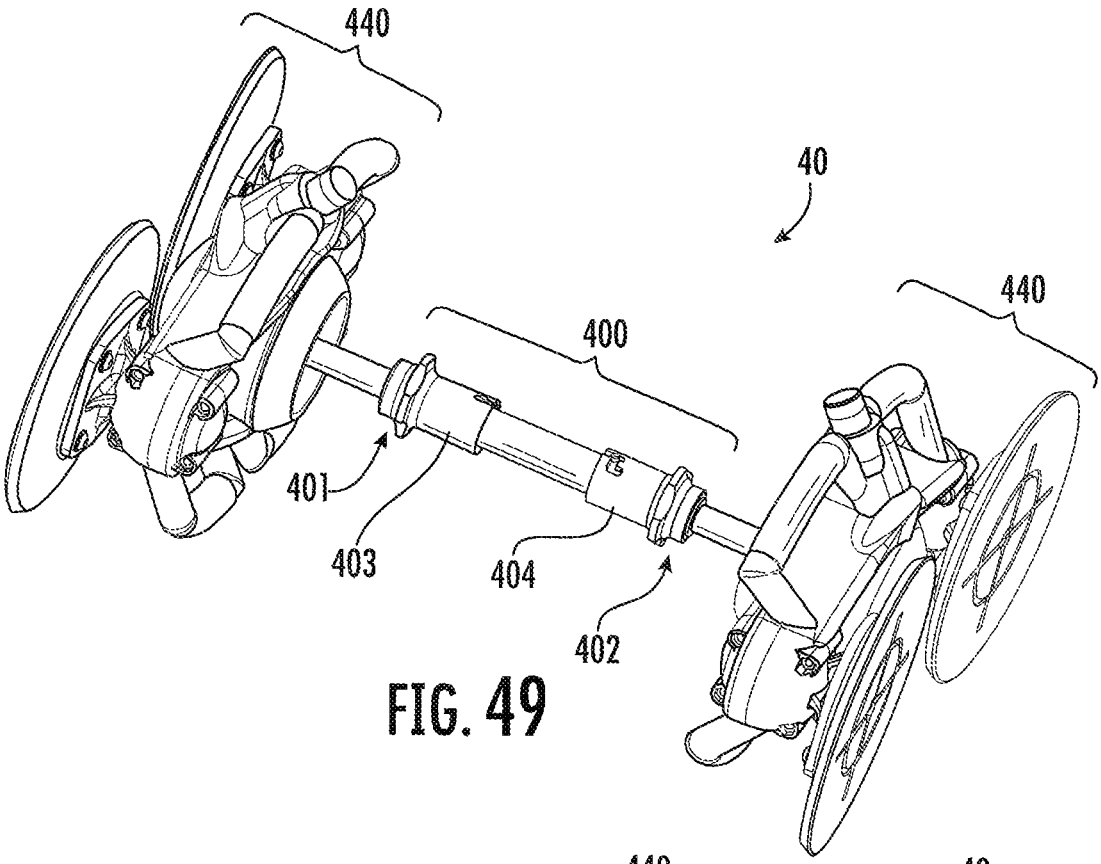
FIG. 49 is a perspective view for one embodiment of the present invention.
Figure 50:
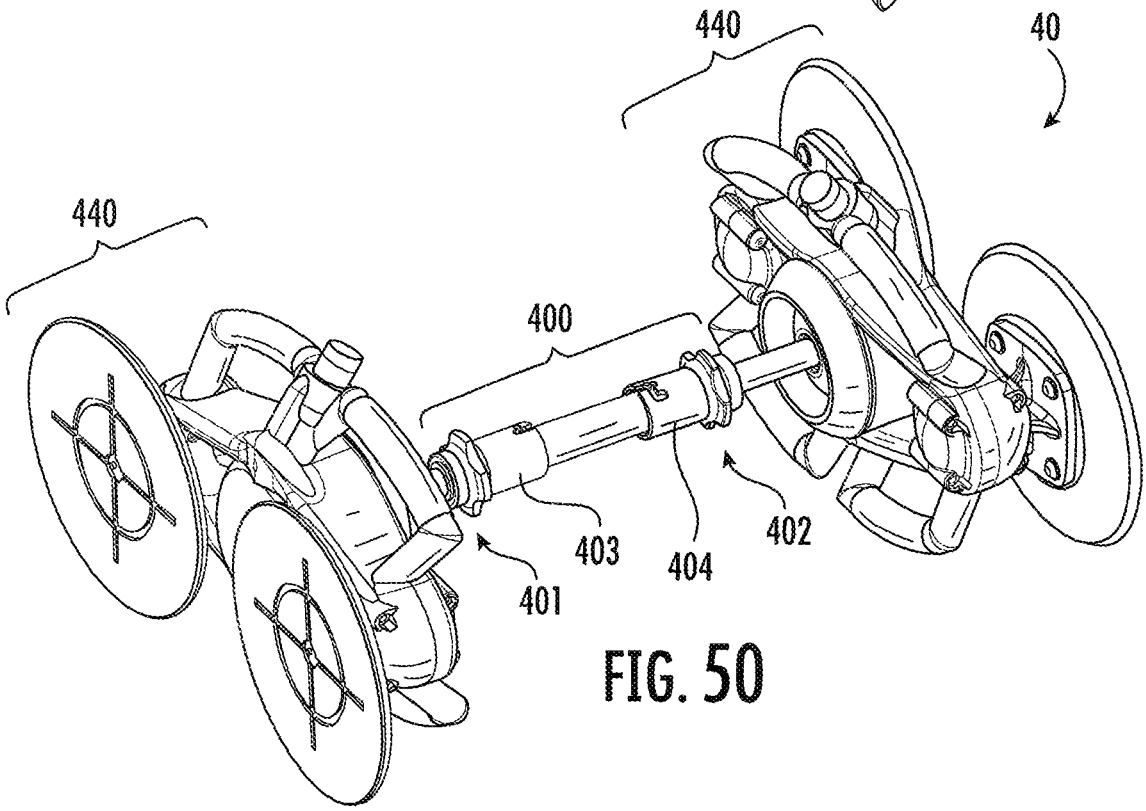
FIG. 50 is an alternate perspective view for the invention embodiment illustrated in FIG. 49.
Figure 51:
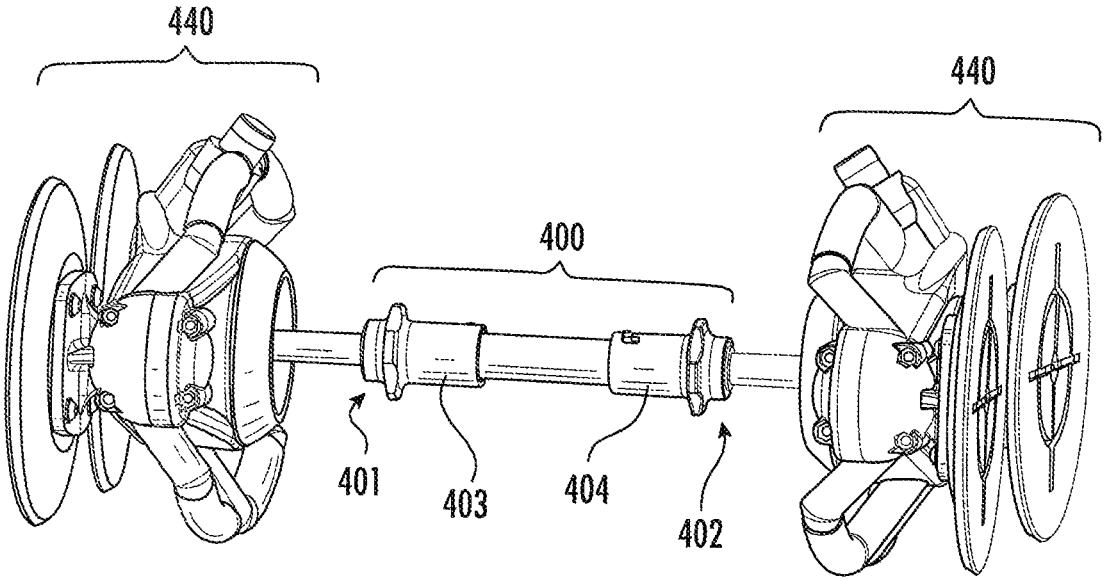
FIG. 51 is a lateral view for the invention embodiment illustrated in FIG. 49.
Figure 52:
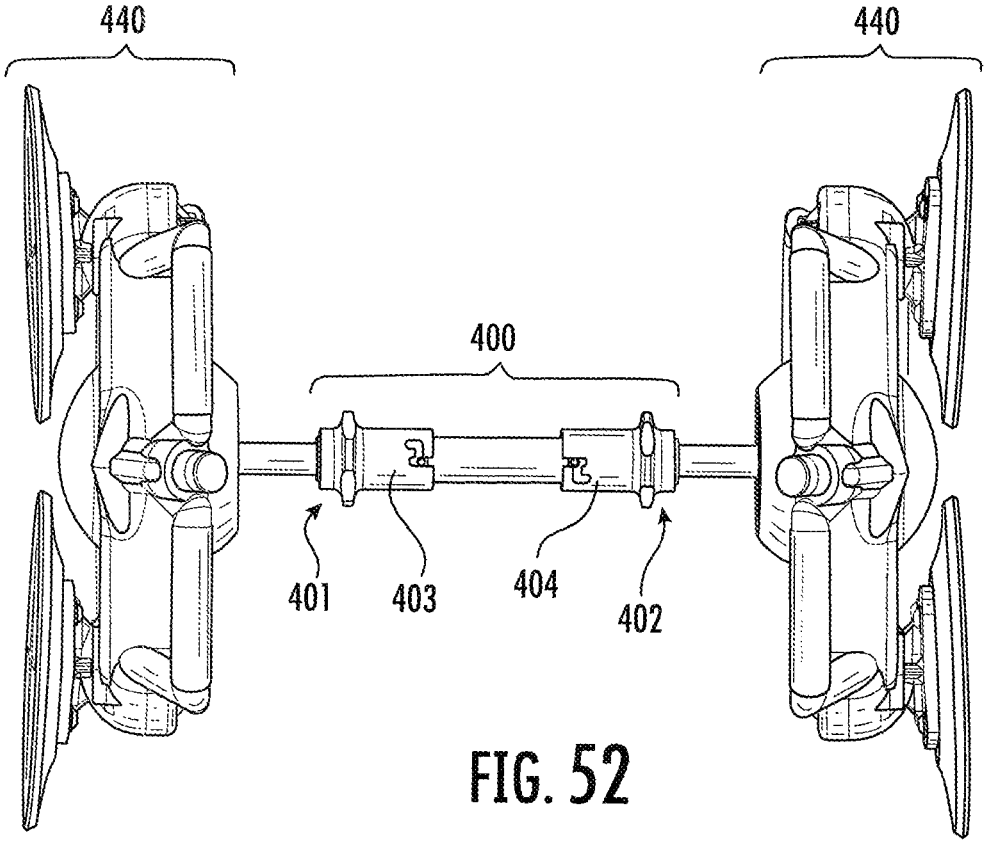
FIG. 52 is top plan view for the invention embodiment illustrated in FIG. 49.
Figure 53:
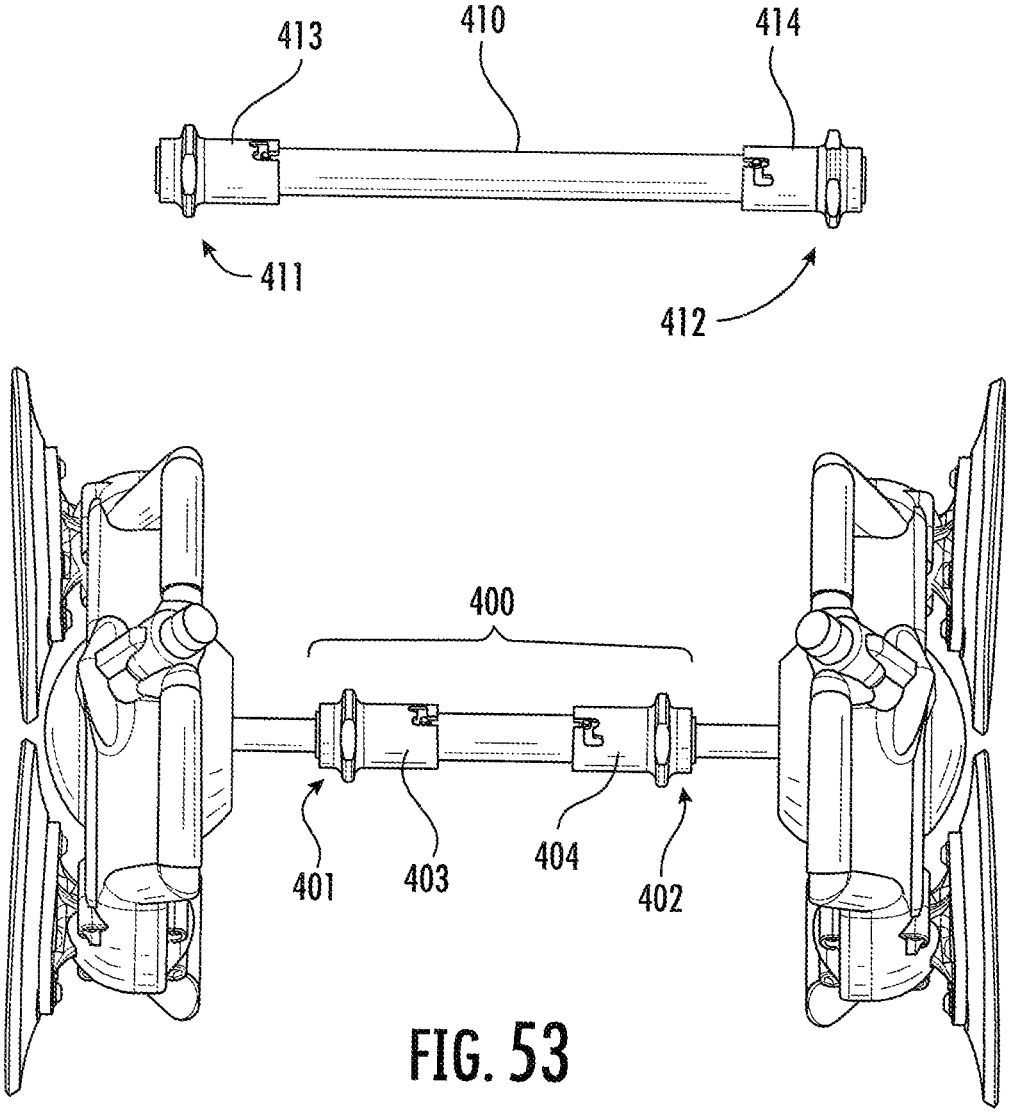
FIG. 53 is top perspective for the invention embodiment illustrated in FIG. 49 with a second connecting rod member.
Figure 54A:
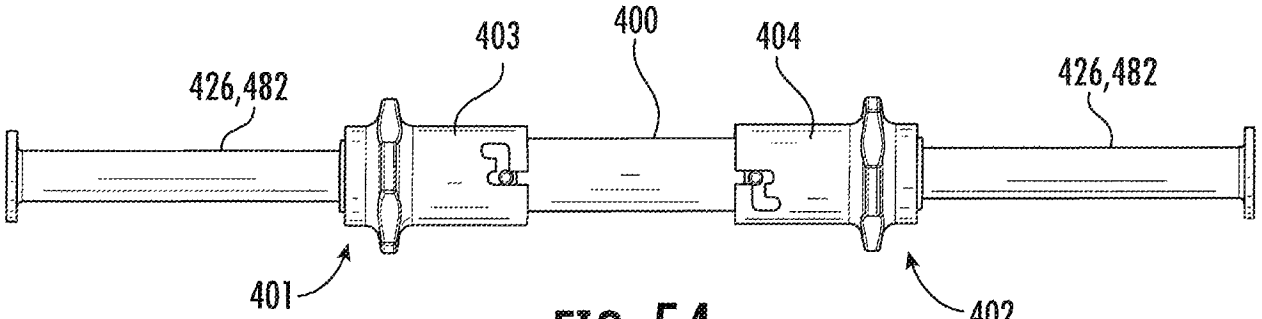
FIG. 54A is a lateral view of a connecting rod member for one embodiment of the present invention.
Figure 54B:
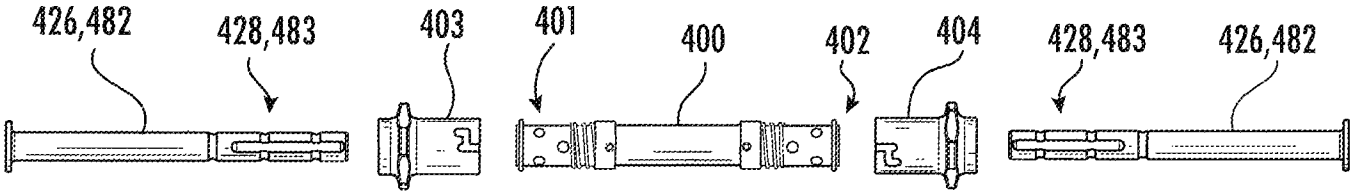
FIG. 54B is an exploded view of the invention embodiment illustrated in FIG. 54A.
Figure 54C:
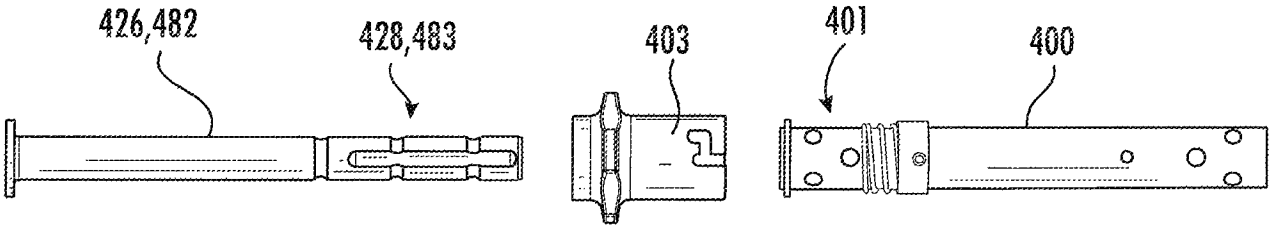
FIG. 54C is an exploded partial view of the invention embodiment illustrated in FIG. 54B.
Figure 55:
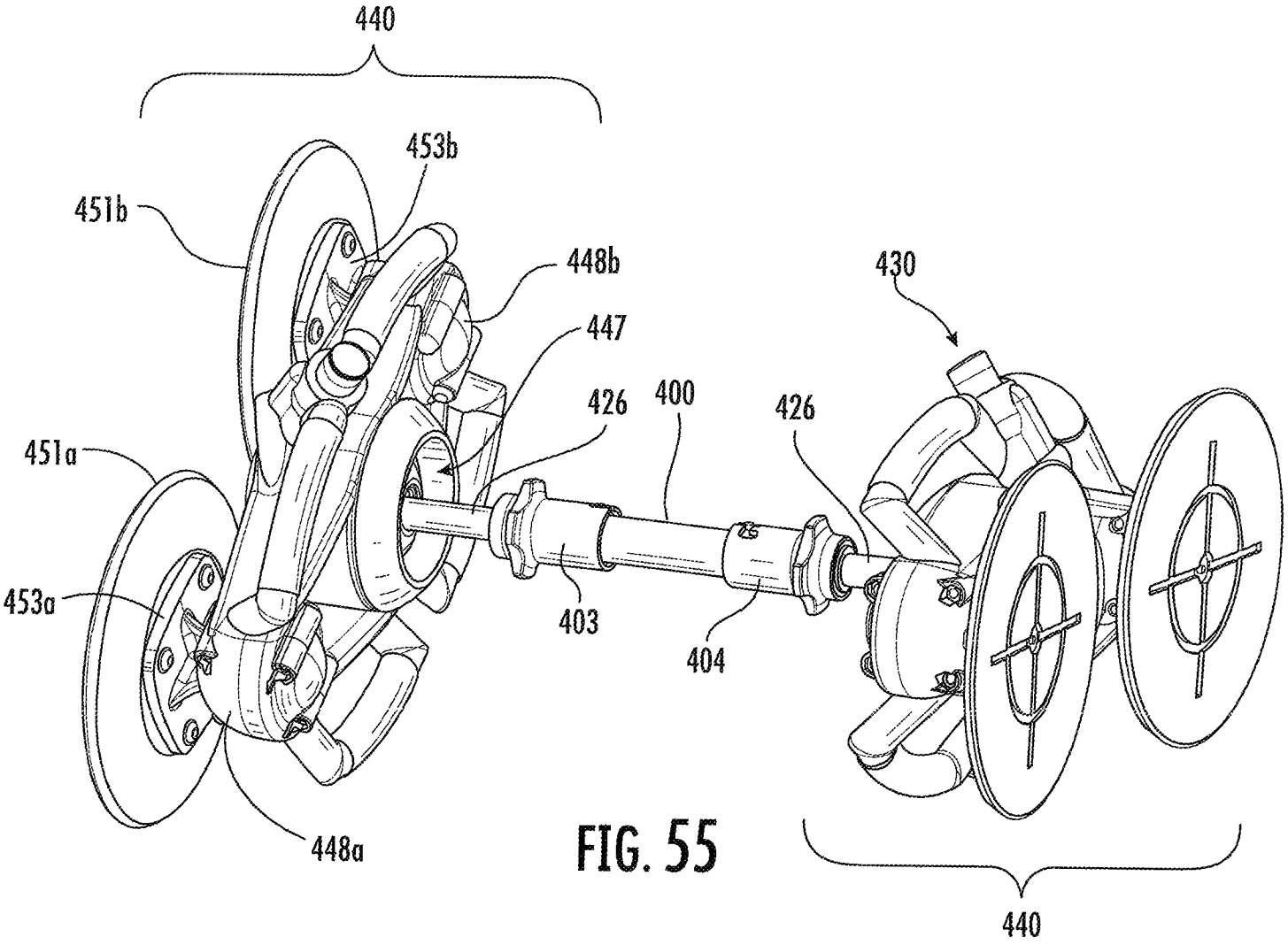
FIG. 55 is a perspective view of one embodiment for the present invention illustrating the rotational capability of an attached vacuum handle member.
Figure 56:
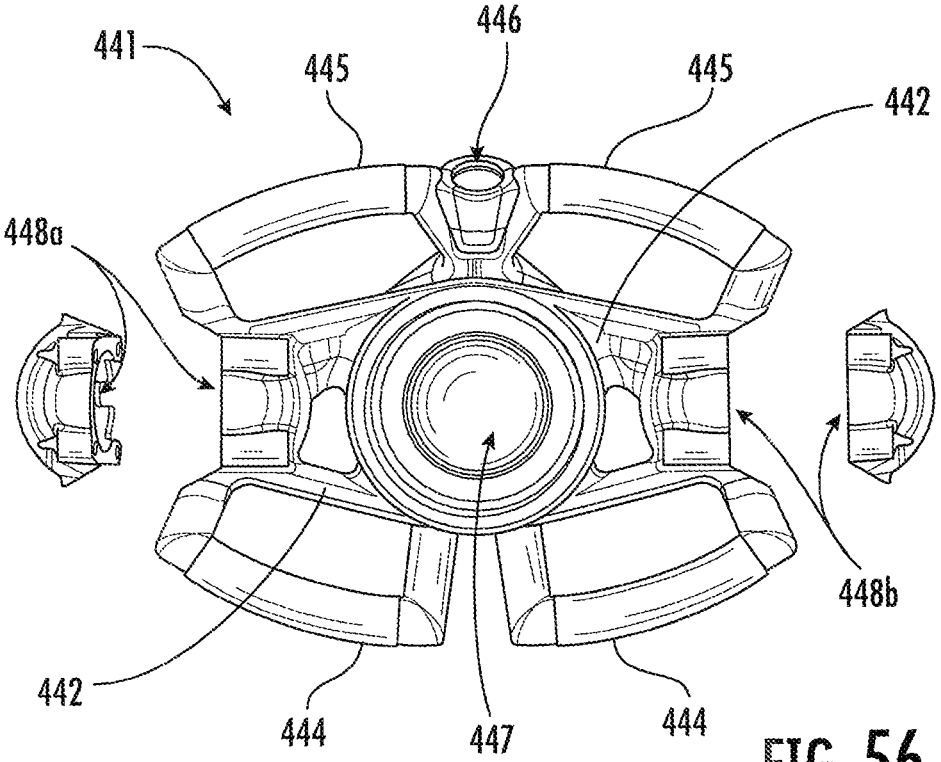
FIG. 56 is an inner surface view of a handle mount for one embodiment of the present invention.
Figure 57:
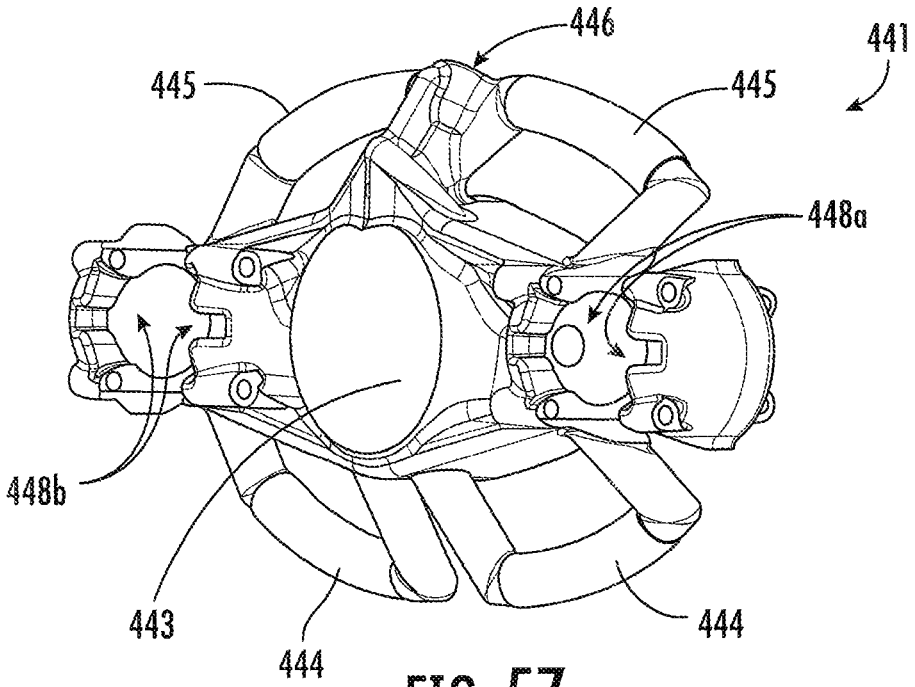
FIG. 57 is a perspective outer surface view of the invention embodiment illustrated in FIG. 56.
Figure 58:
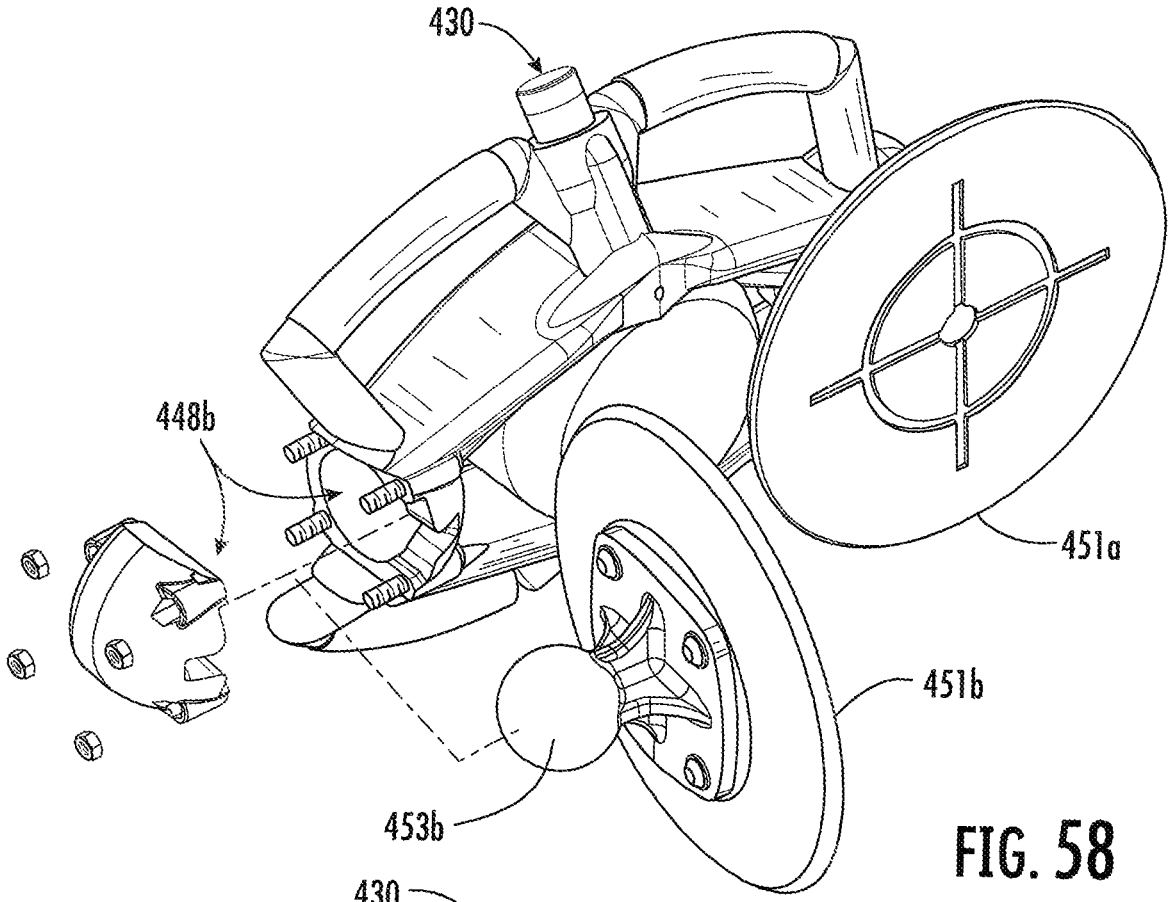
FIG. 58 is a partial exploded perspective view for one embodiment of the present invention.
Figure 59:
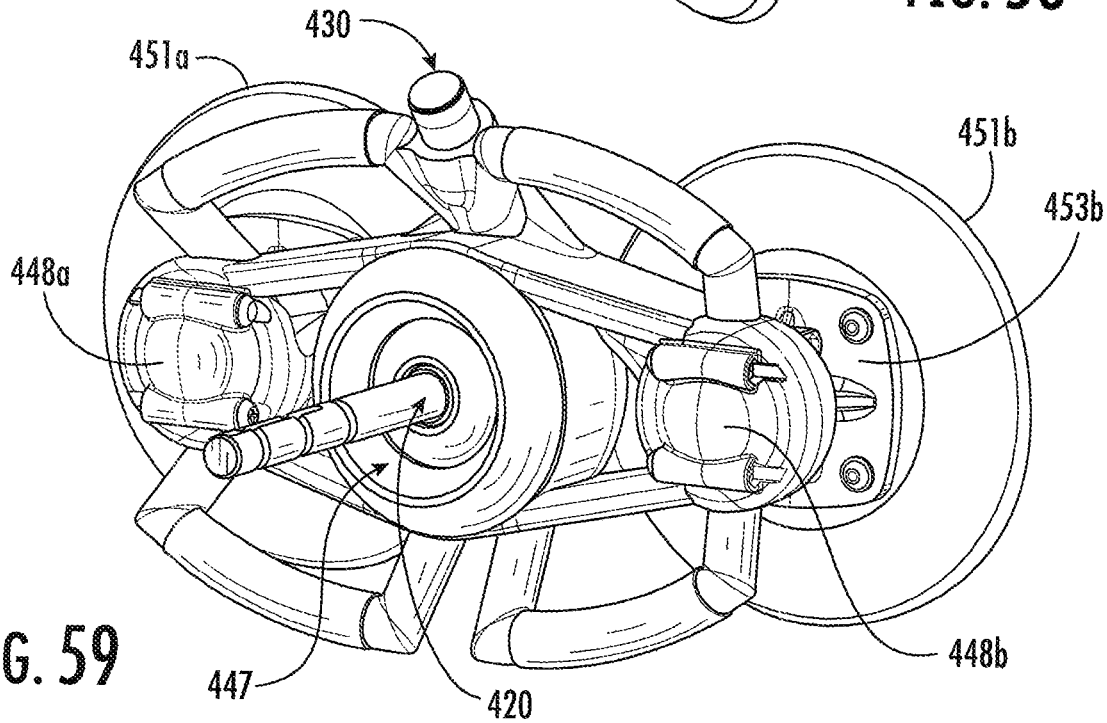
FIG. 59 is an inner perspective view for one embodiment of the present invention.
Figure 60A:
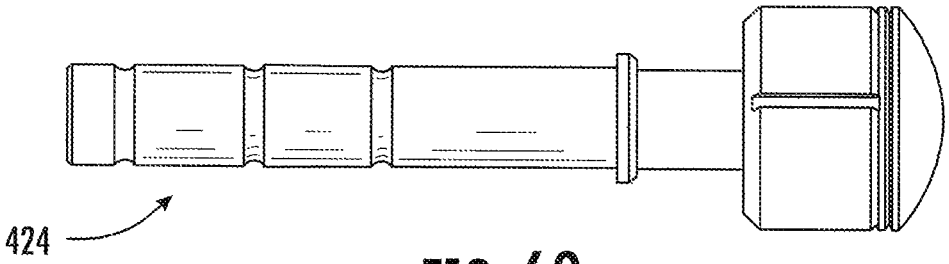
FIG. 60A is a lateral view of a piston for one embodiment of the present invention.
Figure 60B:
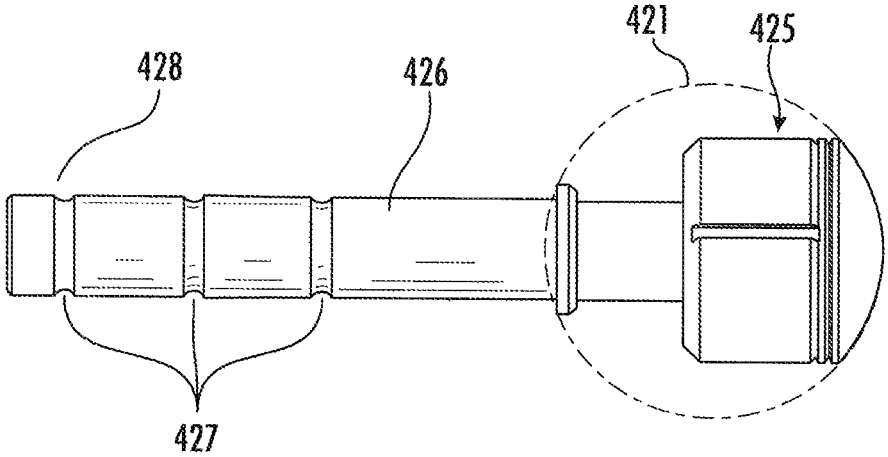
FIG. 60B is an lateral view of a piston illustrating the position of the spherical house for invention embodiment illustrated in FIG. 60B.
Figure 60C:
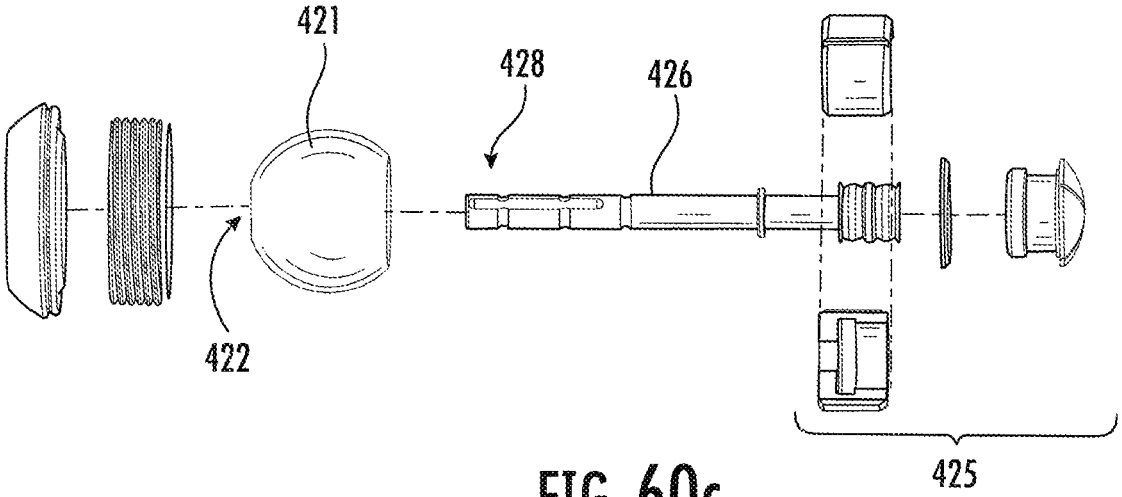
FIG. 60C is an exploded view of the piston illustrated in FIG. 60A for one embodiment of the present invention.
Figure 61:
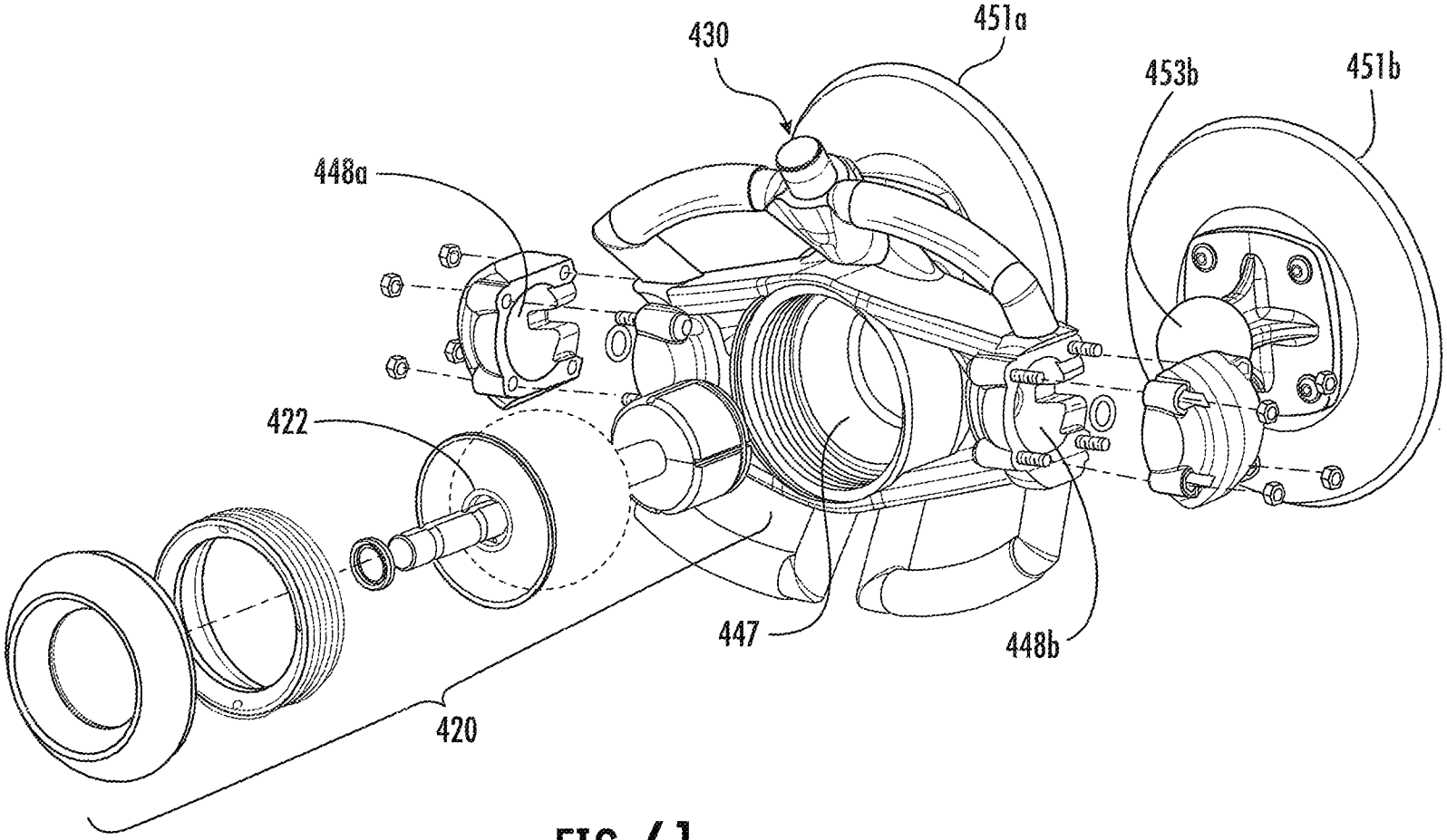
FIG. 61 is an exploded perspective view illustrating a spherical joint continuous vacuum assembly for one embodiment of the present invention.
Figure 62:
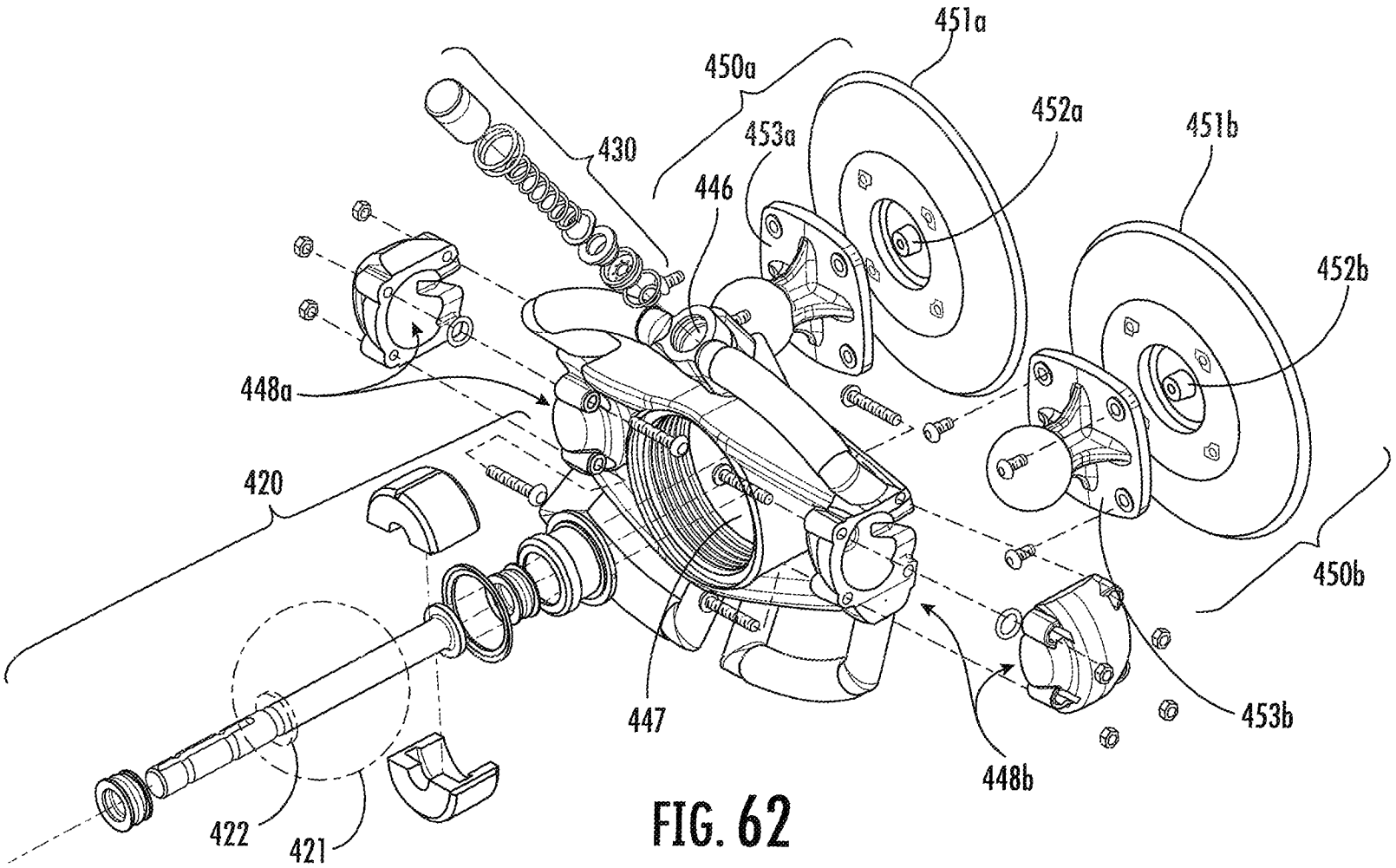
FIG. 62 is a total exploded view of a vacuum handle member for one embodiment of the present invention.
Figure 63:
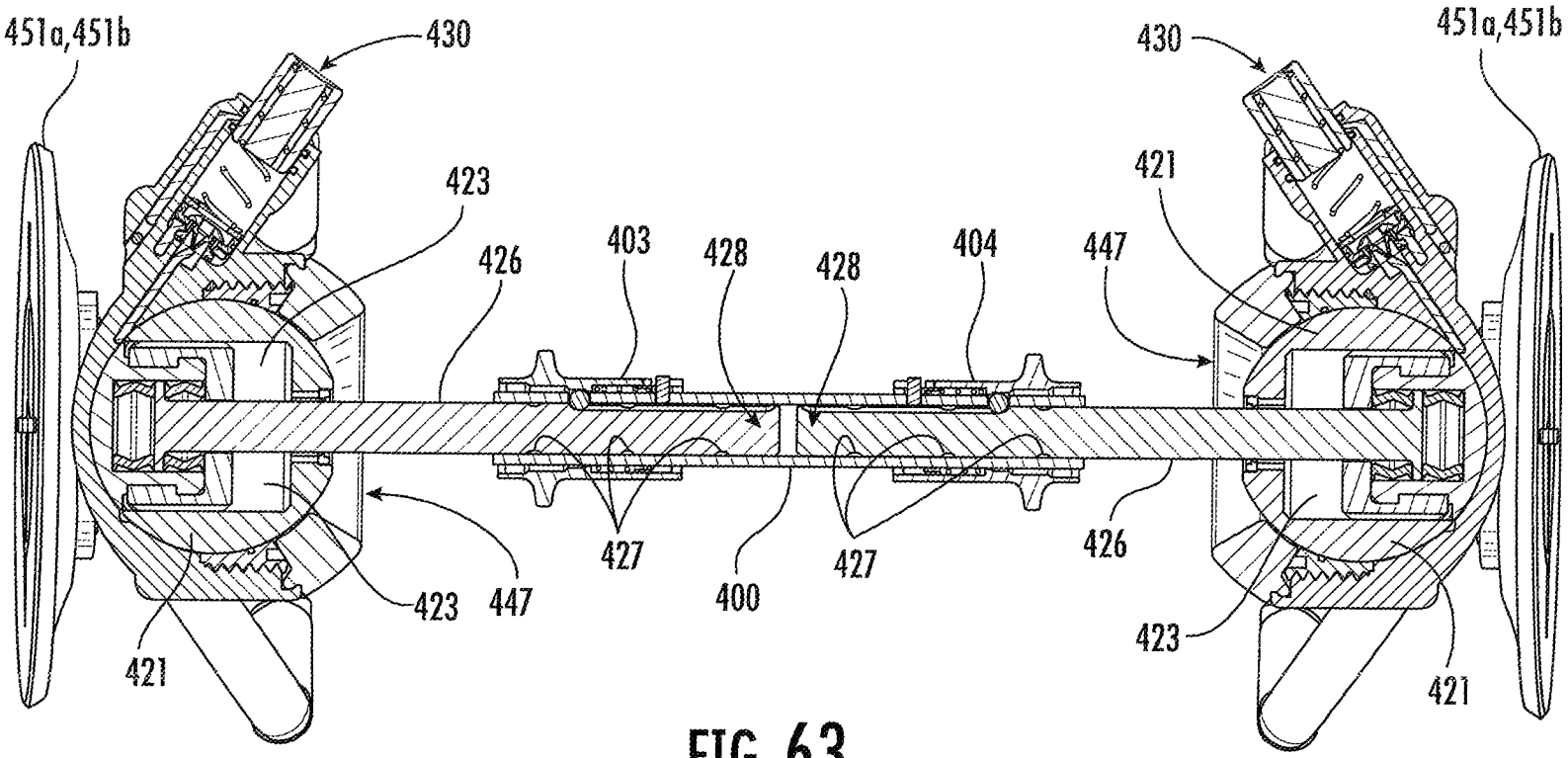
FIG. 63 is a longitudinal cross sectional view for one embodiment of the present invention illustrating tow vacuum handle members connect to a connecting rod member.
Figure 64:
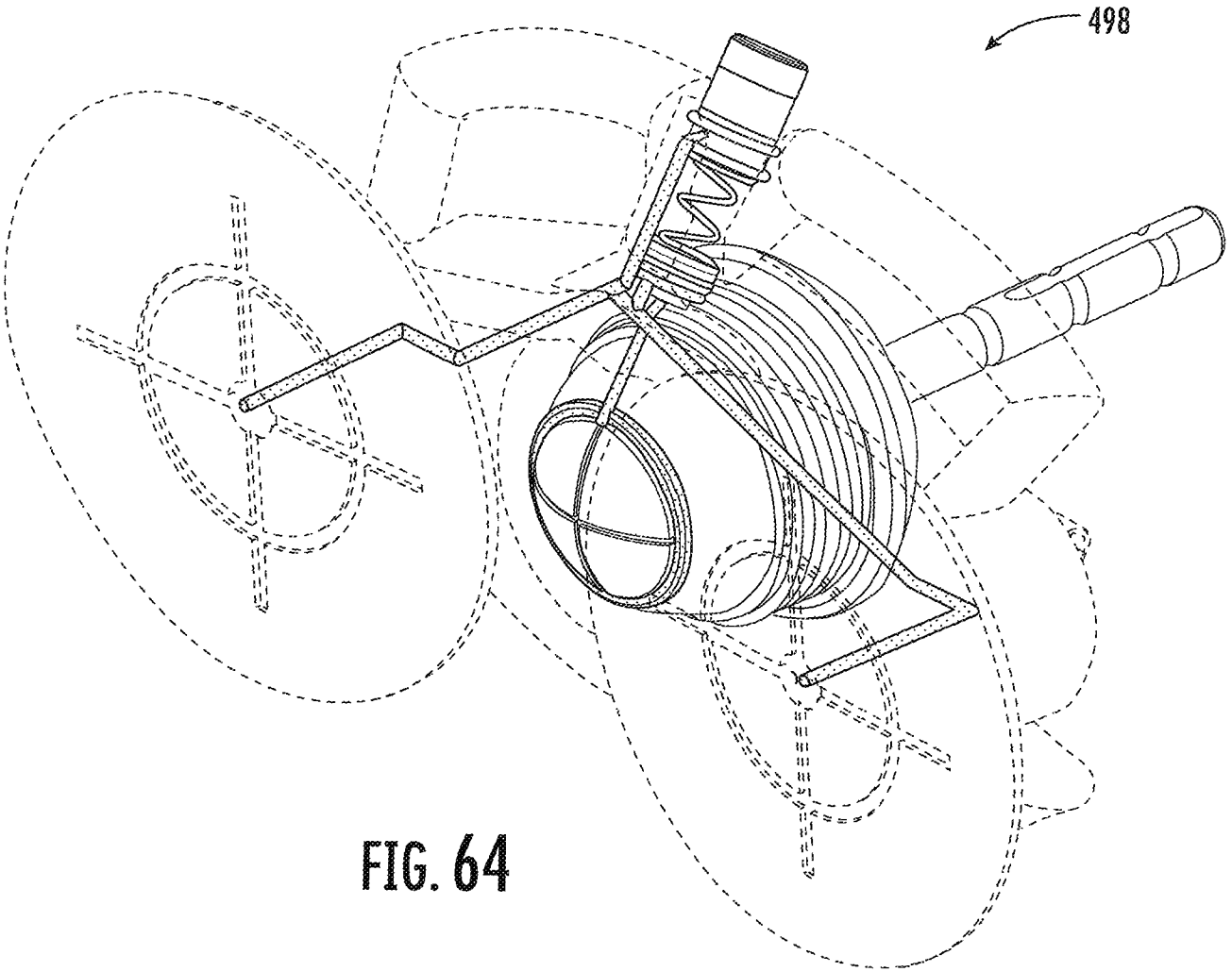
FIG. 64 is an environmental view illustrating the internal vacuum channels for one embodiment of the present invention.
Figure 65:
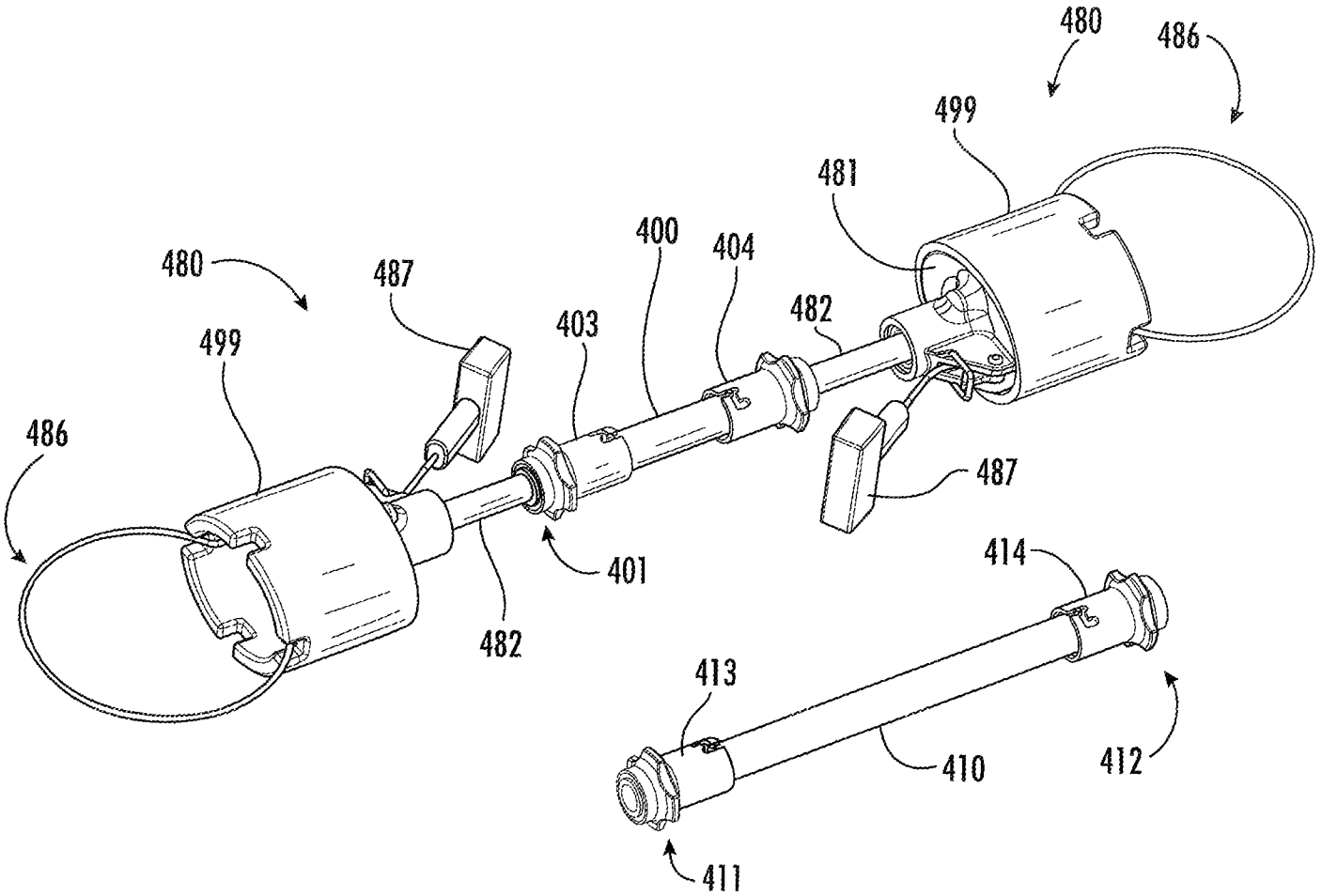
FIG. 65 is a lateral perspective view for one embodiment of the present invention shown with a second connecting rod member.
Figure 66:
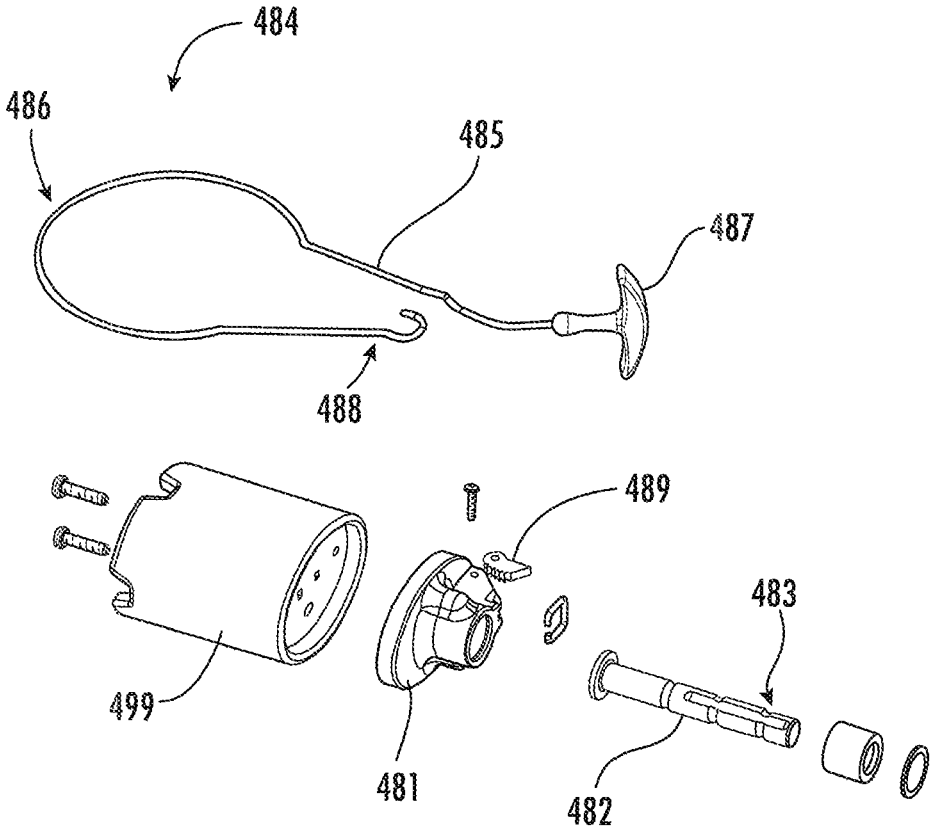
FIG. 66 is an exploded view of a cleat connector member for one embodiment of the present invention.
Figure 67:
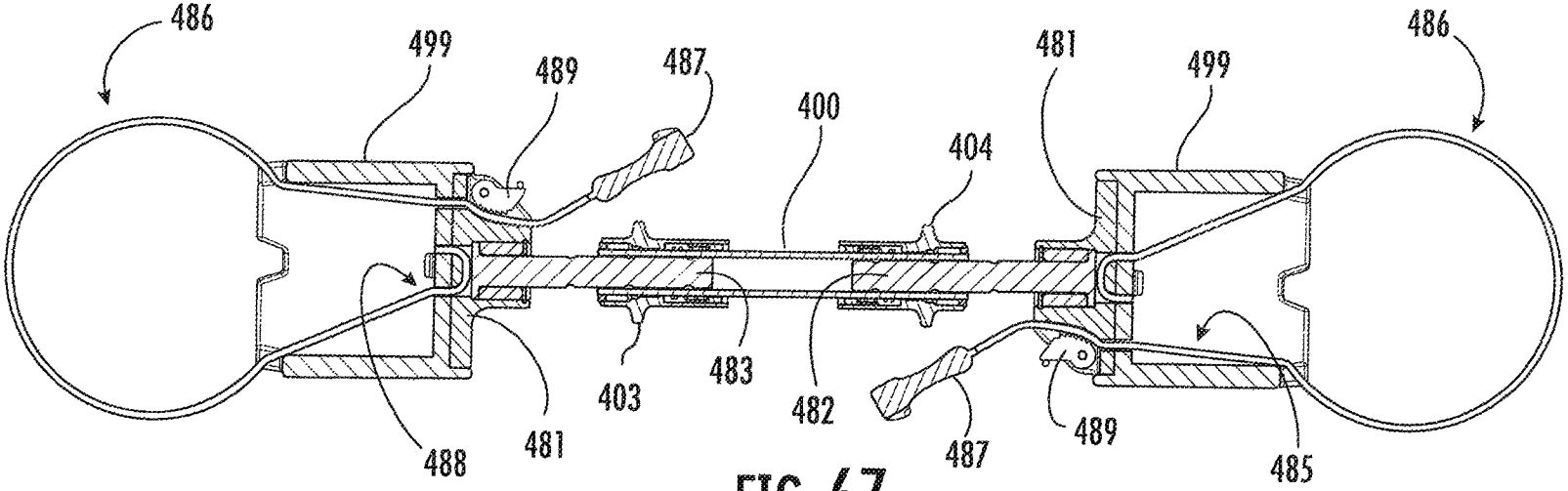
FIG. 67 is a longitudinal cross sectional view for one embodiment of the present invention illustrating a connecting rod member with two cleat connector members attached.

Additionally, the present invention includes features that provides a user the ability to quickly alter the mooring components configuration, as shown in FIGS. 5A, 5B, 5C, and also to easily and quickly increase or decrease the length of the connecting rod member to provide more or less distance between moored watercraft. In the event additional distance between moored watercraft is desired, one preferred embodiment for the present invention includes an coupler extension as a component for the connecting rod member.

The manner of using the present invention is generally the same for each of the disclosed embodiments 1, 2, 3, and 4. The watercraft that are to be temporarily moored to one another are aligned in parallel, bow to bow and stern to stern, with a maximum distance of two feet between the watercraft.

Before installing the present invention inspect the vacuum cups for debris, ensure that the quick release connector/extension lock is in the lock position, and that the safety buoy is attached to the center rod. For best results clean the surface area and moisten the suction cups prior to installing.

Install the present invention on the stern of the first watercraft as close to the watercraft's rub rail as possible. Hold the handle assembly with the thumb plunger vacuum assembly/spherical joint continuous vacuum assembly facing upwards.

Rotate (or move) the vacuum handle member as necessary allowing both vacuum cups to make contact with the watercraft. Apply slight pressure inward allowing the vacuum cups to seal against the watercraft and then pump the (initial) vacuum system pump 4 to 6 times to lock vacuum cups into place. Repeat this process for the bow installation of the present invention. Note: Adjust the length of the connecting rod member as necessary to keep the watercraft parallel.

The vacuum system thumb plunger also serves as a vacuum indicator. As vacuum dissipates from the vacuum cups, the thumb plunger of the thumb plunger vacuum assembly will begin moving outwards. When the red line indicator on the thumb plunger is visible, it will be necessary to pump the thumb plunger of the thumb plunger vacuum assembly to direct additional vacuum into the vacuum cups.

To release the vacuum from the vacuum cups grasp the release tab on the vacuum cup and pull inwards to release the vacuum. For embodiment 4 of the present invention the vacuum is released by pushing the vacuum pump plunger completely down into the cylindrical socket of the thumb operated vacuum plunger assembly.

What is claimed is:

1. A watercraft mooring system comprising:

a connecting rod member having a first end and a second end, the connecting rod member comprising:

a first telescopic member, said first telescopic member being designed and adapted to optionally engage a tubular coupler for connecting the first telescopic member to a second telescopic member;

a first extension lock engaged to the first telescopic member;

a second extension lock engaged to the second telescopic member;

a first vacuum-handle member pivotally secured to the first end of the connecting rod member;

a second vacuum-handle member pivotally secured to the second end of the connecting rod member, each vacuum handle member comprising:

a handle mount; and a vacuum cup assembly secured to the handle mount, said vacuum cup assembly comprising:

a first vacuum cup operationally associated with a first vacuum cup assembly;

a second vacuum cup operationally associated with a second vacuum cup assembly; and at least one vacuum means for providing at least one vacuum to said first and second vacuum cups for detachable attachment of said at least one vacuum-handle member to said at least one watercraft.

2. The watercraft mooring system of claim 1 further comprising:

a counter displacement means for responding to relative movement between a first watercraft and a second watercraft, or between said first watercraft and a dock during temporary mooring of said first watercraft, said counter displacement means comprising:

a torsion spring assembly fastened horizontally over a handle mount connector aperture located on the handle mount, whereby said torsion spring responds to vertical movement between the first watercraft and the second watercraft or between the first watercraft and the dock during the temporary mooring of said first watercraft.

3. The watercraft mooring system of claim 1 wherein the first vacuum-handle member and the second vacuum-handle member are each pivotally secured to their respective ends of the connecting rod member using a swivel joint connector, a ball joint connector, a spherical joint connector, or a combination thereof.

4. The watercraft mooring system of claim 1 wherein each vacuum cup assembly is secured to the handle mount using a swivel joint connector, a ball joint connector, a spherical joint connector, or a combination thereof.

5. The watercraft mooring system of claim 1 wherein the second vacuum-handle member is replaced with a cleat connector member being designed and adapted for detachable attachment to a cleat and for detachable attachment to the second end of the connecting rod member, the cleat connector member comprising a cleat assembly mount designed and adapted for detachable attachment to the connecting rod member second end, and a cleat attachment line assembly operatively affixed to said cleat assembly mount, said cleat attachment line assembly having an adjustable cleat attachment line defining a cleat attachment line loop that operationally engages the cleat.

6. The watercraft mooring system of claim 1 wherein the first vacuum-handle member is replaced with a first cleat connector member being designed and adapted for detachable attachment to a cleat and for detachable attachment to the first end of the connecting rod member, the second vacuum-handle member is replaced with a cleat connector member being designed and adapted for detachable attachment to a cleat and for detachable attachment to the second end of the connecting rod member, the first cleat connector member and the second cleat connector member comprising a cleat assembly mount designed and adapted for detachable attachment to the connecting rod member second end, and a cleat attachment line assembly operatively affixed to said cleat assembly mount, said cleat attachment line assembly having an adjustable cleat attachment line defining a cleat attachment line loop that operationally engages the cleat.

7. The watercraft mooring system of claim 1 further comprising a safety device detachably tethered to the connecting rod member, said safety device designed and adapted to suspend vertically downward towards a water surface to provide a visual warning when the watercraft mooring system is in use.

8. A watercraft mooring system comprising:

a connecting rod member having a first end and a second end;

a first extension lock secured to the first end of the connecting rod member;

a second extension lock secured to the second end of the connecting rod member;

a first piston connecting rod telescopically engaged to the first extension lock;

a second piston connecting rod telescopically engaged to the second extension lock;

a first vacuum-handle member pivotally secured to first piston connecting rod;

a second vacuum-handle member pivotally and removably secured to the second piston connecting rod, each vacuum handle member comprising:

a handle mount engaged to the piston connecting rod;

a vacuum assembly contained within the handle mount;

a first vacuum cup assembly pivotally engaged to the handle mount; and a second vacuum cup assembly pivotally engaged to the handle mount, each vacuum cup assembly comprising:

a vacuum cup mount secured to a vacuum cup and operationally associated with the vacuum assembly.

9. The watercraft mooring system of claim 8 wherein each vacuum cup assembly is secured by the vacuum cup mount to the handle mount using a swivel joint connector, a ball joint connector, a spherical joint connector, or a combination thereof.

10. The watercraft mooring system of claim 8 wherein each vacuum cup assembly is secured by the vacuum cup mount to the handle mount using a swivel joint connector, a ball joint connector, a spherical joint connector, or a combination thereof.

11. The watercraft mooring system of claim 8 wherein the second vacuum-handle member is replaced with a cleat connector member being designed and adapted for detachable attachment to a cleat and for detachable attachment to the second end of the connecting rod member, the cleat connector member comprising a cleat assembly mount designed and adapted for detachable attachment to the connecting rod member second end, and a cleat attachment line assembly operatively affixed to said cleat assembly mount, said cleat attachment line assembly having an adjustable cleat attachment line defining a cleat attachment line loop that operationally engages the cleat.

12. The watercraft mooring system of claim 8 wherein the first vacuum-handle member is replaced with a first cleat connector member being designed and adapted for detachable attachment to a cleat and for detachable attachment to the first end of the connecting rod member, the second vacuum-handle member is replaced with a cleat connector member being designed and adapted for detachable attachment to a cleat and for detachable attachment to the second end of the connecting rod member, the first cleat connector member and the second cleat connector member comprising a cleat assembly mount designed and adapted for detachable attachment to the connecting rod member second end, and a cleat attachment line assembly operatively affixed to said cleat assembly mount, said cleat attachment line assembly having an adjustable cleat attachment line defining a cleat attachment line loop that operationally engages the cleat.

13. The watercraft mooring system of claim 8 further comprising a safety device detachably tethered to the connecting rod member, said safety device designed and adapted to suspend vertically downward towards a water surface to provide a visual warning when the watercraft mooring system is in use.

14. The watercraft mooring system of claim 8 wherein the vacuum assembly contained within the handle mount is a motion-actuated vacuum means for providing a continuous vacuum to the first vacuum cup assembly and to the second vacuum cup assembly to maintain the first vacuum-handle member's detachable attachment and the second vacuum-handle member's detachable attachment to a watercraft or dock;

each handle mount having a handle mount inner surface and a handle mount outer surface, said handle mount defining:

a lower handle grip, an upper handle grip, a handle mount inner surface spherical socket designed and adapted to house the motion-actuated vacuum means, said motion-actuated vacuum means comprising:

a spherical continuous vacuum assembly:

a first vacuum cup ball joint socket, designed and adapted to mount/secure said first vacuum cup assembly;

a second vacuum cup ball joint socket, designed and adapted to mount/secure said second vacuum cup assembly;

a vacuum channel connecting said motion-actuated vacuum means to said first vacuum cup assembly and said second vacuum cup assembly.

15. The watercraft mooring system of claim 8 wherein the vacuum assembly contained within the handle mount is a motion-actuated vacuum means for providing a continuous vacuum to the first vacuum cup assembly and to the second vacuum cup assembly to maintain the first vacuum-handle member's detachable attachment and the second vacuum-handle member's detachable attachment to a watercraft or dock;

each handle mount having a handle mount inner surface and a handle mount outer surface, said handle mount defining:

a lower handle grip, an upper handle grip, a cylindrical socket being defined by said upper handle grip and designed and adapted to house an initial vacuum means, the initial vacuum means comprising a thumb-plunger vacuum assembly;

a plurality of vacuum channels operatively connecting said initial vacuum means and said motion-actuated vacuum means to said first and second vacuum cup assemblies, a handle mount inner surface spherical socket designed and adapted to house the motion-actuated vacuum means, said motion-actuated vacuum means comprising:

a spherical continuous vacuum assembly;

a first vacuum cup ball joint socket, designed and adapted to mount/secure said first vacuum cup assembly;

a second vacuum cup ball joint socket, designed and adapted to mount/secure said second vacuum cup assembly;

a second vacuum channel connecting said motion-actuated vacuum means to said first vacuum cup assembly and said second vacuum cup assembly.

16. The watercraft mooring system of claim 1 wherein, said vacuum-handle member including a separation distance for optimal functionality of said vacuum-handle member, said separation distance being 1.5 inches.

* * * * *